US006057817A

United States Patent [19]

Ono et al.

[11] Patent Number: 6,057,817

[45] Date of Patent: May 2, 2000

[54] LIQUID CRYSTAL DISPLAY DEVICE HAVING BISTABLE NEMATIC LIQUID CRYSTAL AND METHOD OF DRIVING THE SAME

[75] Inventors: Toshiomi Ono, Machida; Soichi Sato, Ome; Tetsushi Yoshida, Kanagawa-ken; Toshihiro Mannoji, Hachioji, all of Japan

[73] Assignee: Casio Computer Co., Ltd., Tokyo, Japan

[21] Appl. No.: 08/990,789

[22] Filed: Dec. 15, 1997

[30] Foreign Application Priority Data

| | | | |
|---|---|---|---|
| Dec. 17, 1996 | [JP] | Japan | 8-336519 |
| Dec. 19, 1996 | [JP] | Japan | 8-339602 |
| Dec. 19, 1996 | [JP] | Japan | 8-339603 |
| Dec. 20, 1996 | [JP] | Japan | 8-341385 |
| Dec. 24, 1996 | [JP] | Japan | 8-344150 |
| Dec. 24, 1996 | [JP] | Japan | 8-344151 |
| Dec. 24, 1996 | [JP] | Japan | 8-344152 |
| Dec. 24, 1996 | [JP] | Japan | 8-344153 |
| Dec. 26, 1996 | [JP] | Japan | 8-348503 |

[51] Int. Cl.[7] ..... G09G 3/36

[52] U.S. Cl. ..... 345/94; 345/87; 349/128

[58] Field of Search ..... 345/50, 87, 94, 345/95, 96, 97, 99, 204, 211; 349/33, 94, 96, 103, 127, 128, 129, 179, 120, 177

[56] References Cited

U.S. PATENT DOCUMENTS

| | | | |
|---|---|---|---|
| 3,837,730 | 9/1974 | Hatfield et al. | 349/34 |
| 4,239,345 | 12/1980 | Berreman et al. | 349/179 |
| 5,900,852 | 5/1999 | Tanaka et al. | 345/95 |

*Primary Examiner*—Dennis-Doon Chow

*Attorney, Agent, or Firm*—Frishauf, Holtz, Goodman, Langer & Chick, P.C.

[57] ABSTRACT

A liquid crystal cell includes scanning and signal electrodes, and a bistable nematic liquid crystal material sealed therein. The material has liquid crystal molecules alignable in first and second metastable aligned states by selective application of twist select voltages smaller than a reset voltage after application of the reset voltage. A tilt angle of the liquid crystal molecules is controlled in the first and second metastable aligned states in accordance with an effective value of a voltage applied between the opposing electrodes. A row driver, in accordance with display data, supplies a reset potential for applying the reset voltage between the electrodes, and a write-period voltage for designating a period for applying a voltage with an effective value according to the display data between the electrodes, to scanning electrodes. A data driver, in accordance with the display data, supplies a metastable-aligned-state selecting voltage for selectively applying a first metastable-aligned-state selecting voltage and a second metastable-aligned-state selecting voltage between the electrodes, and a write voltage corresponding to the voltage with the effective value according to the display data, to the signal electrodes in synchronism with the reset voltage and said write-period voltage.

26 Claims, 35 Drawing Sheets

LIQUID CRYSTAL DISPLAY DEVICE HAVING BISTABLE NEMATIC LIQUID CRYSTAL AND METHOD OF DRIVING THE SAME

BACKGROUND OF THE INVENTION

1. Field of the Invention

The present invention relates to a liquid crystal display device having bistable nematic liquid crystal and also to a method of driving the liquid crystal display device.

2. Description of the Related Art

Liquid crystal display devices are classified into two types. The first type is known as a transmissive display which uses the light emanating from a back light. The second type is known as a reflective display which utilizes external light such as natural light and light emitted from lamps on the ceiling.

A liquid crystal display of either type comprises a front polarizing plate, a rear polarizing plate, and a liquid crystal cell interposed between the polarizing plates. A reflective liquid crystal display further comprises a reflective plate laid on the outer surface of the rear polarizing plate.

The liquid crystal cell comprises a pair of substrates and liquid crystal held in the gap between the substrates. Each of the substrates has a number of electrodes arranged on its inner surface and an aligning film covering the electrodes. The aligning film aligns the molecules of the liquid crystal near the substrate, in a specific aligned state (e.g., twist-aligned state).

A drive signal is applied between electrodes of pixels to drive the liquid crystal display device. When the drive signal is applied to between the electrodes of the pixel, the molecules of the liquid crystal are tilted to the substrates. And passage of light depends on how much the liquid crystal molecules are tilted to the substrates.

Two types of liquid crystal cells are known. The first type is a simple matrix cell in which the electrodes provided on the inner surface of the first substrate intersect with those provided on the inner surface of the second substrate. The second type is an active matrix cell whose one active element is connected to each electrode. The simple matrix cell is advantageous in a point that it can be made at a lower cost because of its simple structure.

In a liquid crystal display having a simple matrix cell, the effective value (the effective value of voltage to be applied between the electrodes in a predetermined period) of a drive signal applied between the electrodes of each pixel for a predetermined time is controlled to display an image. To display a gray-scale image, the drive signal is time-divided into segment drive signals. The segment drive signals are sequentially applied between the electrodes of the pixel, thereby changing stepwise the amount of light passing through the pixel. The more minutely the drive signal is time-divided, the smaller the difference between the effective values of any two segment signals which correspond to gray-scale levels. When the liquid crystal cell is driven in high-duty time division, the operating voltage margin (i.e., the difference between the effective values) is inevitably too narrow for the display to provide clear gray-scale images.

The liquid crystal display having a simple matrix cell can hardly be driven in high-duty time division. Therefore, the display cannot have an increased number of pixels to display clear gray-scale images.

SUMMARY OF THE INVENTION

The object of the present invention is to provide a liquid crystal display device which can be driven in high-duty time division, which has a large number of pixels and which can display clear gray-scale images.

To achieve the object, a liquid crystal display using bistable nematic liquid crystal, according to a first aspect of the present invention comprises:

a liquid crystal cell having a pair of substrates having opposing electrodes and aligning films respectively formed on opposing inner surfaces of said substrates, said aligning films having been subjected to an aligning treatment in a predetermined direction, and a liquid crystal layer of a bistable nematic liquid crystal material, sealed between said pair of substrates and having liquid crystal molecules selectively alignable in one of a first metastable aligned state and a second metastable aligned state different from each other by selective application of a twist select voltage having a plurality of different predetermined voltage values smaller than a voltage value of a reset voltage after application of said reset voltage, said voltage value of said reset voltage being such as to align said liquid crystal molecules substantially perpendicular to said substrates, a tilt angle of said liquid crystal molecules to said substrates being controlled in said first metastable aligned state and said second metastable aligned state in accordance with an effective value of a voltage to be applied to said opposing electrodes;

at least one polarizing plate located on one outer side or both outer sides of said pair of substrates;

a first driver for, in accordance with display data externally supplied, supplying a reset potential for applying said reset voltage between said electrodes, and a write-period voltage for designating a period for applying a voltage with an effective value according to said display data between said electrodes, both to one of said electrodes of said pair of substrates;

a second driver for, in accordance with said display data, supplying a metastable-aligned-state selecting voltage for selectively applying a first metastable-aligned-state selecting voltage and a second metastable-aligned-state selecting voltage between said electrodes, and a write voltage corresponding to said voltage with said effective value according to said display data, both to the other electrode of said pair of substrates respectively in synchronism with said reset voltage and said write-period voltage; and a power source for supplying said reset voltage, said write-period voltage, said metastable-aligned-state selecting voltage and said write voltage to said first driver and said second driver.

This liquid crystal display device using bistable nematic liquid crystal can display a plurality of gray-scales or display colors, and drive a display device with relatively high duty.

Said opposing electrodes may include a plurality of scan electrodes arranged in a stripe form on one of said substrates and a plurality of signal electrodes so arranged as to intersect said scan electrodes, and said pair of substrates and said liquid crystal layer constitute a simple matrix type liquid crystal cell.

Said opposing aligning films may cause said liquid crystal to be spray-strained by a twist angle of 0° to 180° in an initial aligned state;

said first metastable aligned state is a state where said liquid crystal is twisted by a twist angle which is 180° plus said twist angle in said initial aligned state; and said second metastable aligned state is a state where said liquid crystal is twisted by a twist angle which is 180° subtracted from said twist angle in said initial aligned state.

At least one of said reset voltage and said metastable-aligned-state selecting voltage may be comprised of an AC voltage.

The application of an AC voltage prevents liquid crystal from being degraded due to local application of a DC component to the liquid crystal, and prevents an afterimage from being produced by an ionic impurity locally present in the liquid crystal.

Said reset voltage may be greater than a minimum voltage value necessary to align said liquid crystal molecules substantially perpendicular to said substrates. In this case, an application period for said reset voltage may be set shorter than a time for said liquid crystal molecules to be aligned substantially perpendicular to said substrates by application of said minimum voltage value.

This structure can shorten the period of applying the reset voltage, and increase the frame frequency to prevent flickering or the like.

Said reset voltage may include a reset voltage of a first frequency by which said liquid crystal molecules shows a positive dielectric anisotropy and a reset voltage of a second frequency by which said liquid crystal molecules shows zero or a negative dielectric anisotropy. In this case, said first driver may apply said reset voltage of said first frequency to said one electrode which is to be set in one of said first and second metastable aligned states, and applies said reset voltage of said second frequency to said one electrode which is to hold said previously set first or second metastable aligned state.

Controlling the alignment of the liquid crystal molecules by the frequency signal eliminates the need for precise control on the applied voltage and can thus simplify the device structure.

Said second driver may have means for frequency-modulating a voltage and applying said frequency-modulated voltage to said other electrode.

Said second driver may have means for performing pulse width modulation on a voltage and applying said pulse-width-modulated voltage to said other electrode.

Those structures facilitate voltage control to thereby ensure easier alignment control as compared with the case where the applied voltage itself is controlled to control the aligned state of the liquid crystal molecules.

Said first and second drivers may apply said metastable-aligned-state selecting voltage after applying said reset voltage to said liquid crystal.

It is desirable that after applying said reset voltage even to liquid crystal of pixels whose metastable aligned state to be selected is the same as a previous one, said first and second drivers apply said metastable-aligned-state selecting voltage to said liquid crystal, thereby setting an old metastable aligned state again.

This structure can keep certainly the metastable aligned state the liquid crystal molecules assume, and shorten the time for aligning the molecules in accordance with the effective value of the voltage under the same metastable aligned state, in other words, make the response speed faster.

Said pair of substrates, said liquid crystal layer sealed between said pair of substrates, and said at least one polarizing plate located outside said pair of substrates may form a liquid crystal cell which presents a display color in said initial aligned state substantially matching with at least one of display colors obtained when said write voltage is applied.

This structure can suppress display disturbance which unnecessary image is displayed while the selected metastable state changes into the initial aligned state after the power source is switched off.

Said first driver and/or said second driver may include control means for applying an effective value voltage for displaying a color substantially matching with said display color in said initial aligned state between said opposing electrodes and then stopping voltage supply between said opposing electrodes.

This structure can surely prevent display disturbance from occurring after the power source is switched off.

Said first driver and said second driver may perform rewriting a plurality of pixels, comprised of an intersecting portion between said one electrode and said other electrode and liquid crystal therebetween, over a plurality of frames for image display and setting an aligned state of liquid crystal of plural rows of pixels previously selected in each frame. In this case, said first driver sequentially applies said reset voltage to one of said electrodes which constitutes an associated group of pixel rows in each frame period; and said second driver applies, to the other electrode, said metastable-aligned-state selecting voltage for selecting a metastable aligned state of liquid crystal of those pixels to which said reset voltage is applied.

Said first and second drivers may sequentially alter a composition of pixel rows constituting each group.

Accordingly, a display boundary, formed at the time of switching frames, can be made less noticeable, and the display irregularity, such as the display flicker can be reduced.

A method of driving a liquid crystal display device, according to a second aspect of the present invention, comprises the steps of:

preparing a liquid crystal cell comprising a pair of substrates having opposing electrodes and aligning films respectively formed on opposing inner surfaces of said substrates, said aligning films having been subjected to an aligning treatment in a predetermined direction; a liquid crystal layer of a bistable nematic liquid crystal material, sealed between said pair of substrates and having liquid crystal molecules selectively alignable in one of a first metastable aligned state and a second metastable aligned state different from each other by selective application of a twist select voltage having a plurality of different predetermined voltage values smaller than a voltage value of a reset voltage after application of said reset voltage, said voltage value of said reset voltage being such as to align said liquid crystal molecules substantially perpendicular to said substrates, a tilt angle of said liquid crystal molecules to said substrates being controlled in said first metastable aligned state and said second metastable aligned state in accordance with an effective value of a voltage to be applied to said opposing electrodes; and at least one polarizing plate located on one outer side or both outer sides of said pair of substrates;

supplying a reset potential for applying said reset voltage between said electrodes, to one of said electrodes of said pair of substrates in accordance with display data externally supplied;

supplying a metastable-aligned-state selecting voltage for selecting a first metastable-aligned-state selecting voltage and a second metastable-aligned-state selecting voltage, between said electrodes in accordance with said display data; and supplying a write voltage corresponding to a voltage with an effective value according to said display data, between said electrodes.

This method can keep certainly the metastable aligned state the bistable nematic liquid crystal assumes, and shorten the time for aligning the molecules in accordance with the effective value of the voltage under the same metastable aligned state, in other words, make the response speed faster.

Said step of preparing said liquid crystal cell may prepare a liquid crystal cell having said liquid crystal spray-strained by a twist angle of 0° to 180° in an initial aligned state. In this case, said step of applying said metastable-aligned-state selecting voltage includes a step of selectively applying to said liquid crystal a voltage for twisting liquid crystal molecules by a twist angle which is 180° plus said twist angle in said initial aligned state, and a voltage for twisting said liquid crystal molecules by a twist angle which is 180° subtracted from said twist angle in said initial aligned state.

At least one of said reset voltage applying step and said metastable-aligned-state selecting voltage applying step may comprise a step of applying an AC voltage between said electrodes.

The application of an AC voltage can suppress the charge bias, the deterioration of liquid crystal and the generation of an afterimage.

Said reset voltage may be greater than a minimum voltage value necessary to align said liquid crystal molecules substantially perpendicular to said substrates. In this case, said reset voltage applying step applies said reset voltage between said electrodes for a period shorter than a time required for said liquid crystal molecules to be aligned substantially perpendicular to said substrates by application of said minimum voltage value.

This method can allow the liquid crystal molecules to be surely reset, and shorten the frame cycle.

Said reset voltage may include a reset voltage of a first frequency by which said liquid crystal molecules shows a positive dielectric anisotropy and a reset voltage of a second frequency by which said liquid crystal molecules shows a negative dielectric anisotropy. In this case, said reset voltage applying step applies said reset voltage of said first frequency between said electrodes sandwiching a liquid crystal area which is to be set in one of said first and second metastable aligned states, and applies said reset voltage of said second frequency between said electrodes sandwiching a liquid crystal area which is to hold one of said first or second metastable aligned state previously set.

Thus applied AC reset voltage suppress the charge bias, the deterioration of liquid crystal and the generation of an afterimage.

At least one of said reset voltage applying step and said metastable-aligned-state selecting voltage applying step may include a step of frequency-modulating a voltage and applying said frequency-modulated voltage.

At least one of said reset voltage applying step and said metastable-aligned-state selecting voltage applying step may include a step of performing pulse width modulation on a voltage and applying said pulse-width-modulated voltage to said other electrode.

Those structures make alignment control on the liquid crystal molecules easier as compared with the case where the applied voltage itself is controlled.

Said reset voltage applying step and said metastable-aligned-state selecting voltage applying step may apply said metastable-aligned-state selecting voltage after applying said reset voltage.

Said reset voltage applying step and said metastable-aligned-state selecting voltage applying step may apply said reset voltage even to liquid crystal of pixels to which the same metastable aligned state as a directly previous one is to be set, and then apply said metastable-aligned-state selecting voltage to thereby set an old metastable aligned state again.

This can keep certainly the metastable aligned state the liquid crystal molecules assume, and shorten the time for aligning the molecules in accordance with the effective value of the voltage under the same metastable aligned state, in other words, make the response speed faster.

In response to an instruction to disable display, an effective value voltage for displaying a color substantially matching with a display color in an initial aligned state may be applied between said opposing electrodes, and then voltage supply between said opposing electrodes is stopped.

This can suppress display disturbance which unnecessary image is displayed while the selected metastable state changes into the initial aligned state after the power source is switched off.

Said reset voltage applying step and said metastable-aligned-state selecting voltage applying step may rewrite one screen of images over a plurality of frames, and apply said reset voltage, and said metastable-aligned-state selecting voltage or selecting said metastable aligned state, between said opposing electrodes of individual pixel rows in a group of a plurality of pixel rows in each frame.

In this case said reset voltage applying step and said metastable-aligned-state selecting voltage applying step may sequentially alter a composition of pixel rows constituting each group.

It is therefore possible to make a display boundary, formed at the time of switching frames, less noticeable, and reduce the display irregularity such as the display flicker.

DETAILED DESCRIPTION OF THE PREFERRED EMBODIMENTS

Liquid crystal display devices will be described below as embodiments of the present invention with reference to the accompanying drawings.

Figure 1:
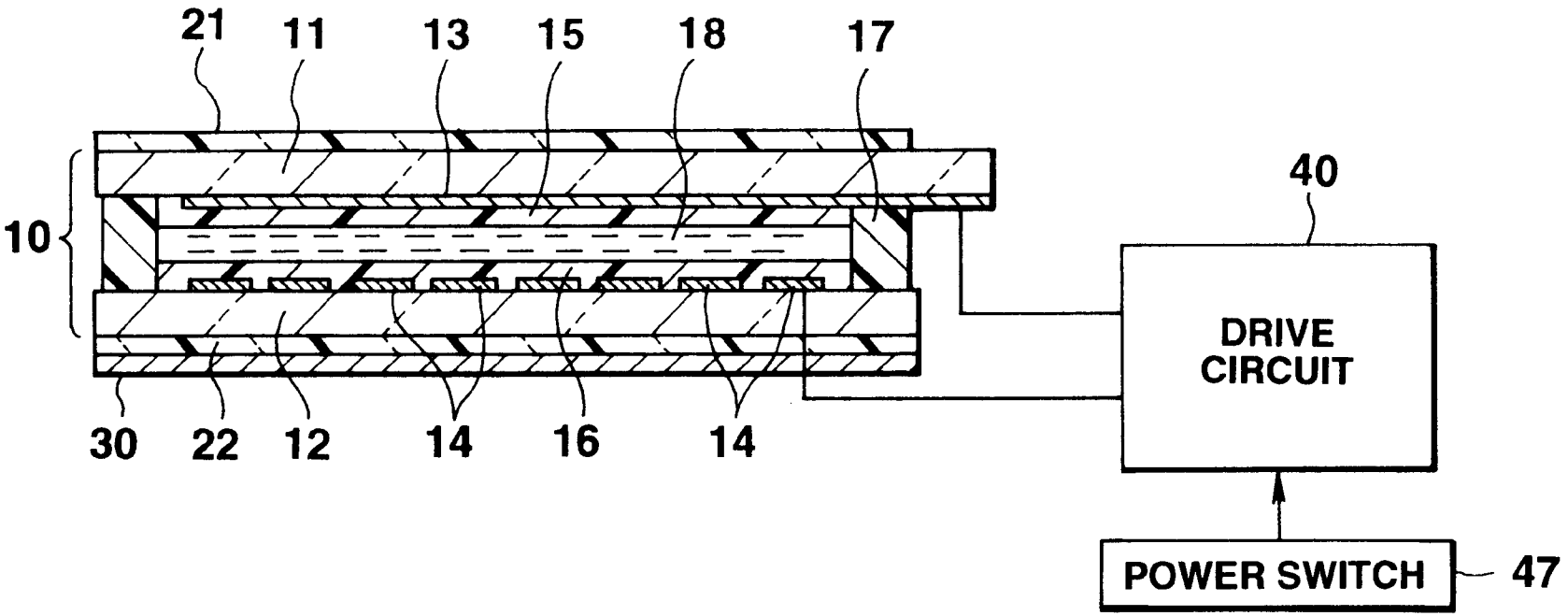
FIG. 1 is a sectional view showing a first embodiment of the basic structure of a liquid crystal display device of the present invention.

FIG. 1 shows a schematic structure of a liquid crystal display device of the present invention according to an embodiment. The liquid crystal display device according to this embodiment is comprised of a liquid crystal display element and a drive circuit 40 as illustrated.

As shown in FIGS. 1 and 2, the liquid crystal display element comprises a liquid crystal cell 10 being interposed between polarizing plates 21 and 22. The polarizing plate 21 is arranged on the outer surface of the liquid crystal cell 10, and the polarizing plate 22 is arranged on the back surface of the liquid crystal cell 10. A reflective plate is mounted on the outer surface of the second polarizing plate 22. A drive circuit 40 for driving the liquid crystal cell 10 is connected thereto.

As shown in FIG. 1, the liquid crystal cell 10 is comprised of a pair of transparent substrates 11 and 12, and liquid crystal is interposed therebetween. Transparent electrodes 13 and 14 are arranged on the inner surfaces of the substrates, and aligning films 15 and 16, on which aligning treatment is performed, are further disposed on the electrodes. The pair of the substrates 11 and 12 are sealed with a frame-shaped sealing member 17. The liquid crystal 18 is sealed in a space which is closed by said sealing member 17 between the substrates 11 and 12. The aligning films 15 and 16 are horizontal aligning films made of polyimide or the like, and their surfaces are rubbed in predetermined directions.

The liquid crystal cell 10 is a simple matrix cell. The first transparent electrode 13 mounted on the inner surface of the first substrate 11 comprises a plurality of parallel scanning electrodes which extend in a direction (horizontal direction in FIG. 1). The second transparent electrode 14 mounted on the inner surfaces of the second substrate 12 comprises a plurality of signal electrodes which intersect with the scanning electrodes at about right angles.

The liquid crystal 18 is nematic liquid crystal which contains chiral agent and which is therefore twisted nematic liquid crystal. In the initial aligned state, the molecules in a layer of the liquid crystal 18 are twisted or not twisted by a twist angle of 0° to 180° with respect to the rubbed direction of one of the aligning films 15 and 16. In other words, the liquid crystal molecules assume so-called "spray-aligned state."

A reset pulse, whose voltage is high enough to cause the liquid crystal molecules to stand almost perpendicular to the substrates 11 and 12, is applied to the layer. Then, a selection pulse, having a predetermined voltage lower than that of the reset pulse, is applied thereto. The liquid crystal molecules in the initial aligned state are thereby further twisted by a twist angle of 180° with respect to the above mentioned direction (the direction same as the twisted direction in the initial aligned state). Thus twisted, the liquid crystal molecules assume the state known as "first metastable aligned state" where the molecules are released from spray-strained state. Alternatively, another selection pulse having a predetermined voltage lower than that of the reset pulse, is applied the liquid crystal layer. In this case, the liquid crystal molecules in the initial aligned state are twisted in the direction inverse to the above mentioned direction (the direction inverse to the twisted direction in the first metastable state), or by a twist angle about 180°. Thus twisted, the liquid crystal molecules assume the state known as "second metastable state" where the molecules are released from the spray-strained state. Moreover, the liquid crystal molecules in the first and second metastable aligned state are induced by a voltage which changes in accordance with effective value of a drive voltage which is applied in accordance with display data.

First to Fourth Examples of a Liquid Crystal Display Device

Examples of a liquid crystal display device will now be described with reference to FIGS. 2 to 19.

(First Example for the Liquid Crystal Display Device)

Figure 2A:
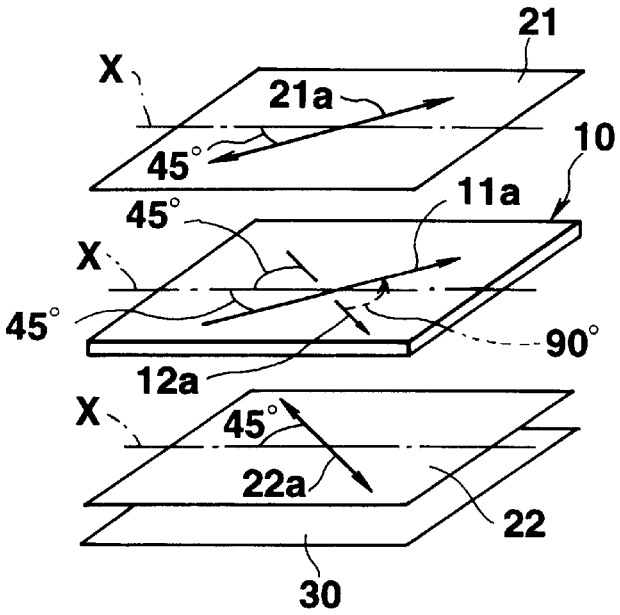
FIGS. 2A to C are perspective views showing schematic structures of the liquid crystal display device according to the first embodiment, and show initial aligned state, first metastable aligned state, and second metastable aligned state.

In a first example of the liquid crystal display device shown in FIG. 2A, a twist angle of the liquid crystal molecules in the initial aligned state is set to about 90°. Therefore, the liquid crystal molecules in the first metastable aligned state are twisted by a twist angle of about 270° in the above mentioned direction with respect to the rubbed direction of one of the substrates. The liquid crystal molecules in the second metastable aligned state are twisted by a twist angle of about 90° in the direction inverse to that in the first metastable aligned state with respect to the rubbed direction of one of the substrates.

Figure 2B:
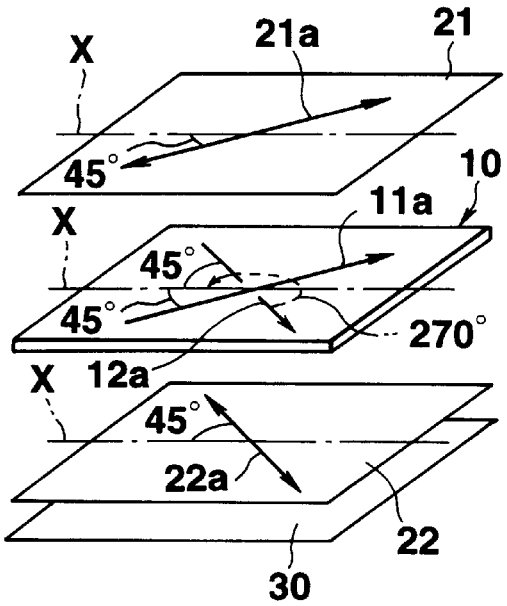
Figure 2C:
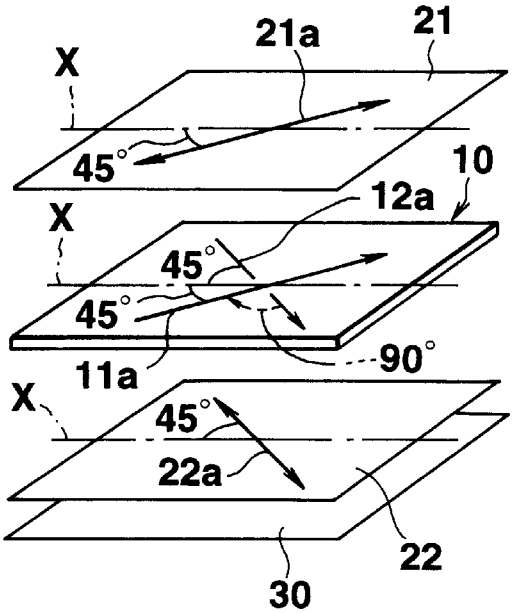

In FIGS. 2A to 2C, reference numerals 11*a* and 11*b* denote directions of the aligning treatment (rubbing directions of the aligning films 15 and 16) of the substrates 11 and 12 of the liquid crystal cell 10. In this example, the first aligning film 15 has been rubbed along a line inclined counterclockwise as viewed from the screen of the display, or inclined at an angle of about +90°/2, i.e., 45°, to the horizontal axis X of the screen, from the lower-left corner of the screen to the upper-right corner thereof. The second aligning film 16 has been rubbed along a line inclined clockwise as viewed from the screen, or inclined at an angle of 45° to the axis X, from the upper-left corner of the screen to the lower-right corner thereof. Namely, the aligned directions 11*a* and 12*a* of the substrates 11 and 12 are indicated by two lines which intersect at about right angles.

As mentioned above, the liquid crystal 18 is nematic liquid crystal which contains chiral agent. The chiral agent rotates the molecules of the liquid crystal cell 10 counterclockwise (twisted direction due to the chiral agent) as viewed from the screen of the screen. Hence, the liquid crystal molecules are spray-strained and twisted counterclockwise in the initial aligned state, by an angle of about 90°.

In the initial aligned state, the liquid crystal molecules are aligned near the substrates 11 and 12 in the directions 11*a* and 12*a*, respectively, assuming a spray-aligned state. They are twisted by about 90° in the direction shown by the broken-line arrow in FIG. 2A, i.e., the direction due to the chiral agent, with respect to, for example, the direction 12*a* of the second substrate 12.

The liquid crystal cell 10 does not serve to display images while the molecules of the liquid crystal remain in the initial aligned state. The liquid crystal cell 10 displays an image when the liquid crystal molecules assume either the first metastable aligned state or the second metastable aligned state.

To assume the first metastable state, the liquid crystal molecules in the initial aligned state are twisted by about 180° in the direction defined by the chiral agent. As a result, the liquid crystal molecules are released from the spray-strained state. To assume the second metastable state, the liquid crystal molecules in the initial aligned state are twisted by about −180° in the direction inverse to the direction defined by the chiral agent. Also in this case, the liquid crystal molecules are released from the spray-strained state.

The initial aligned state is switched to the first or second metastable aligned state, in two steps of operation. First, a spray-strained state release voltage (a reset voltage) for releasing the molecules from the spray-strained state is applied between the electrodes 13 and 14 of each pixel of the liquid crystal cell 10, having its voltage value (an absolute value) causing the liquid crystal molecules to stand almost perpendicular to the substrates 11 and 12. Next, a selection pulse for selecting a state of predetermined voltage value is applied between the electrodes 13 and 14.

More specifically, after applying the reset pulse, aligning the liquid crystal molecules almost perpendicular to the substrates 11 and 12, a selection pulse (hereinafter called first metastable selecting pulse) may be applied between the electrodes. The first metastable state selecting pulse has a predetermined voltage value (an absolute value) Vs1 less than the reset voltage. The liquid crystal molecules in the initial aligned state are twisted by 90°. As a result, the molecules are twisted by a twist angle of 270° (=90°+180°). The liquid crystal molecules are release from the spray-strained state. They assume the first metastable aligned state.

In the first metastable aligned state, the liquid crystal molecules near the substrate 11 are aligned in the direction 11*a*, whereas the liquid crystal molecules near the substrate 12 are aligned in the direction 12*a*. Furthermore, the liquid crystal molecules are twisted by about 270° counterclockwise as view from the screen (the direction due to the chiral agent), as shown by the broken-line arrow in FIG. 2B, with respect to, for example, the direction 12*a* of the second substrate 12.

After applying a reset pulse, aligning the liquid crystal molecules almost perpendicular to the substrates 11 and 12, a pulse (hereinafter called second metastable state selecting pulse) may be applied between the electrodes. The second metastable state selecting pulse has a predetermined voltage value (an absolute value) Vs2 lower than the reset voltage. The liquid crystal molecules in the initial aligned state are twisted by −180°. As a result, the molecules are twisted by −90° (=90°−180°). The liquid crystal molecules are released from the spray-strained state. They assume the second metastable aligned state.

In the second metastable aligned state, the liquid crystal molecules near the substrate 11 are aligned in the direction 11*a*, whereas the liquid crystal molecules near the substrate 12 are aligned in the direction 12*a*. Furthermore, the liquid crystal molecules are twisted by about 90°, clockwise (in the direction inverse to the direction defined by the chiral agent), as shown by the broken-line arrow in FIG. 2C, with respect to, for example, the direction 12*a* of the second substrate 12.

Furthermore, the aligned state of the liquid crystal molecules can be switched from the first metastable aligned state to the second metastable aligned state, and vice versa. To switch the first metastable aligned state to the second metastable aligned state, the reset pulse, whose voltage value causing the liquid crystal molecules to stand almost perpendicular to the substrates 11 and 12, is applied between the electrodes 13 and 14, setting the liquid crystal molecules in the initial aligned state, and the second metastable state selecting pulse is applied between the electrodes 13 and 14. Conversely, to switch the second metastable aligned state to the first metastable aligned state, the reset pulse is applied between the electrodes 13 and 14, setting the liquid crystal molecules in the initial aligned state, and the first metastable state selecting pulse is applied between the electrodes 13 and 14.

The voltage value Vs1 of the first metastable state selecting pulse and the voltage value Vs2 of the second metastable state selecting pulse are determined by the characteristic of the liquid crystal 18 and the characteristic and amount of the chiral agent contained therein. The relationship between the absolute values of Vs1 and Vs2 is, for example, Vs1<Vs2. The voltage value Vs1 of the first metastable aligned state is substantially 0V, and the voltage value Vs2 of the second metastable aligned state is small, barely enough to tilt the liquid crystal molecules to the substrates 11 and 12 at an angle which is equal or similar to a pre-tilt angle.

Figure 3:
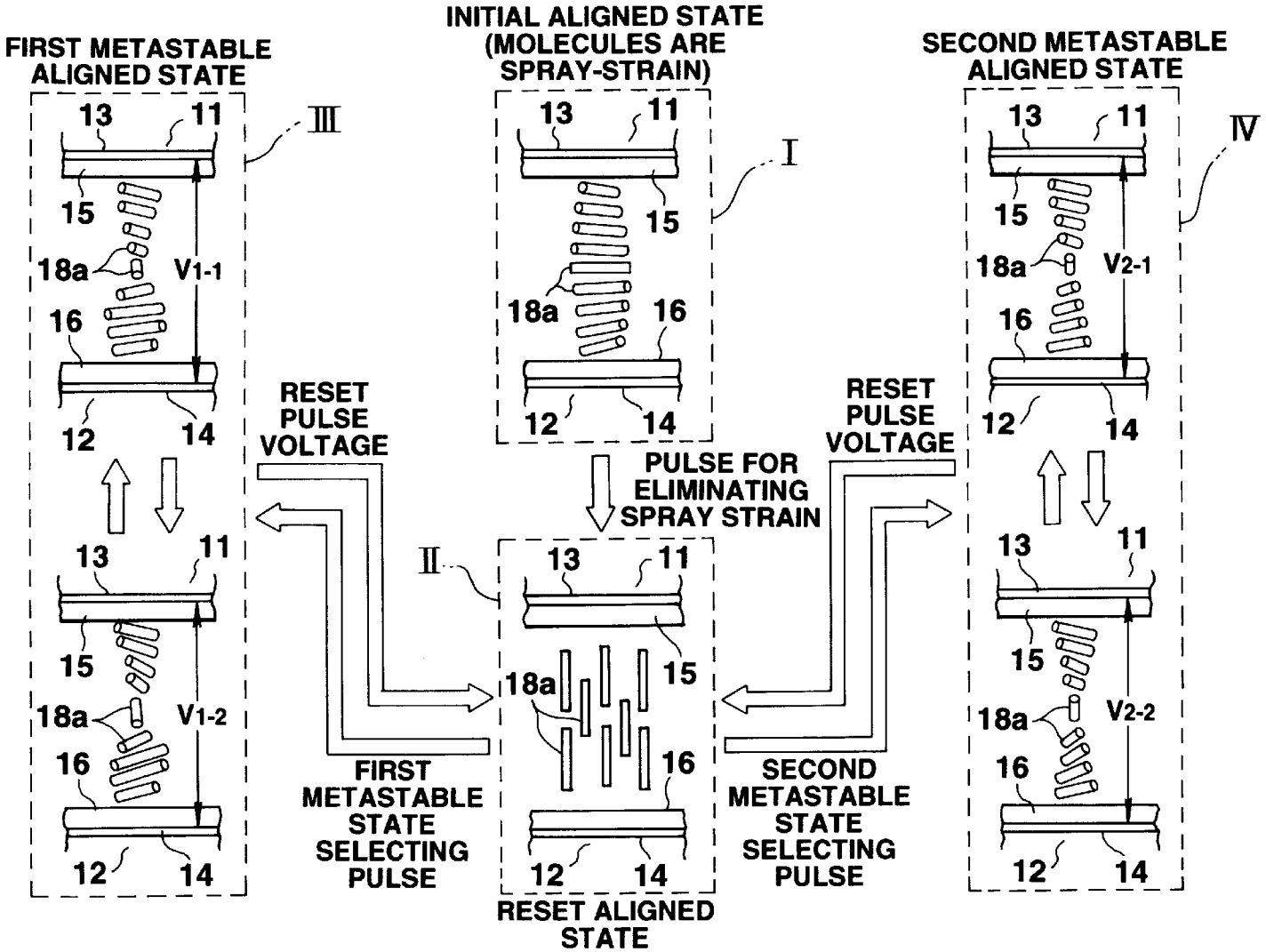
FIG. 3 is a block diagram showing the initial aligned state, the first metastable aligned state, and second metastable aligned state of liquid crystal molecules of the liquid crystal display device according to the first embodiment.

FIG. 3 is a diagram showing how the molecules 18*a* of the liquid crystal 18 are aligned and twisted as viewed from the lower side of the liquid crystal cell 10 (in the direction perpendicular to the horizontal axis X of the screen) in the initial aligned state I, reset-aligned state II, first metastable aligned state III and second metastable aligned state IV.

In the initial aligned state I (where the liquid crystal molecules are twisted counterclockwise by a twist angle of 90° as viewed from the screen), the liquid crystal molecules 18*a* near the substrates 11 and 12 are tilted toward the substrates 11 and 12, respectively, by a tilt angle of a several degrees. Were these molecules 18*a* are not twisted and have their major axes in the same plane, they would be pre-tilted in the opposite directions. Thus, the farther away liquid crystal molecules 18*a* are from the substrate 11 or 12, the smaller their pre-tilt angles. Any molecule 18*a* located above the midpoint of the liquid crystal layer (a point where the molecules are not tilted) is tilted in the opposite direction to the direction in which any other molecule 18*a* located below said midpoint is tilted. In short, the liquid crystal molecules are twisted and spray-strained in the initial aligned state I.

In the reset aligned state II, the liquid crystal molecules 18*a* (not shown) near the substrates 11 and 12 are tilted by a several degrees toward the substrates 11 and 12, respectively, as in the initial aligned state I. Most of the other molecules 18*a* remote from the substrates 11 and 12 stand almost perpendicular to the substrates 11 and 12.

In the first metastable aligned state III (where the liquid crystal molecules 18*a* are twisted in one direction by a twist angle of 270°), also the molecules near the substrates 11 and 12 are tilted by a several degrees toward the substrates 11 and 12, respectively, as in the initial aligned state I. The molecules 18*a* at the midpoint of the liquid crystal layer is further twisted by about 180°, they are therefore twisted by about angle of 270° and have their major axes in the same plane, they would be pre-tilted in the opposite directions. In the first metastable aligned state III, the liquid crystal molecules 18*a* are twisted by 270° and not spray-strained.

In the second metastable aligned state IV (where the liquid crystal molecules 18*a* are twisted by 90° in the direction opposite to the direction in which they are twisted in the first metastable aligned state III), also the molecules near the substrates 11 and 12 are tilted by a several degrees toward the substrates 11 and 12, respectively, as in the initial aligned state I. The molecules 18*a* are twisted by 180° in the direction in the direction opposite to the direction in which they are twisted in the first metastable aligned state III. Were the molecules 18*a* are not twisted and have their major axes in the same plane, they would be tilted in the same direction. That is, the liquid crystal molecules 18*a* in the second metastable aligned state are twisted and not spray-strained.

In both metastable aligned states, the liquid crystal molecules 18*a* remain twisted and tilted to the substrates 11 and 12. The angle by which the molecules 18*a* are tilted depends on an effective value of a drive signal applied between the opposing electrodes 13 and 14 (i.e., the effective value of a voltage to be applied between the electrodes during an inter-frame period). However, the aligned state of the molecules near the substrates 11 and 12 is almost the same.

Of the diagrams representing aligned states of the liquid crystal molecules in the first metastable aligned sates shown in FIG. 3, the upper half shows the aligned state, where the molecules are stood (a second written state), the molecules 18*a* assume when the first metastable state selecting pulse has a relatively small effective value V1-1 of the drive signal, and the lower half illustrates the aligned state, where the molecules are stood (a first written state), the molecules 18*a* assume when the first metastable state selecting pulse has a relatively large effective value V1-2 of the drive signal. Similarly, of the diagrams representing the second metastable aligned state, the upper half shows the aligned state where the molecules are stood (the second written state) the molecules 18*a* assume when the second metastable state selecting pulse has a relatively small absolute value V2-1, and the lower half illustrates the aligned state where the molecules are stood (the first written state) the molecules 18*a* assume when the second metastable state selecting pulse has a relatively large absolute value V2-2. In whichever state shown in FIG. 3, the liquid crystal molecules 18*a* are tilted in accordance with the absolute value of the state selecting pulse, while assuming a twisted state specific to the metastable aligned state which is specific to the metastable aligned state.

The effective value of the drive voltage changes in a range which is lower than the voltage value of the reset voltage. The liquid crystal molecules 18*a* tilt in accordance with the effective value of the drive voltage, however, remain in the first metastable aligned state or the second metastable aligned state until the reset pulse is applied between the electrodes 13 and 14 of the pixel to stand the liquid crystal molecules 18*a* almost perpendicular to the substrates 11 and 12 and set the molecules 18*a* into the initial aligned state.

As seen from FIGS. 2A to 2C, the first polarizing plate 21 is positioned with its light-transmitting axis 21*a* extending substantially in parallel to the arrow indicating the direction 11*a* of the first substrate 11. Alternatively, the plate 21 may be so positioned that its light-transmitting axis 21*a* intersecting with the arrow indicating the direction 11*a*, substantially at right angles. On the other hand, the second polarizing plate 22 is positioned with its light-transmitting axis 22*a* intersecting with the arrow indicating the direction 12*a* of the second substrate 12, substantially at right angles.

The liquid crystal display device comprises the reflective plate 30 on the back surface of the second polarizing plate 22 to utilize external light such as natural light and light emitted from lamps on the ceiling. The reflective plate 30 reflects the external light. The liquid crystal cell 10 is driven by the drive system 40 to display images on the screen of the liquid crystal display device.

The drive circuit 40 supplies scanning signals to the scanning electrodes 13 of the liquid crystal cell 10, one after another. The circuit 40 also supplies data signals to the signal electrodes 14 of the cell 10, one after another. Each data signal is supplied to one signal electrode 14, exactly at the same time a scanning signal is supplied to one scanning electrode 13. As a result, a voltage, i.e., the potential difference between the scanning signal and the data signal, is applied between the electrodes 13 and 14 of the pixel. After applying a reset pulse between the electrodes 13 and 14 of the pixel, the drive circuit 40 applies the first or second metastable state selecting pulse between the electrodes 13 and 14 and then supplies to the pixel a drive signal whose effective voltage is far lower than the reset pulse.

The liquid crystal display in this example is a reflective display which utilizes external light such as natural light and light emitted from lamps on the ceiling. The reflective plate 30 reflects the light applied to the front of the display. Before the display is driven, the liquid crystal molecules of the cell 10 remain in the initial aligned state (they are aligned and spray-strained). When the reset pulse is applied between the electrodes 13 and 14 of each pixel, the liquid crystal molecules 18*a* stand almost perpendicular to the substrates 11 and 12. The liquid crystal molecules 18*a* are therefore set into either the first metastable aligned state or the second metastable aligned state in accordance with the value of the voltage applied.

The drive circuit 40 may applies the reset pulse between the electrodes 13 and 14 of every pixel when the power switch of the liquid crystal display is turned on, and may then apply either the first or second metastable state selecting pulse between the electrodes 13 and 14 of every pixel. Then, the liquid crystal molecules 18*a* of all pixels are set into either the first metastable aligned state or the second metastable aligned state. The liquid crystal display can therefore display images.

In the liquid crystal display device, the liquid crystal molecules 18*a* of the cell 10 assume either the first metastable aligned state or the second metastable aligned state. When set in the first metastable aligned state, the molecules 18*a* are twisted in one direction by a twist angle of about 270°, with respect to the aligned direction of one of the substrates. When set in the second metastable aligned state, the molecules 18*a* are twisted in the opposite direction by a twist angle of about 90°, with respect to the aligned direction of one of the substrates.

In other words, the liquid crystal display device has the electrooptical characteristics of two liquid crystal displays which are different in terms of the alighted state of the liquid crystal molecules. The electrooptical characteristics of both displays are used to control the transmittance of each pixel, thereby to control the gray-scale level of the pixel.

In FIGS. 2A to 2C, the light-transmitting axes 21*a* of the first polarizing plate 21 extends substantially in parallel or substantially at right angles to the arrow indicating the aligned direction 11*a* of the first substrate 11, and the light-transmitting axis 22*a* of the second polarizing plate 22 intersects with the light-transmitting axis 21*a* of the first polarizing plate 21 substantially at right angles. Hence, the first example can display images in twisted nematic mode (hereinafter referred to as "TN mode") of normally white type, by setting the liquid crystal molecules 18*a* in the first metastable aligned state.

No matter whether the molecules 18*a* assume the first or second metastable aligned state, the linearly polarized light beam emitted from the polarizing plate 21 is rotated due to the twisted liquid crystal molecules as it passes through the liquid crystal cell 10, by virtue of the birefringent action of the layer of the liquid crystal 18. The light beam thus rotated is applied to the second polarizing plate 22. The second polarizing plate 22 controls the passage of the light beam. The reflective plate 30 reflects the light beam emitted from the second polarizing plate 22. The light beam thus reflected passes through the second polarizing plate 22, the liquid crystal cell 10 and the first polarizing plate 21.

While set in the first metastable aligned state, the liquid crystal molecules 18*a* remain much twisted by about 270°. As long as the molecules 18*a* are so twisted, the rays of different wavelengths pass through the second polarizing plate 22, each in a different transmittance because the layer of liquid crystal 18 exhibits different optical rotatory powers to these rays, respectively. The light applied from the second polarizing plate 22 to the reflective plate 30 has color defined by the intensity ratio among the rays of different wavelengths, which compose the light.

When the liquid crystal molecules 18*a* assume the first metastable aligned state while the display operates in TN mode, the display presents a color image. The color of the image depends upon the effective value of the drive signal applied between the electrodes 13 and 14 of each pixel.

On the other hand, when the liquid crystal molecules 18*a* assume the second metastable aligned state while the display operates in TN mode, they are twisted by a twist angle of almost 90°. In this case, the color liquid crystal display works, basically in the same way as a TN-type, monochrome liquid crystal display. As described above, the polarizing plates 21 and 22 are positioned with their light-transmitting axes 21*a* and 22*a* intersecting at almost right angles. Each pixel therefore looks white when the liquid crystal molecules 18*a* are tilted by an angle close to the pre-tilt angle.

As the tilt angle of the molecules 18*a* increases, the transmittance of the pixel decreases. Finally, the pixel appears black. While staying in the second metastable aligned state, the liquid crystal molecules 18*a* of each pixel are tilted in accordance with the effective value of the drive signal applied between the electrodes 13 and 14 of the pixel, and the birefringent property of the liquid crystal layer changes. Each pixel can appear white, black and any gray scale when the effective value of the drive signal applied to it is changed. The display can therefore display gray-scale images.

When the liquid crystal molecules 18*a* assume the initial aligned state, they are twisted by almost 90° and spray-strained. Thus, the color liquid crystal display can work, basically in the same way as a TN-type, monochrome liquid crystal display, to display a black-and-white image. In practice, however, the initial aligned state of the molecules 18*a* is not utilized to display images.

Figure 4A:
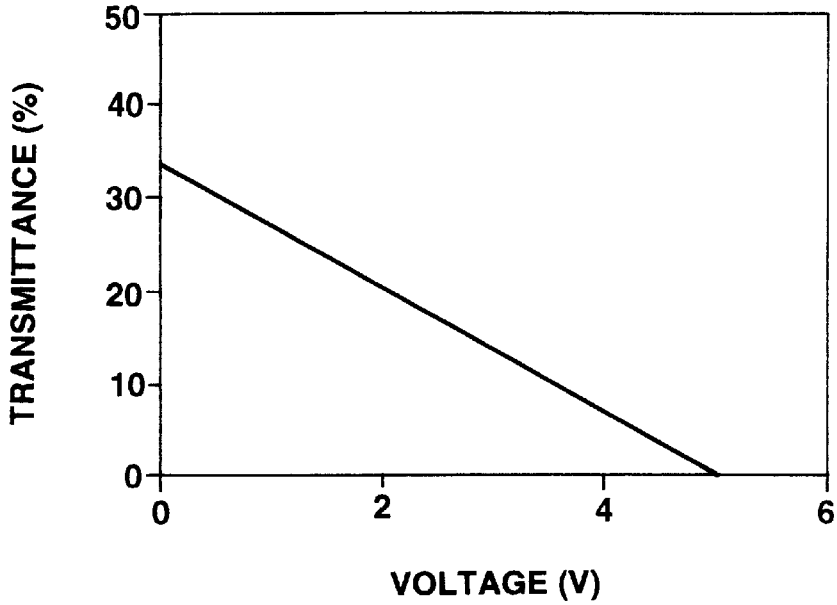
FIGS. 4A and 4B are a graph representing the voltage-transmittance characteristic, and a diagram of the CIE chromaticity which the first embodiment exhibits when the liquid crystal molecules assume the initial aligned state.
Figure 4B:
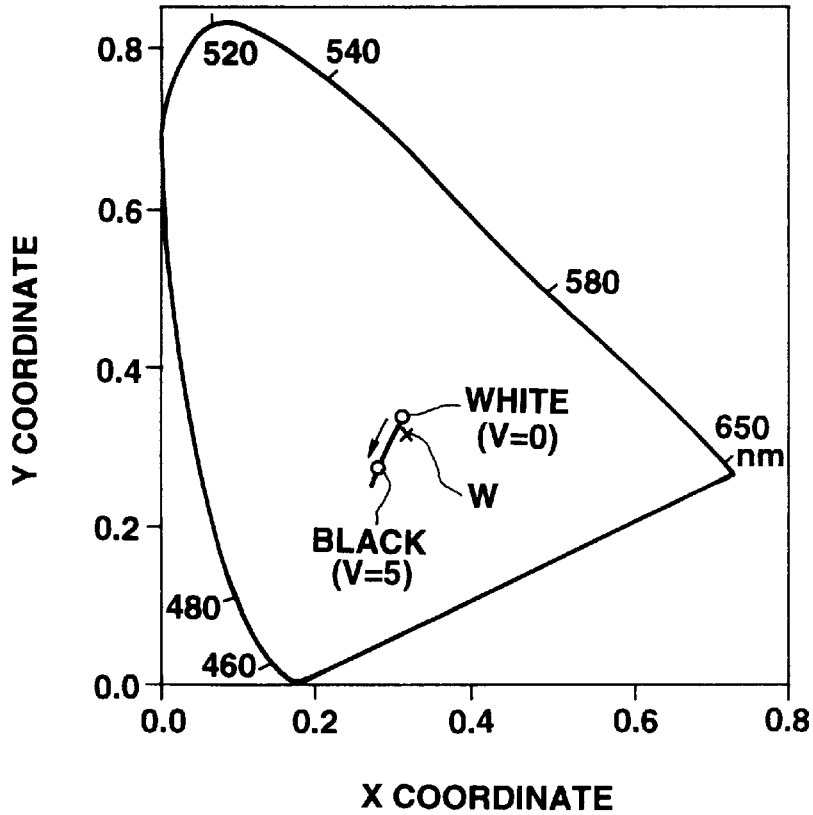
Figure 5A:
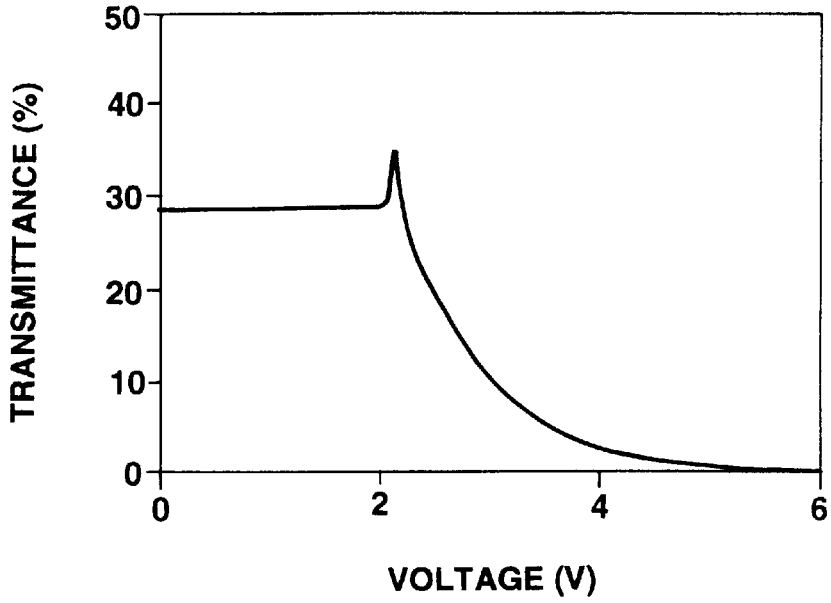
FIGS. 5A and 5B are a graph representing the voltage-transmittance characteristic, and a diagram of the CIE chromaticity which the first embodiment exhibits when the liquid crystal molecules assume the first metastable aligned state.
Figure 5B:
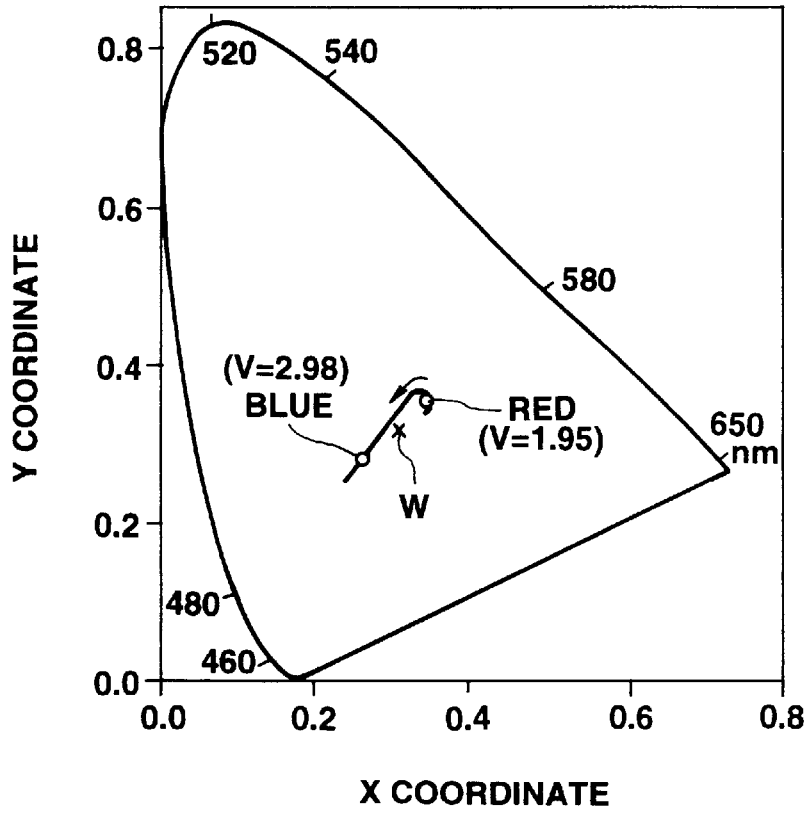
Figure 6A:
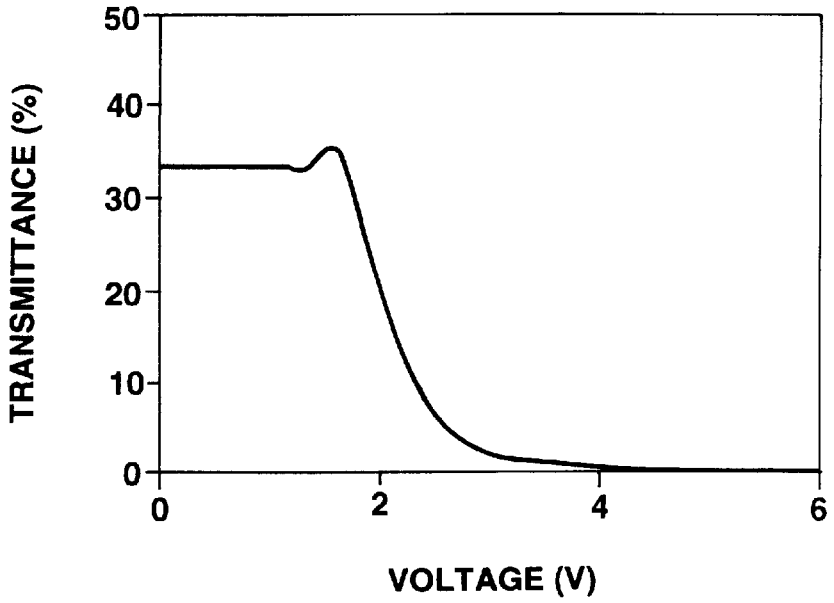
FIGS. 6A and 6B are a graph representing the voltage-transmittance characteristic, and a diagram of the CIE chromaticity which the first embodiment exhibits when the liquid crystal molecules assume the second metastable aligned state.
Figure 6B:
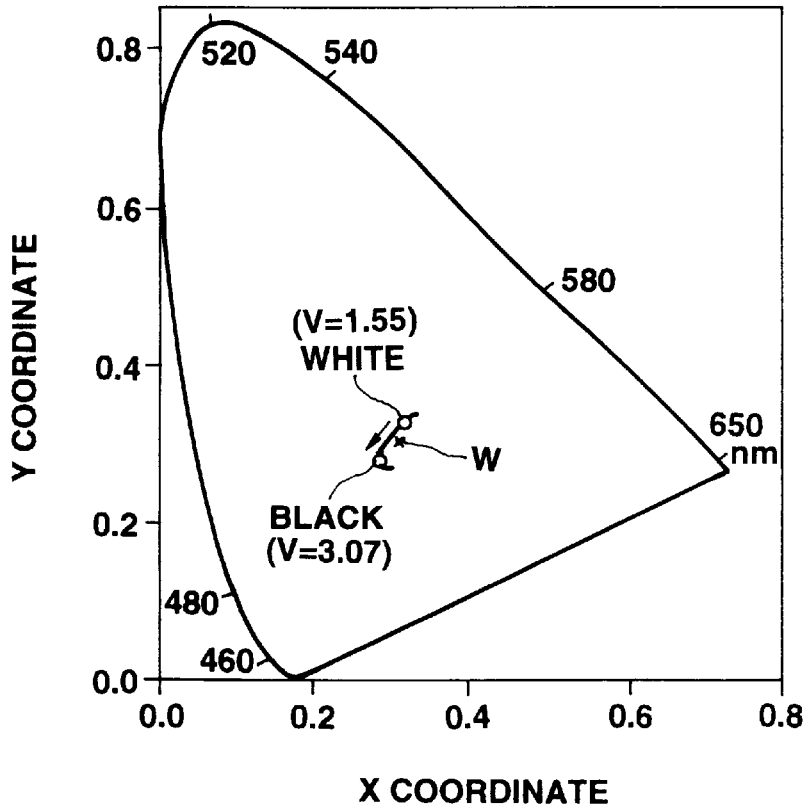

FIGS. 4A to 6B show how the transmittance of the liquid crystal layer and the color of each pixel change with the voltage applied to the pixel when the value Δnd (i.e., the product of the optical anisotropy (birefringent anisotropy) Δn of liquid crystal 18 and the thickness d of the liquid crystal layer) is about 1000 nm in the liquid crystal display illustrated in FIG. 2A. More specifically, FIG. 4A represents the voltage-transmittance characteristic which the display exhibits when the liquid crystal molecules assume the initial aligned state. FIG. 4B is a diagram of the CIE chromaticity which each pixel of the display presents when the liquid crystal molecules assume the initial aligned state. FIG. 5A shows the voltage-transmittance characteristic which the display has when the liquid crystal molecules assume the first metastable aligned state. FIG. 5B is a diagram of the CIE chromaticity which each pixel presents when the liquid crystal molecules assume the first metastable aligned state. FIG. 6A shows the voltage-transmittance characteristic which the first example presents when the liquid crystal molecules assume the second metastable aligned state. FIG. 6B is a diagram representing the CIE chromaticity which each pixel presents when the liquid crystal molecules assume the second metastable aligned state. In each of the diagrams of the chromaticity, reference alphabet W denotes uncolored point.

As seen from FIG. 4A, the transmittance of each pixel changes substantially in proportion to the voltage applied to the pixel when the liquid crystal molecules assume the initial aligned state. As FIG. 4B shows, the pixel appears white when a voltage is 0V (no voltage is applied) is applied to it. The pixel appears black when applied with a voltage (e.g., 5V) which is high enough to cause the molecules 18*a* to stand almost perpendicular to the substrates 11 and 12.

FIG. 5A shows voltage-transmittance characteristic under the first metastable aligned state. As clearly seen from FIG. 5B, the pixel appears red when applied with a voltage of 1.95V, and blue when applied with a voltage of 2.98V, while the liquid crystal molecules remain in the first metastable aligned state. X- and Y-coordinate values of the red are 0.35 and 0.35, respectively (x=0.353, y=0.350). Y value (i.e., brightness) of the red is 28.54. X- and Y-coordinate values of the blue are 0.27 and 0.30, respectively (x=0.27, y=0.30). Y value of the blue is 11.64.

FIG. 6A shows the voltage-transmittance characteristic under the second metastable aligned state. As can be understood from FIG. 6B, the pixel appears white when applied with a voltage of 1.55V, and black when applied with a voltage of 3.071V, while the liquid crystal molecules remain in the second metastable aligned state. X- and Y-coordinate values of the white are 0.317 and 0.341, respectively (x=0.317, y=0.341). Y value of the white is 0.341. X- and Y-coordinate values of the black are 0.271 and 0.290, respectively (x=0.271, y=0.290). Y value of the black is 1.83.

As indicated above, each pixel of the first example appears either red or blue while the liquid crystal molecules 18*a* remain in the first metastable aligned state, and appears either white or black while the molecules 18*a* remain in the second metastable aligned state. The first example can therefore display not only black-and-white images but also red-and-blue images. The molecules 18*a* are aligned almost vertically and the pixel presents most intensely black, when the drive circuit 40 supplies the reset pulse to the pixel. However, the pixel does not appear black to human eyes since the reset pulse is applied to the pixel for an extremely short time.

When the power switch of the drive circuit 40 is turned off, the liquid crystal molecules 18*a* in the first or second metastable aligned state come to assume the initial aligned state within a few seconds to a few minutes due to natural discharging. (The time within which the molecules 18*a* assume the initial aligned state depends upon the characteristic of the liquid crystal 18 and the characteristic and amount of the chiral agent contained therein.) The screen of the display therefore entirely appears white as in the case where no voltage is applied to the pixels while the liquid crystal molecules 18*a* remain in the initial aligned state.

As described above, the first example has the electrooptical characteristics of two liquid crystal displays which differ in the alighted state of liquid crystal molecules. The characteristics of one display are used to control some of the gray-scale levels of each pixel or some of color tones of the pixel, and the characteristics of the other display are used to control the remaining gray-scale levels of the pixel or the remaining color tones of the pixel. To be more specific, the liquid crystal molecules 18*a* are set in the first metastable aligned state and the transmittance of each pixel is controlled, whereby the pixel presents one of the gray-scale level or color tones of the first set, and the molecules 18*a* are set in the second metastable aligned state and the transmittance of each pixel is controlled, whereby the pixel presents one of the gray-scale level or color tones of the second set. Hence, the drive signal only needs to be time-divided far less minutely, providing fewer segment signals for driving while the molecules remain in the first or second metastable aligned state.

According to the liquid crystal display device, the operating voltage margin is broad enough for the drive duty of the liquid crystal cell 10. In order to display a red-and-blue image, it suffices to supply a segment signal of 1.95V to some pixels and a segment signal of 2.98V to some other pixels while the liquid crystal molecules 18*a* remain in the first metastable aligned state. The difference in effective value between the segment signals, i.e., the operating voltage margin, is 1.03V (=2.98V−1.95V) which is sufficiently broad. To display a blue-and-white image, it suffices to supply a segment signal of 1.55V to some pixels and a segment signal of 3.07V to some other pixels while the liquid crystal molecules remain in the second metastable aligned state. In this case, too, the operating voltage margin, is 1.52V (=3.07V−1.55V) which is sufficiently broad.

Hence, the operating voltage margin can be broad, making it possible to drive the liquid crystal cell 10 in high-duty time division, though the cell 10 is a simple matrix cell which is driven by a controlled drive signal. The liquid crystal display according to the first example can therefore display an image composed of a great number of pixels.

In this liquid crystal display device, the time for which the reset voltage must be applied to each pixel can be much shortened, making it possible to switch the metastable aligned state of the molecules, from one to the other.

In the above mentioned liquid crystal display device, each pixel can appear either red or blue while the liquid crystal molecules 18*a* remain in the first metastable aligned state. The pixel presents red when Δnd of the cell 10 is set at a certain value, and blue when Δnd of the cell 10 is set at another value.

(Second Example for the Liquid Crystal Display Device)

The above example operates in TN mode, no matter whichever metastable aligned state the liquid crystal molecules 18*a* assume. When the molecules 18*a* assume the first metastable aligned state, the devise displays a color image. When the molecules 18*a* assume the second metastable aligned state, the device displays a black-and-white image. The first polarizing plate 21 may be positioned with its light-transmitting axis 21*a* inclined to the direction 11*a* of the first substrate 11 in the cell 10. In this case, the first example can display color images in birefringent mode, whichever metastable aligned state the molecules 18*a* assumes.

Figure 7A:
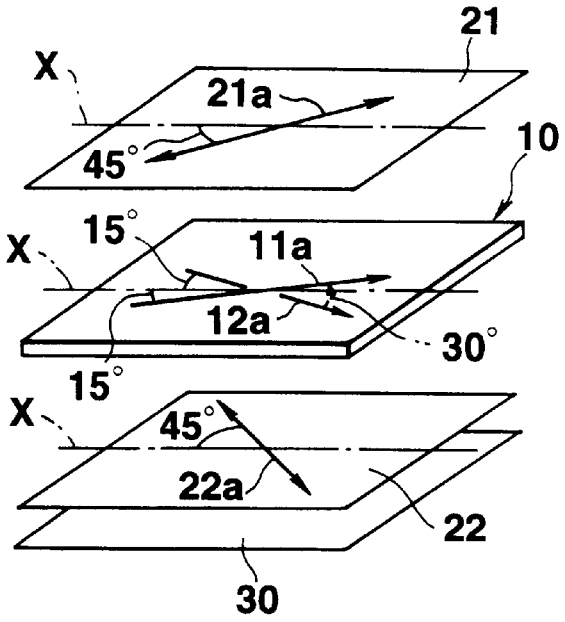
FIGS. 7A to C are perspective views showing schematic structures of the liquid crystal display device according to the second embodiment, and show initial aligned state, first metastable aligned state, and second metastable aligned state.
Figure 7B:
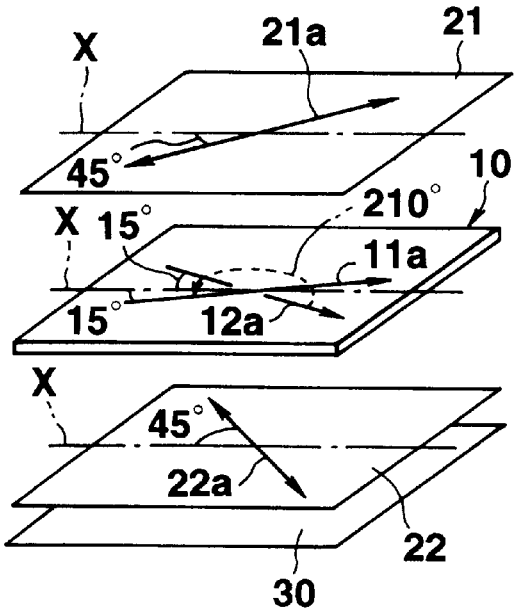
Figure 7C:
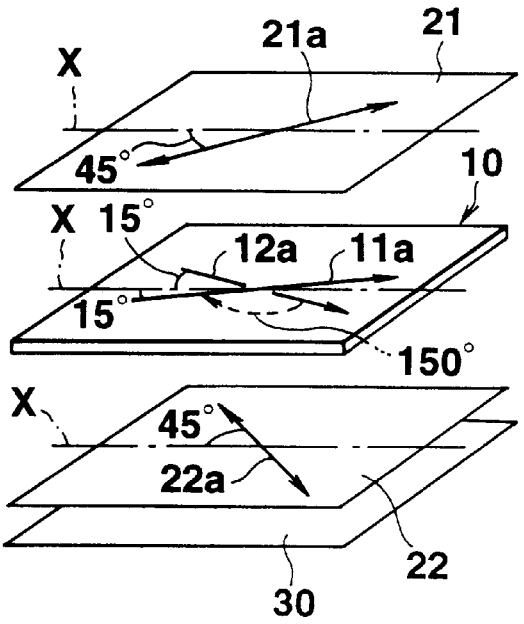

The liquid crystal display according to the second example will be described, with reference to FIGS. 7A to 10B. FIGS. 7A to 7C are perspective views. FIG. 7A illustrates the initial aligned state of the liquid crystal molecules. FIG. 7B represents the first metastable aligned state of the liquid crystal molecules. FIG. 7C depicts the second metastable aligned state of the liquid crystal molecules.

The liquid crystal display device in the second example comprises a liquid crystal cell 10 being interposed between polarizing plates 21 and 22 as shown in FIG. 2. The polarizing plate 21 is arranged on the outer surface of the liquid crystal cell 10, and the polarizing plate 22 is arranged on the back surface of the liquid crystal cell 10. A reflective plate 30 is mounted on the outer surface of the second polarizing plate 22. A drive circuit 40 for driving the liquid crystal cell 10 is connected to electrodes 13 and 14. The second example is identical in basic structure to the first example. Differences from the first example are twist angles of liquid crystal molecules. That is, the molecules are twisted by 30° in the initial aligned state, the molecules are twisted by 210° in the first metastable aligned state, and the molecules are twisted by −150° in the second metastable aligned state.

The components identical to those of the liquid crystal cell of the first example are designated at the same reference numerals and will not described in detail.

In this example, as shown in FIGS. 7A to 7C, the aligned direction 11*a* of the first substrate 11 in the liquid crystal cell 10 is along a line inclined counterclockwise as viewed from the screen of the display, or inclined at an angle of about 15° to the horizontal axis X of the screen, from the lower-left corner of the screen to the upper-right corner thereof. The aligned direction 12*a* of the second substrate 12 is along a line inclined clockwise as viewed from the screen, or inclined at an angle of 15° to the axis X, from the upper-left corner of the screen to the lower-right corner thereof. Namely, the aligned directions 11*a* and 12*a* of the substrates 11 and 12 are indicated by two lines which intersect at about 30°.

In FIG. 7A, reference numerals 11*a* and 11*b* denote directions of the aligning treatment (rubbing directions of the aligning films 15 and 16) of the substrates 11 and 12 of the liquid crystal cell 10. In this example, the first aligning film 15 has been rubbed along a line inclined counterclockwise as viewed from the screen of the display, or inclined at an angle of about 15° to the horizontal axis X of the screen, from the lower-left corner of the screen to the upper-right corner thereof. The second aligning film 16 has been rubbed along a line inclined clockwise as viewed from the screen, or inclined at an angle of 15° to the axis X, from the upper-left corner of the screen to the lower-right corner thereof. Namely, the aligned directions 11*a* and 12*a* of the substrates 11 and 12 are indicated by two lines which intersect at about 30°.

In this example, the liquid crystal 18 is contains chiral agent. The chiral agent rotates the molecules of the liquid crystal cell 10 counterclockwise (twisted direction due to the chiral agent) as viewed from the screen. Hence, the liquid crystal molecules are spray-strained and twisted counterclockwise in the initial aligned state, by an angle of about 30°.

In the initial aligned state, the liquid crystal molecules are aligned near the substrates 11 and 12 in the directions 11*a* and 12*a*, respectively, assuming a spray-aligned state. They are twisted by about 30° in the direction shown by the broken-line arrow in FIG. 7A, i.e., the direction due to the chiral agent, with respect to, for example, the direction 12*a* of the second substrate 12.

To assume the first metastable state, the liquid crystal molecules in the initial aligned state are twisted by about 180° in the direction defined by the chiral agent. As a result, the liquid crystal molecules are released from the spray-strained state. To assume the second metastable state, the liquid crystal molecules in the initial aligned state are twisted by about −180° in the direction inverse to the direction defined by the chiral agent. Also in this case, the liquid crystal molecules are released from the spray-strained state.

More specifically, after applying the reset pulse, aligning the liquid crystal molecules almost perpendicular to the substrates 11 and 12, a selection pulse (hereinafter called first metastable selecting pulse) may be applied between the electrodes. The first metastable state selecting pulse has a predetermined voltage value (an absolute value) Vs1 less than the reset voltage. The liquid crystal molecules in the initial aligned state are twisted by 30°. As a result, the molecules are twisted by a twist angle of 210° (=30°+180°). The liquid crystal molecules are release from the spray-strained state. They assume the first metastable aligned state.

In the first metastable aligned state, the liquid crystal molecules near the substrate 11 are aligned in the direction 11*a*, whereas the liquid crystal molecules near the substrate 12 are aligned in the direction 12*a*. Furthermore, the liquid crystal molecules are twisted by about 210° counterclockwise as view from the screen (the direction due to the chiral agent), as shown by the broken-line arrow in FIG. 7B, with respect to, for example, the direction 12*a* of the second substrate 12.

After applying a reset pulse, aligning the liquid crystal molecules almost perpendicular to the substrates 11 and 12, a pulse (hereinafter called second metastable state selecting pulse) may be applied between the electrodes. The second metastable state selecting pulse has a predetermined voltage value (an absolute value) Vs2 lower than the reset voltage. The liquid crystal molecules in the initial aligned state are twisted by −180°. As a result, the molecules are twisted by −150° (=30°−180°). The liquid crystal molecules are released from the spray-strained state. They assume the second metastable aligned state.

Furthermore, the aligned state of the liquid crystal molecules can be switched, in the same manner as the first example, from the first metastable aligned state to the second metastable aligned state, and vice versa. To switch the first metastable aligned state to the second metastable aligned state, the reset voltage, whose voltage value causing the liquid crystal molecules to stand almost perpendicular to the substrates 11 and 12, is applied between the electrodes 13 and 14, setting the liquid crystal molecules in the initial aligned state, and the second metastable state selecting pulse is applied between the electrodes 13 and 14. Conversely, to switch the second metastable aligned state to the first metastable aligned state, the reset pulse is applied between the electrodes 13 and 14, setting the liquid crystal molecules in the initial aligned state, and the first metastable state selecting pulse is applied between the electrodes 13 and 14.

The voltage value Vs1 of the first metastable aligned state is substantially 0V, and the voltage value Vs2 of the second metastable aligned state is small, barely enough to tilt the liquid crystal molecules to the substrates 11 and 12 at an angle which is equal or similar to a pre-tilt angle.

In this example, the first polarization plate 21 has been arranged along its transmission axis 21*a* inclined counterclockwise as viewed from the screen of the display, or inclined at an angle of about 45° to the horizontal axis X of the screen. The second polarizing plate 22 has been arranged along its transmission axis 22*a* inclined clockwise as viewed from the screen, or inclined at an angle of 45° to the axis X. Namely, the transmission axis 21*a* of the first polarizing plate 21 and the aligned directions 11*a* (which is inclined counterclockwise at about 15° as viewed from the screen) of the first substrates 11 are indicated by two lines which intersect at about 30°, and the transmission axis 22*a* of the second polarizing plate 22 and the transmission axis 21*a* of the first polarizing plate 21 are indicated by two lines which intersect at about right angles.

In the liquid crystal display device according to this example, the liquid crystal molecules 18*a* of the cell 10 assume either the first metastable aligned state or the second metastable aligned state. When set in the first metastable aligned state, the molecules 18*a* are twisted in one direction by a twist angle of about 210°, with respect to the aligned direction 12*a* of one of the substrates 12. When set in the second metastable aligned state, the molecules 18*a* are twisted in the opposite direction by a twist angle of about 150°, with respect to the aligned direction of one of the substrates.

In this example, the transmission axis 21*a* of the first polarizing plate 21 and the aligned direction 11*a* of the first substrate 11 of the liquid crystal cell 10 are indicated by two lines which intersect at about 30°, and the transmission axis 22*a* of the second polarizing plate 22 and the transmission axis 21*a* of the first polarizing plate 21 are indicated by two lines which intersect at about right angles. In this case, the first example can display color images in birefringent mode, whichever metastable aligned state the molecules 18*a* assumes.

Figure 8A:
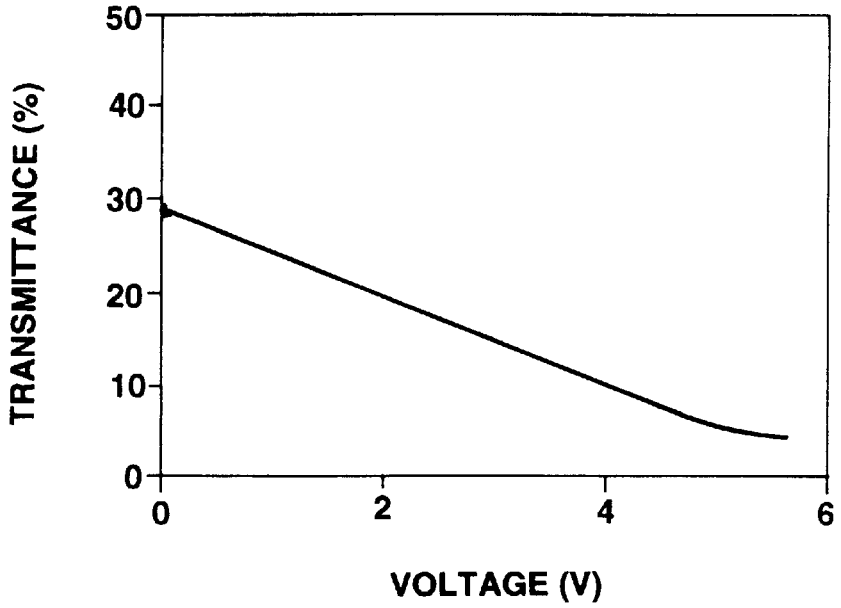
FIGS. 8A and 8B are a graph representing the voltage-transmittance characteristic, and a diagram of the CIE chromaticity which the second embodiment exhibits when the liquid crystal molecules assume the initial aligned state.
Figure 8B:
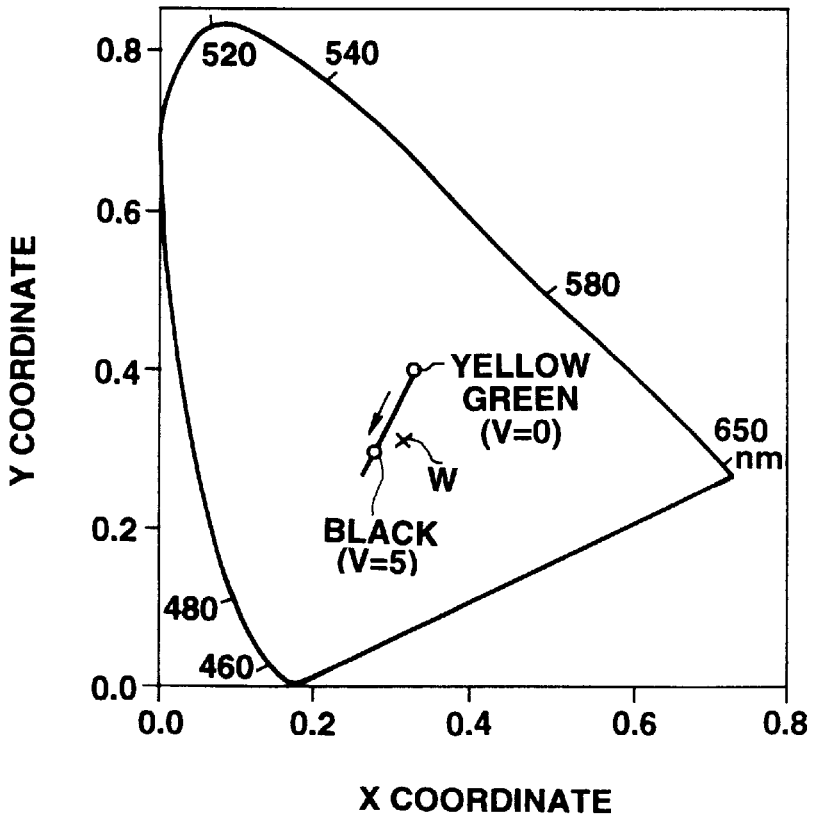
Figure 9A:
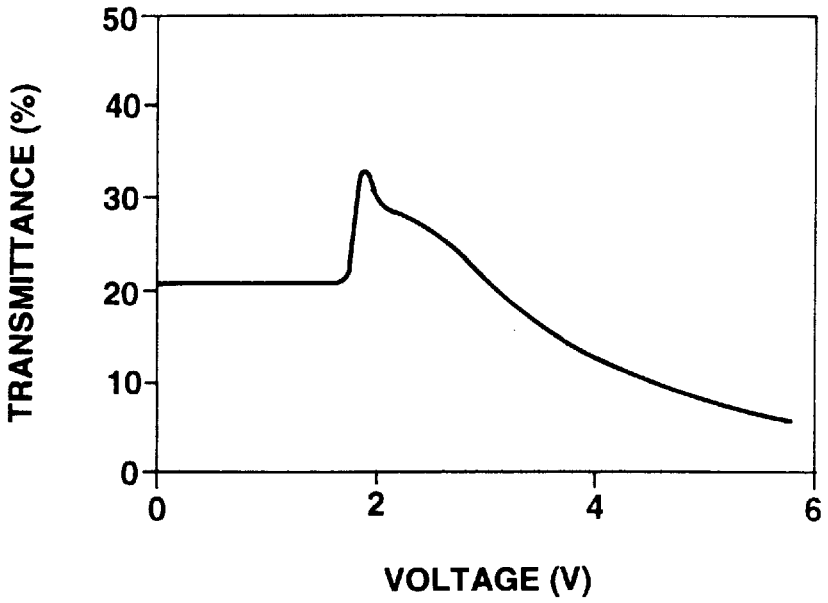
FIGS. 9A and 9B are a graph representing the voltage-transmittance characteristic, and a diagram of the CIE chromaticity which the second embodiment exhibits when the liquid crystal molecules assume the first metastable aligned state.
Figure 9B:
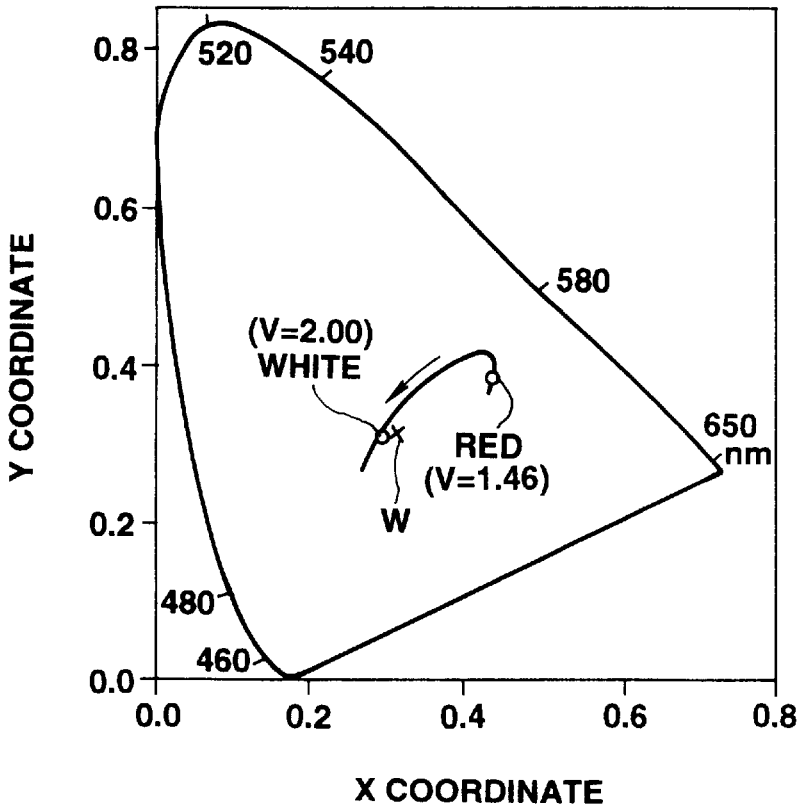
Figure 10A:
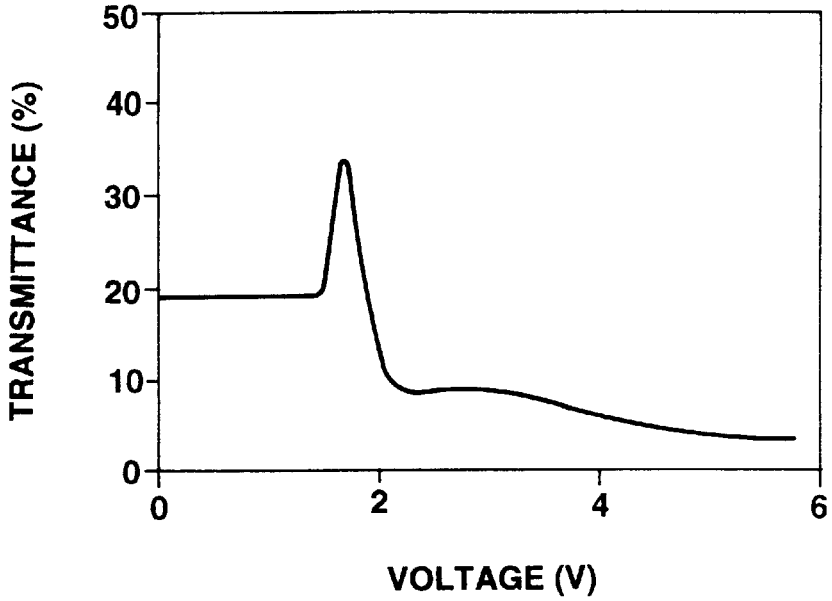
FIGS. 10A and 10B are a graph representing the voltage-transmittance characteristic, and a diagram of the CIE chromaticity which the second embodiment exhibits when the liquid crystal molecules assume the second metastable aligned state.
Figure 10B:
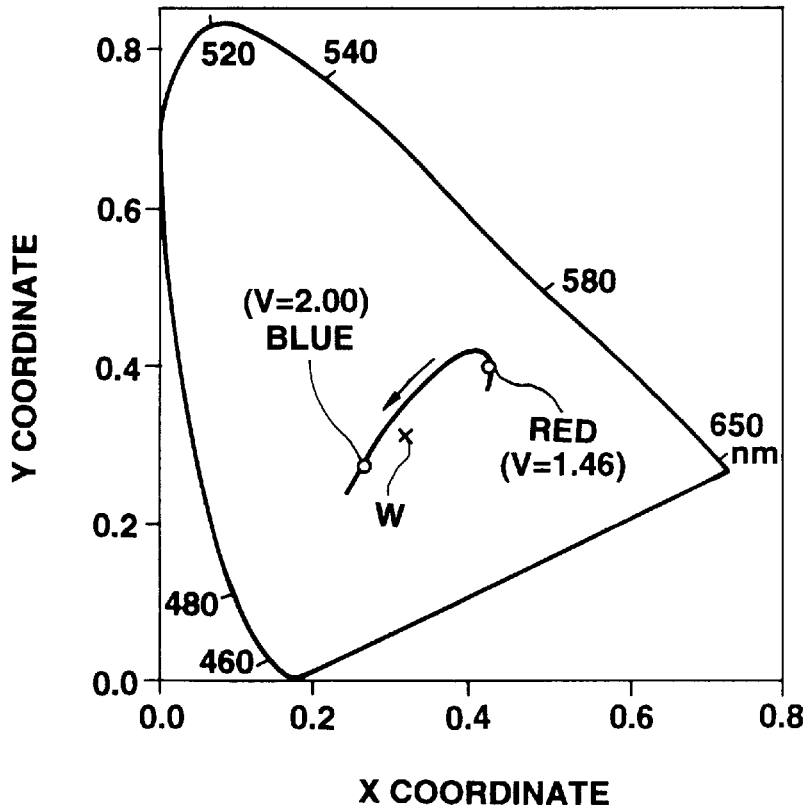

FIGS. 8A and 8B show how the transmittance of the liquid crystal layer and the color of each pixel change with the voltage applied to the pixel when the value Δnd is about 900 nm in the liquid crystal display illustrated in FIG. 7A. More specifically, FIG. 8A represents the voltage-transmittance characteristic which the display exhibits when the liquid crystal molecules assume the initial aligned state. FIG. 8B is a diagram of the CIE chromaticity which each pixel of the display presents when the liquid crystal molecules assume the initial aligned state. FIG. 9A shows the voltage-transmittance characteristic which the display has when the liquid crystal molecules assume the first metastable aligned state. FIG. 9B is a diagram of the CIE chromaticity which each pixel presents when the liquid crystal molecules assume the first metastable aligned state. FIG. 10A shows the voltage-transmittance characteristic which the first example presents when the liquid crystal molecules assume the second metastable aligned state. FIG. 10B is a diagram representing the CIE chromaticity which each pixel presents when the liquid crystal molecules assume the second metastable aligned state.

As seen from FIG. 8A, the transmittance of each pixel changes substantially in proportion to the voltage applied to the pixel when the liquid crystal molecules assume the initial aligned state. As FIG. 8B shows, the pixel appears black when a voltage is 0V (no voltage is applied) is applied to it. The pixel appears purple when applied with a voltage (e.g., 5V).

FIG. 9A shows, the transmittance of the liquid crystal layer remains high and almost unchanged when the voltage applied ranges from 0V to about 2.5V, and abruptly decreases when the voltage rises above 2.5V, as long as the liquid crystal molecules 18*a* assume the first metastable aligned state. As clearly seen from FIG. 9B, the pixel appears red when applied with a voltage of 2.516V, and black when applied with a voltage of 3.03V, while the liquid crystal molecules remain in the first metastable aligned state. X- and Y-coordinate values of the red are 0.42 and 0.46, respectively (x=0.42, y=0.46). Y value (i.e., brightness) of the red is 30.13. X- and Y-coordinate values of the black are 0.27 and 0.29, respectively (x=0.27, y=0.29). Y value of the black is 11.6.

FIG. 10A shows the voltage-transmittance characteristic under the second metastable aligned state. As can be understood from FIG. 10B, the pixel appears blue when applied with a voltage of 1.418V, and white when applied with a voltage of 3.02V, while the liquid crystal molecules remain in the second metastable aligned state. X- and Y-coordinate values of the blue are 0.15 and 0.14, respectively (x=0.15, y=0.14). Y value of the blue is 5.7. X- and Y-coordinate values of the white are 0.29 and 0.31, respectively (x=0.29, y=0.31). Y value of the white is 26.7.

As indicated above, each pixel of the second example appears either red or black while the liquid crystal molecules 18*a* remain in the first metastable aligned state, and appears either blue or white while the molecules 18*a* remain in the second metastable aligned state. The second example can therefore display not only black-and-white images but also red-and-blue images.

(Third Example for the Liquid Crystal Display Device)

Figure 11A:
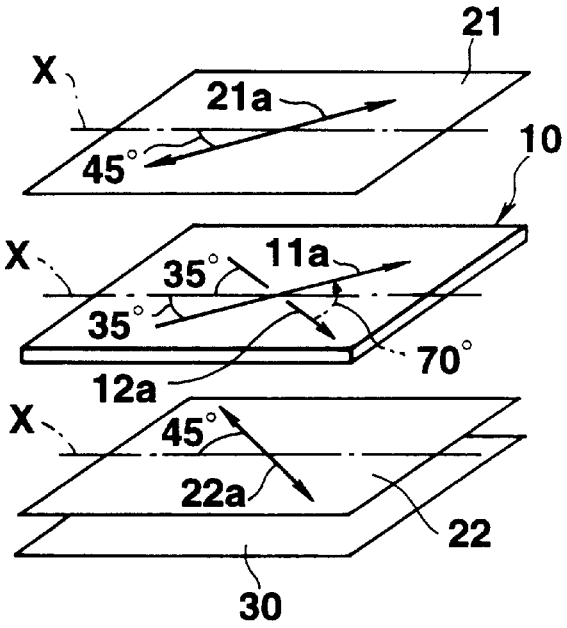
FIGS. 11A to C are perspective views showing schematic structures of the liquid crystal display device according to the third embodiment, and show initial aligned state, first metastable aligned state, and second metastable aligned state.
Figure 11B:
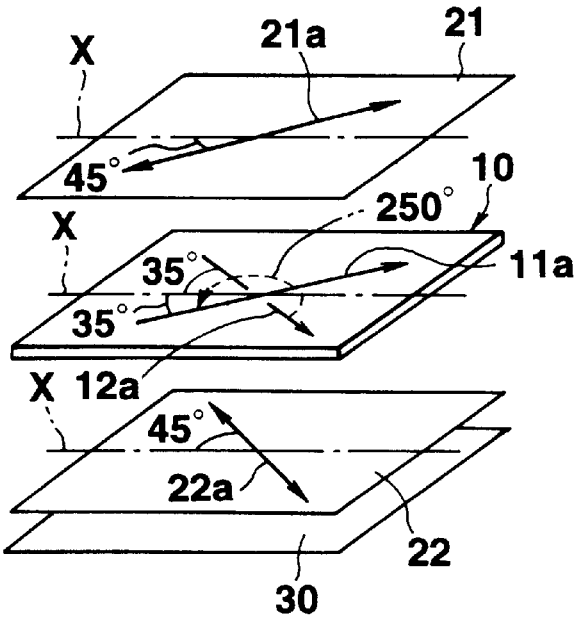
Figure 11C:
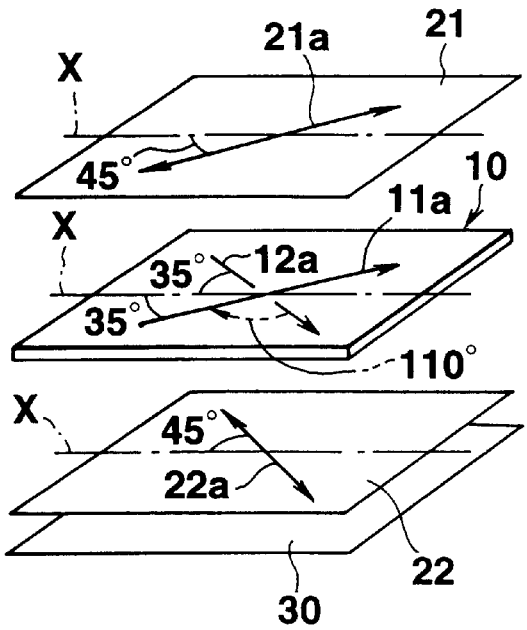

A third example of the present invention will now be described with reference to FIGS. 11A to 14B. FIGS. 11A to 11C are perspective views. FIG. 11A illustrates the initial aligned state of the liquid crystal molecules. FIG. 11B represents the first metastable aligned state of the liquid crystal molecules. FIG. 11C depicts the second metastable aligned state of the liquid crystal molecules.

In this example, as shown in FIGS. 11A to 11C, the aligned direction 11*a* of the first substrate 11 in the liquid crystal cell 10 is along a line inclined counterclockwise as viewed from the screen of the display, or inclined at an angle of about 35° to the horizontal axis X of the screen, from the lower-left corner of the screen to the upper-right corner thereof. The aligned direction 12*a* of the second substrate 12 is along a line inclined clockwise as viewed from the screen, or inclined at an angle of 35° to the axis X, from the upper-left corner of the screen to the lower-right corner thereof. Namely, the aligned directions 11*a* and 12*a* of the substrates 11 and 12 are indicated by two lines which intersect at about 70°.

In FIG. 11A, reference numerals 11*a* and 11*b* denote directions of the aligning treatment (rubbing directions of the aligning films 15 and 16) of the substrates 11 and 12 of the liquid crystal cell 10. In this example, the first aligning film 15 of the first substrate has been rubbed along a line inclined counterclockwise as viewed from the screen of the display, or inclined at an angle of about 35° to the horizontal axis X of the screen, from the lower-left corner of the screen to the upper-right corner thereof. The second aligning film 16 of the second substrate 12 has been rubbed along a line inclined clockwise as viewed from the screen, or inclined at an angle of 35° to the axis X, from the upper-left corner of the screen to the lower-right corner thereof.

In this example, the liquid crystal 18 is contains chiral agent having twisting force in counterclockwise as viewed from the screen. The chiral agent rotates the molecules of the liquid crystal cell 10 counterclockwise (twisted direction due to the chiral agent) as viewed from the screen. Hence as shown by the broken-line arrow in FIG. 11A, the liquid crystal molecules are spray-strained and twisted counterclockwise in the initial aligned state, by an angle of about 70°.

In the initial aligned state, the liquid crystal molecules are aligned near the substrates 11 and 12 in the directions 11*a* and 12*a*, respectively, assuming a spray-aligned state. They are twisted by about 70° in the direction shown by the broken-line arrow in FIG. 11A, i.e., the direction due to the chiral agent, with respect to, for example, the direction 12*a* of the second substrate 12.

To assume the first metastable state, the liquid crystal molecules in the initial aligned state are further twisted by about 180° in the direction defined by the chiral agent. As a result, the liquid crystal molecules are twisted at angle of 250°. To assume the second metastable state, the liquid crystal molecules in the initial aligned state are twisted by about −180° in the direction inverse to the direction defined by the chiral agent. In this case, the liquid crystal molecules are twisted at angle of −110°.

More specifically, after applying the reset pulse, aligning the liquid crystal molecules almost perpendicular to the substrates 11 and 12, a selection pulse (hereinafter called first metastable selecting pulse) may be applied between the electrodes. The first metastable state selecting pulse has a predetermined voltage value (an absolute value) Vs1 less than the reset voltage. The liquid crystal molecules in the initial aligned state are twisted by 70°. As a result, the molecules are twisted by a twist angle of 250° (=70°+180°). The liquid crystal molecules are release from the spray-strained state. They assume the first metastable aligned state.

In the first metastable aligned state, the liquid crystal molecules near the substrate 11 are aligned in the direction 11*a*, whereas the liquid crystal molecules near the substrate 12 are aligned in the direction 12*a*. Furthermore, the liquid crystal molecules are twisted by about 250° counterclockwise as view from the screen (the direction due to the chiral agent), as shown by the broken-line arrow in FIG. 11B, with respect to, for example, the direction 12*a* of the second substrate 12.

After applying a reset pulse, aligning the liquid crystal molecules almost perpendicular to the substrates 11 and 12, a pulse (hereinafter called second metastable state selecting pulse) may be applied between the electrodes. The second metastable state selecting pulse has a predetermined voltage value (an absolute value) Vs2 lower than the reset voltage. The liquid crystal molecules in the initial aligned state are twisted by 70°. As a result, the molecules are twisted by −110° (=70°−180°). The liquid crystal molecules are released from the spray-strained state. They assume the second metastable aligned state.

The aligned state of the liquid crystal molecules can be switched, in the same manner as the first example, from the first metastable aligned state to the second metastable aligned state, and vice versa. To switch the first metastable aligned state to the second metastable aligned state, the reset voltage, whose voltage value causing the liquid crystal molecules to stand almost perpendicular to the substrates 11 and 12, is applied between the electrodes 13 and 14, setting the liquid crystal molecules in the initial aligned state, and the second metastable state selecting pulse is applied between the electrodes 13 and 14. Conversely, to switch the second metastable aligned state to the first metastable aligned state, the reset pulse is applied between the electrodes 13 and 14, setting the liquid crystal molecules in the initial aligned state, and the first metastable state selecting pulse is applied between the electrodes 13 and 14.

The voltage value Vs1 of the first metastable aligned state is substantially 0V, and the voltage value Vs2 of the second metastable aligned state is small, barely enough to tilt the liquid crystal molecules to the substrates 11 and 12 at an angle which is equal or similar to a pre-tilt angle.

In this example, the first polarization plate 21 has been arranged along its transmission axis 21*a* inclined counterclockwise as viewed from the screen of the display, or inclined at an angle of about 45° to the horizontal axis X of the screen. The second polarizing plate 22 has been arranged along its transmission axis 22*a* inclined clockwise as viewed from the screen, or inclined at an angle of 45° to the axis X. Namely, the transmission axis 21*a* of the first polarizing plate 21 and the aligned directions 11*a* of the first substrates 11 are indicated by two lines which intersect at about 70°, and the transmission axis 22*a* of the second polarizing plate 22 and the transmission axis 21*a* of the first polarizing plate 21 are indicated by two lines which intersect at about right angles.

When the molecules assume the first metastable aligned state, the liquid crystal display device shows the electrooptical characteristics of a liquid crystal display device comprising a liquid crystal cell, whose liquid crystal molecules are twisted in one direction at a twist angle of about 250° with respect to the aligned direction 12*a* in one of the substrates, i,e,. the substrate 12, and a polarizing plate. When the molecules assume the second metastable aligned state, the liquid crystal display device shows the electrooptical characteristics of a liquid crystal display device comprising a liquid crystal cell, whose liquid crystal molecules are twisted in a direction inverse to that in the first metastable aligned state at an angle of about 110° with respect to the aligned direction 12*a* in one of the substrates, i.e., the substrate 12, and a polarizing plate.

In this example, the transmission axis 21*a* of the first polarizing plate 21 and the aligned direction 11*a* of the first substrate 11 of the liquid crystal cell 10 are indicated by two lines which intersect at about 10°, and the transmission axis 22*a* of the second polarizing plate 22 and the transmission axis 21*a* of the first polarizing plate 21 are indicated by two lines which intersect at about right angles. In this case, the first example can display color images in birefringent mode, whichever metastable aligned state the molecules 18*a* assumes.

The liquid crystal cell 10 does not serve to display images while the molecules of the liquid crystal remain in the initial aligned state, that is, the liquid crystal molecules are spray-strained and twisted by 70°. Also in this case, this example can display color images in birefringent mode, whichever the initial aligned state the molecules 18*a* assumes.

Figure 12A:
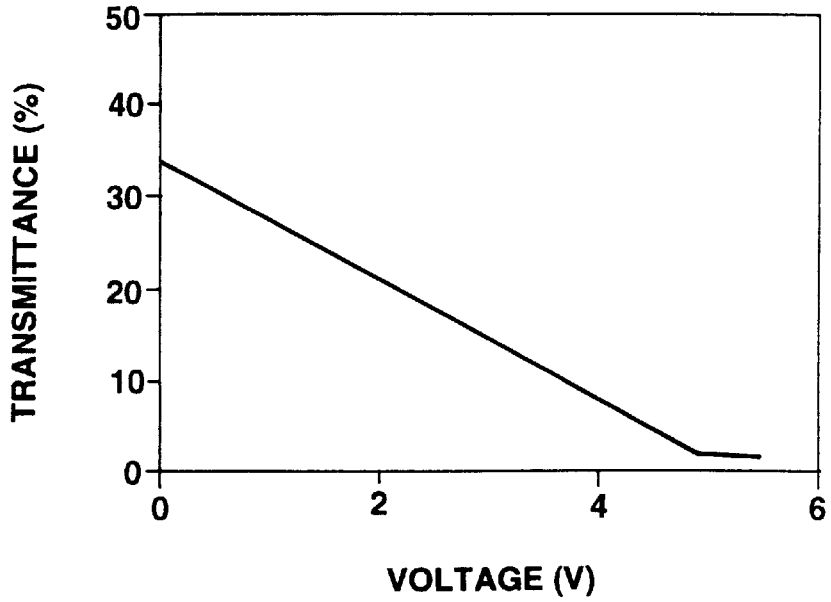
FIGS. 12A and 12B are a graph representing the voltage-transmittance characteristic, and a diagram of the CIE chromaticity which the third embodiment exhibits when the liquid crystal molecules assume the initial aligned state.
Figure 12B:
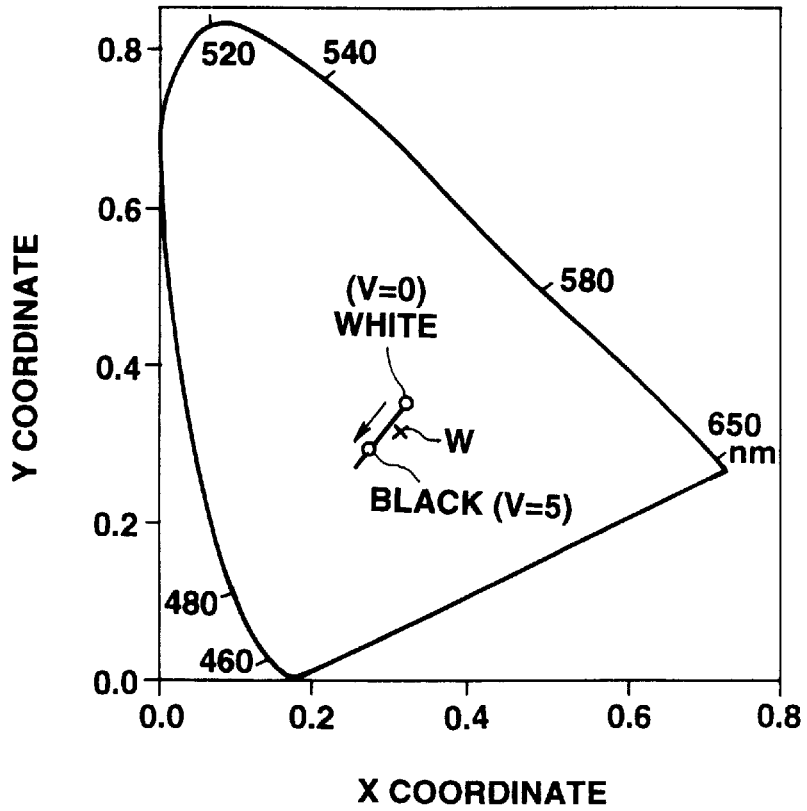

FIGS. 12A and 12B show how the transmittance of the liquid crystal layer and the color of each pixel change with the voltage applied to the pixel when the aligned directions 11*a* and 12*a* of the substrates 11 and 12 in the liquid crystal cell 10, the transmission axes 21*a* and 22*a* of the first and second polarizing plates 21 and 22 are set as shown in FIG. 11A and the value Δnd is set to about 900 nm in the liquid crystal cell 10. More specifically, FIG. 8A represents the voltage-transmittance characteristic which the display exhibits when the liquid crystal molecules assume the initial aligned state. FIG. 8B is a diagram of the CIE chromaticity which each pixel of the display presents when the liquid crystal molecules assume the initial aligned state. FIG. 9A shows the voltage-transmittance characteristic which the display has when the liquid crystal molecules assume the first metastable aligned state. FIG. 9B is a diagram of the CIE chromaticity which each pixel presents when the liquid crystal molecules assume the first metastable aligned state. FIG. 10A shows the voltage-transmittance characteristic which the first example presents when the liquid crystal molecules assume the second metastable aligned state. FIG. 10B is a diagram representing the CIE chromaticity which each pixel presents when the liquid crystal molecules assume the second metastable aligned state.

As seen from FIGS. 12A and 12B, the transmittance of each pixel changes substantially in proportion to the voltage applied to the pixel when the liquid crystal molecules assume the initial aligned state, and the pixel appears white when a voltage is 0V (no voltage is applied) is applied to it. The pixel appears black when applied with a voltage (e.g., 5V).

Figure 13A:
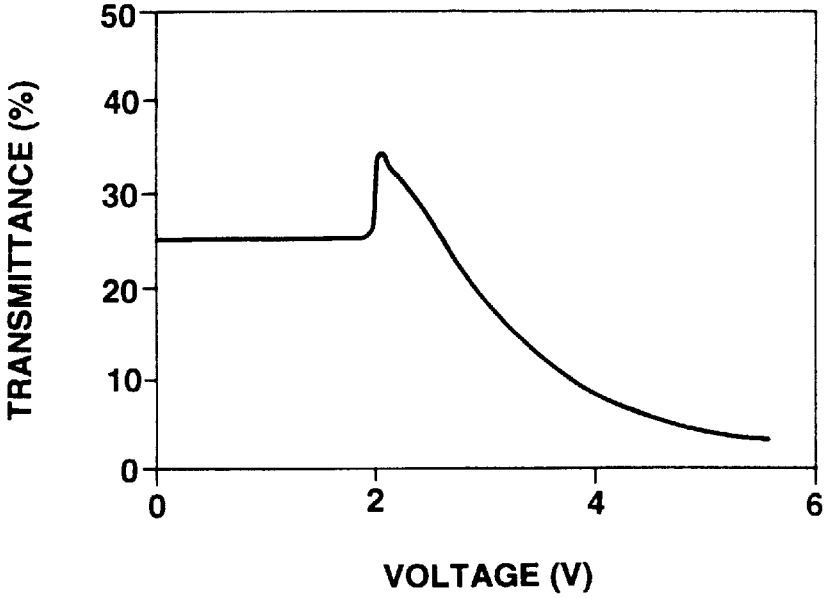
FIGS. 13A and 13B are a graph representing the voltage-transmittance characteristic, and a diagram of the CIE chromaticity which the third embodiment exhibits when the liquid crystal molecules assume the first metastable aligned state.
Figure 13B:
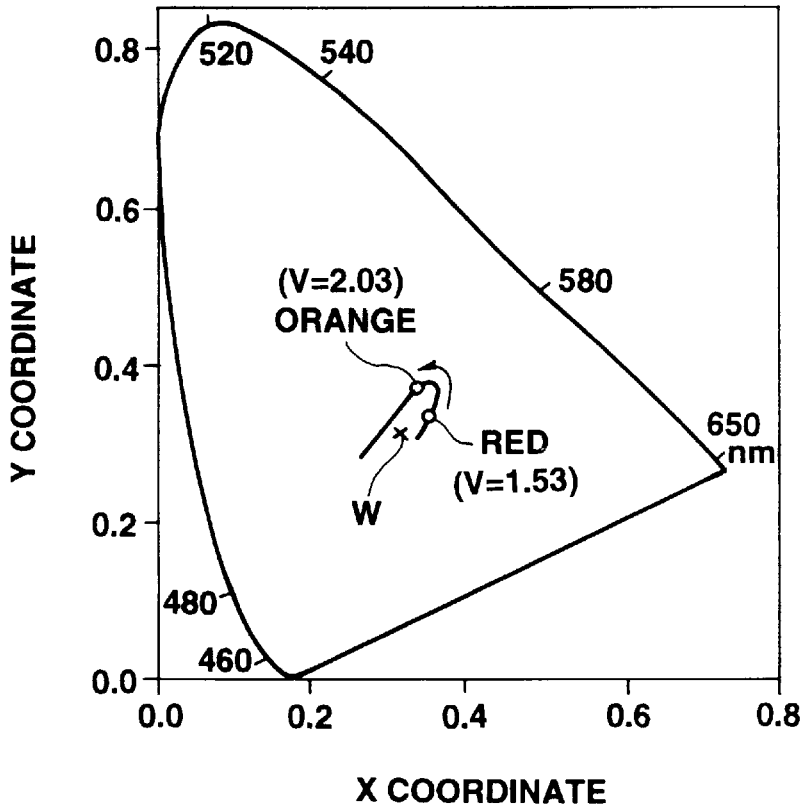

FIG. 13A shows voltage-transmittance characteristic. As clearly seen from FIG. 13B, the pixel appears red when applied with an effective value of 1.53V, and orange when applied with an effective value of 2.03V, while the liquid crystal molecules remain in the first metastable aligned state.

X- and Y-coordinate values of the red are 0.343 and 0.322, respectively (x=0.343, y=0.322). Y value (i.e., brightness) of the red is 24.31. X- and Y-coordinate values of the orange are 0.322 and 0.378, respectively (x=0.322, y=0.378). Y value of the orange is 31.98.

Figure 14A:
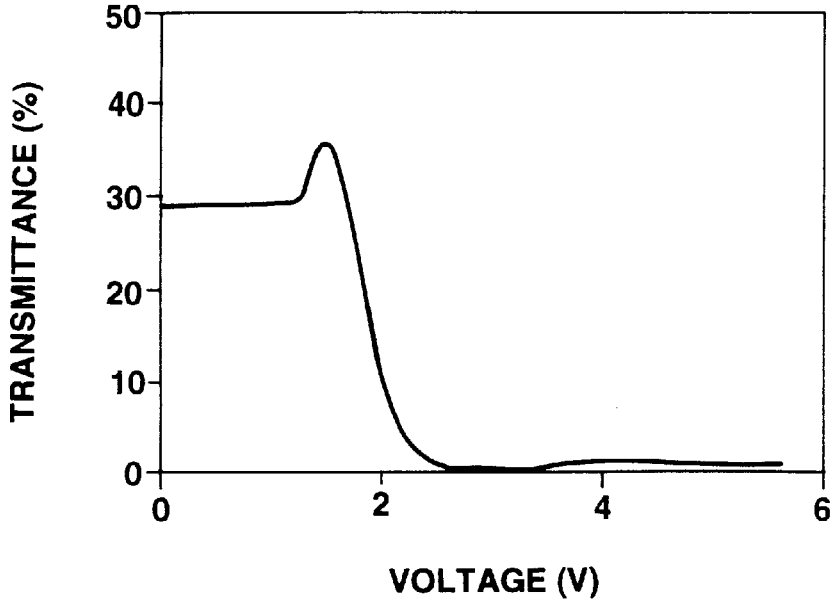
FIGS. 14A and 14B are a graph representing the voltage-transmittance characteristic, and a diagram of the CIE chromaticity which the third embodiment exhibits when the liquid crystal molecules assume the second metastable aligned state.
Figure 14B:
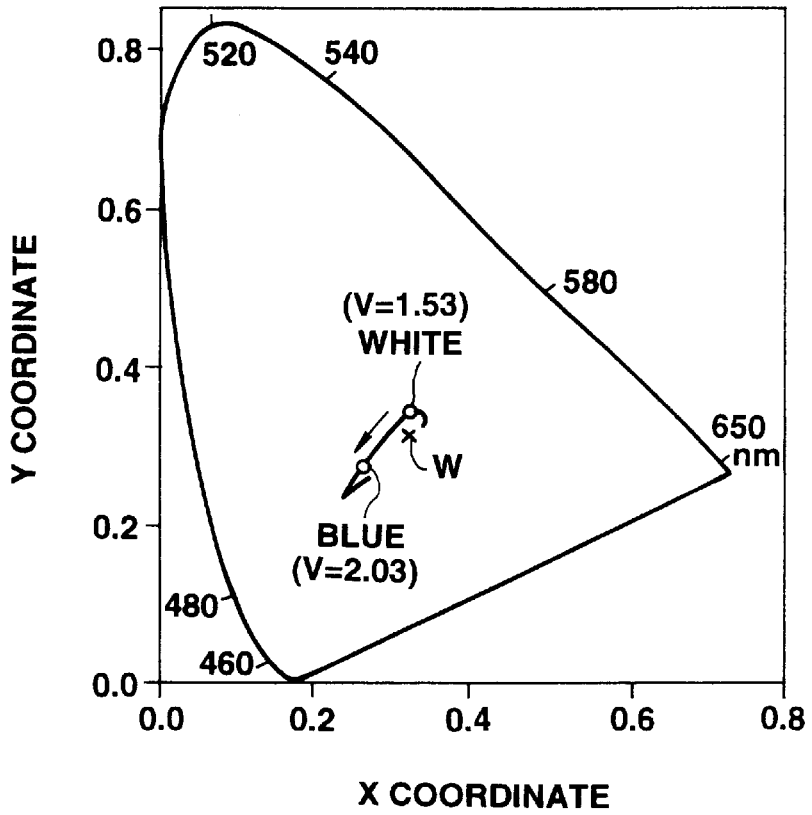

FIG. 14A shows the voltage-transmittance characteristic under the second metastable aligned state. As can be understood from FIG. 14B, the pixel appears white when applied with an effective value of 1.53V, and blue when applied with an effective value of 2.03V, while the liquid crystal molecules remain in the second metastable aligned state.

X- and Y-coordinate values of the white are 0.320 and 0.349, respectively (x=0.320, y=0.349). Y value of the white is 34.36. X- and Y-coordinate values of the blue are 0.260 and 0.278, respectively (x=0.260, y=0.278). Y value of the blue is 9.05.

As indicated above, each pixel of the third example appears either red or orange while the liquid crystal molecules 18*a* remain in the first metastable aligned state, and appears either white or blue while the molecules 18*a* remain in the second metastable aligned state. The third example can therefore display red-orange-and-blue images on white back.

According to the liquid crystal display device, the operating voltage margin is broad enough. In order to display a red-and-orange image, it suffices to supply a segment signal of 1.53V to some pixels and a segment signal of 2.03V to some other pixels while the liquid crystal molecules 18*a* remain in the first metastable aligned state. The difference in effective value between the segment signals, i.e., the operating voltage margin, is 0.50V (=2.03V−1.53V) which is sufficiently broad.

It is easy to drive the display device, because the two effective values when the molecules assume the first metastable aligned state and the two effective values when the molecules assume the second metastable aligned state are the same (1.53V and 2.03V).

The liquid crystal display device in the second example, each pixel can appear either red or white while the liquid crystal molecules 18*a* remain in the first metastable aligned state, and each pixel can appear either blue or black while the liquid crystal molecules 18*a* remain in the second metastable aligned state. The liquid crystal display device in the third example, each pixel can appear either red or orange while the liquid crystal molecules 18*a* remain in the first metastable aligned state, and each pixel can appear either white or blue while the liquid crystal molecules 18*a* remain in the second metastable aligned state. The colors change in accordance with value of Δnd of the cell 10 and the directions of the transmission axes 21*a* and 22*a* of the first and second polarizing plates 21 and 22.

(Fourth Example for the Liquid Crystal Display Device)

Figure 15A:
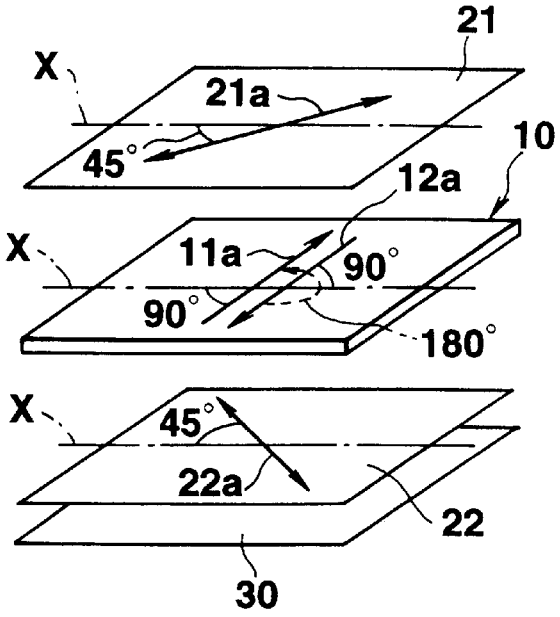
FIGS. 15A to C are perspective views showing schematic structures of the liquid crystal display device according to the fourth embodiment, and show initial aligned state, first metastable aligned state, and second metastable aligned state.
Figure 15B:
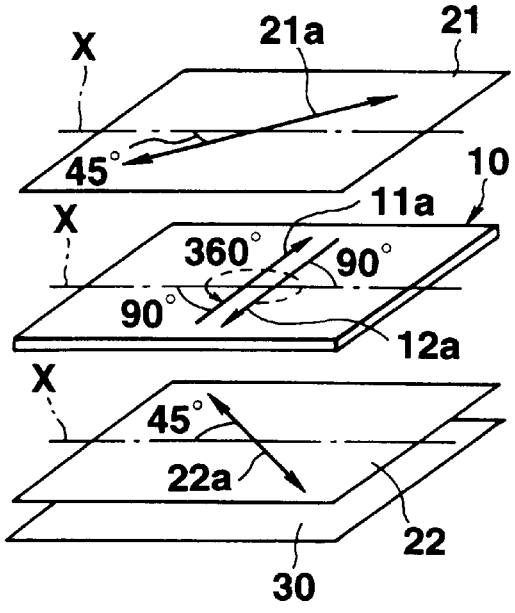
Figure 15C:
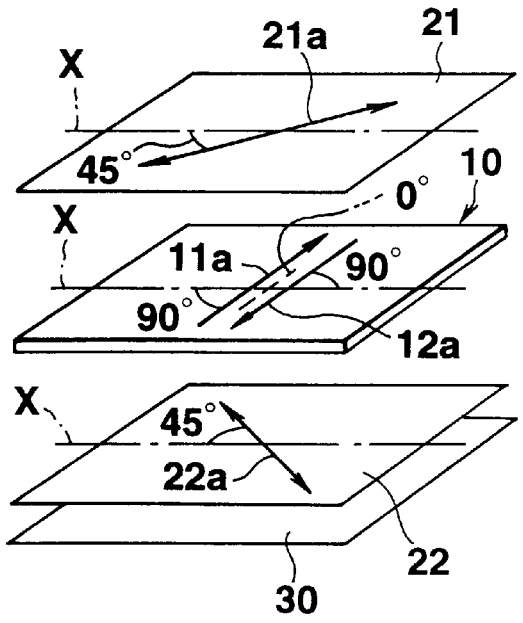

A fourth example of the liquid crystal display device will now be described with reference to FIGS. 15A to 19B. FIG. 15A illustrates the initial aligned state of the liquid crystal molecules. FIG. 15B represents the first metastable aligned state of the liquid crystal molecules. FIG. 15C depicts the second metastable aligned state of the liquid crystal molecules.

In FIG. 15A, reference numerals 11*a* and 11*b* denote directions of the aligning treatment of the substrates 11 and 12 of the liquid crystal cell 10. In this example, the first aligning film 15 of the first substrate 11 has been rubbed along a line inclined at an angle of about right angle to the horizontal axis X of the screen from the lower side of the screen to the upper side thereof. The second aligning film 16 of the second substrate 12 has been rubbed along a line inclined at about right angle to the axis X, from the upper side of the screen to the lower side thereof.

In this example, the liquid crystal 18 is contains chiral agent having twisting force in counterclockwise as viewed from the screen. The chiral agent rotates the molecules of the liquid crystal cell 10 counterclockwise (twisted direction due to the chiral agent) as viewed from the screen. Hence, the liquid crystal molecules are spray-strained and twisted counterclockwise in the initial aligned state, by an angle of about 180°.

In the initial aligned state, the liquid crystal molecules are aligned near the substrates 11 and 12 in the directions 11*a* and 12*a*, respectively, assuming a spray-aligned state. They are twisted by about 180° in the direction shown by the broken-line arrow in FIG. 15A, i.e., the direction due to the chiral agent, with respect to, for example, the direction 12*a* of the second substrate 12.

The liquid crystal cell 10 does not serve to display images while the molecules of the liquid crystal remain in the initial aligned state. The liquid crystal cell 10 is driven to display images after the liquid crystal molecules show the first and second metastable aligned states.

More specifically, after applying the reset voltage, aligning the liquid crystal molecules almost perpendicular to the substrates 11 and 12, a first metastable selection pulse may be applied between the electrodes. The first metastable state selecting pulse has a predetermined voltage value (an absolute value) Vs1 less than the reset voltage. The liquid crystal molecules in the initial aligned state are twisted by 180°. As a result, the molecules are twisted by a twist angle of 360° (=180°+180°). The liquid crystal molecules are release from the spray-strained state. They assume the first metastable aligned state.

In the first metastable aligned state, the liquid crystal molecules are aligned near the substrates 11 and 12 in the directions 11*a* and 12*a*, respectively. They are twisted counterclockwise by about 360° in the direction shown by the broken-line arrow in FIG. 15B, i.e., the direction due to the chiral agent, with respect to, for example, the direction 12*a* of the second substrate 12.

After applying a reset pulse, aligning the liquid crystal molecules almost perpendicular to the substrates 11 and 12, the second metastable state selecting pulse may be applied between the electrodes. The second metastable state selecting pulse has a predetermined voltage value (an absolute value) Vs2 lower than the reset voltage. The liquid crystal molecules in the initial aligned state are twisted by 180°. As a result, the molecules are twisted by 0° (=180°−180°). The liquid crystal molecules are released from the spray-strained state. They assume the second metastable aligned state.

The liquid crystal molecules are not twisted along the aligned direction of one of the substrates, for example, the aligned direction 12*a* of the second substrate 12. The liquid crystal molecules are aligned near the substrate 11 along the aligned direction 11*a*, and the molecules are aligned near the substrate 12 along the aligned direction 12*a*, while they are not twisted at anywhere in the liquid crystal layer, in other words, they are aligned homogeneously.

The aligned state of the liquid crystal molecules can be switched from the first metastable aligned state to the second metastable aligned state, and vice versa. To switch the first metastable aligned state to the second metastable aligned state, the reset pulse, whose voltage value causing the liquid crystal molecules to stand almost perpendicular to the substrates 11 and 12, is applied between the electrodes 13 and 14, setting the liquid crystal molecules in the initial aligned state, and the second metastable state selecting pulse is applied between the electrodes 13 and 14. Conversely, to switch the second metastable aligned state to the first metastable aligned state, the reset pulse is applied between the electrodes 13 and 14, setting the liquid crystal molecules in the initial aligned state, and the first or second metastable state selecting pulse is applied between the electrodes 13 and 14.

As shown in FIGS. 15A to 15C, the first polarizing plate 21 is arranged so that its transmission axis 21*a* and the aligned direction 11*a* of the first substrate 11 of the liquid crystal cell 10 are indicated by two lines which intersect at about 45°, and the second polarizing plate 22 is arranged so that its transmission axis 22*a* and the transmission axis 21*a* of the first polarizing plate 21 are indicated by two lines which intersect at about right angles.

The liquid crystal display device can display color images in birefringent mode, whichever the first or second metastable aligned state the molecules 18*a* assumes to control the transmission.

Figure 16A:
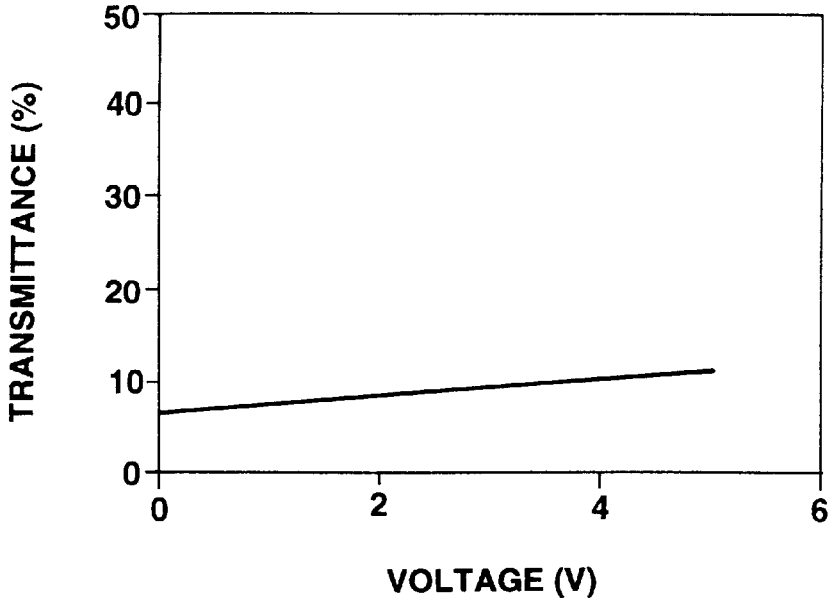
FIGS. 16A and 16B are a graph representing the voltage-transmittance characteristic, and a diagram of the CIE chromaticity which the fourth embodiment exhibits when the liquid crystal molecules assume the initial aligned state.
Figure 16B:
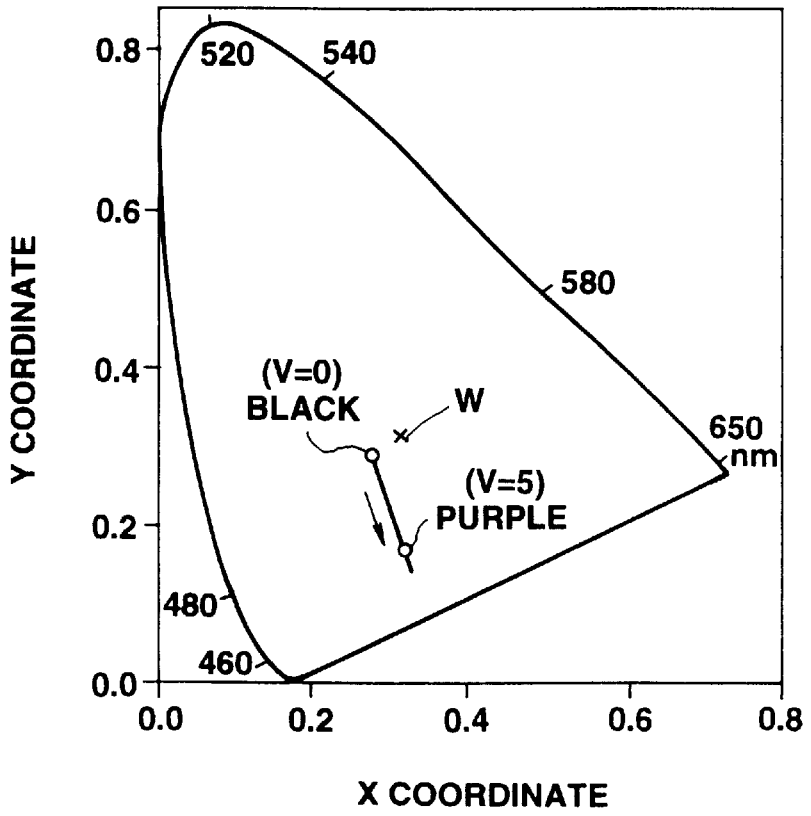
Figure 17A:
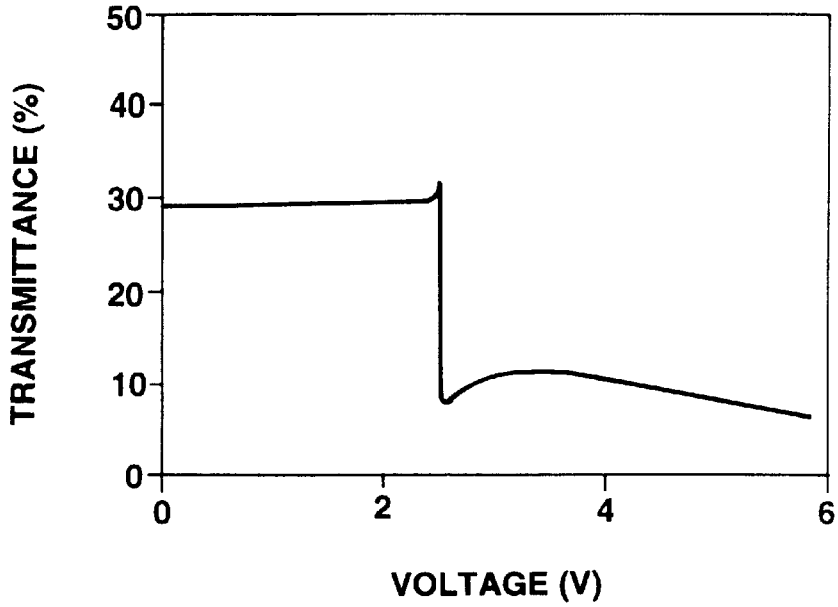
FIGS. 17A and 17B are a graph representing the voltage-transmittance characteristic, and a diagram of the CIE chromaticity which the fourth embodiment exhibits when the liquid crystal molecules assume the first metastable aligned state.
Figure 17B:
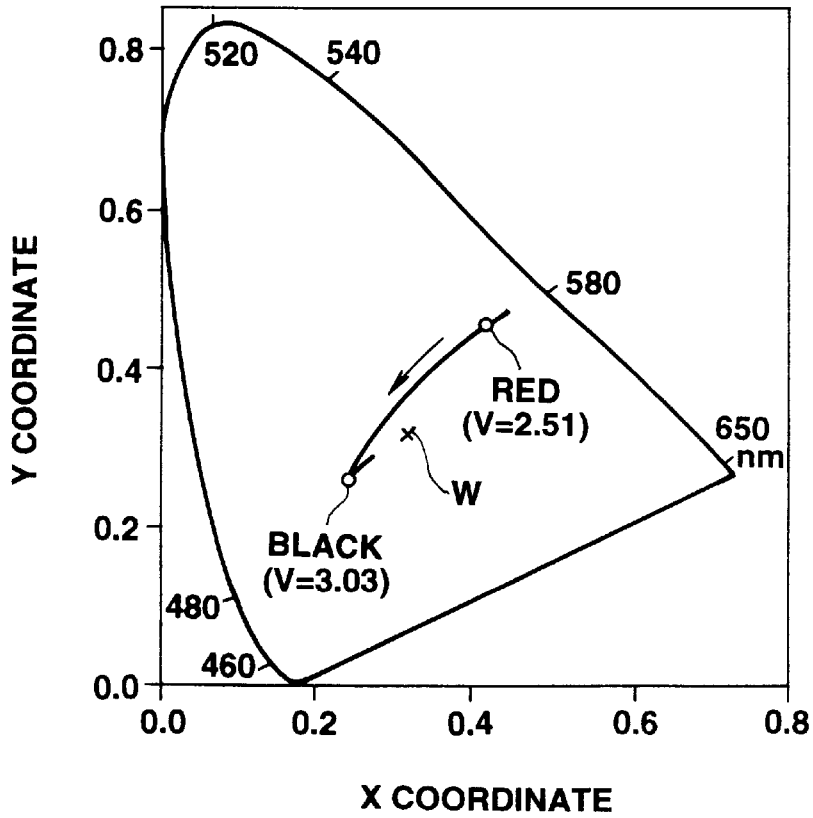
Figure 18A:
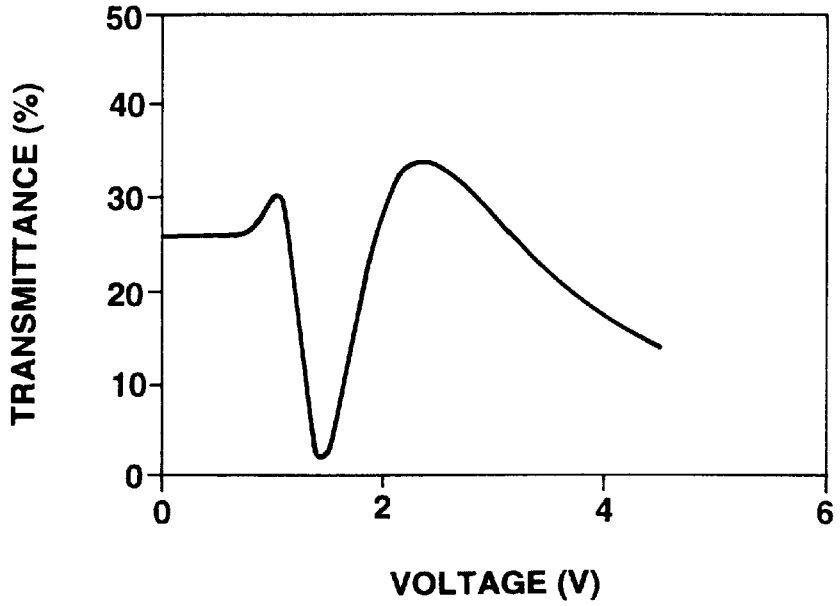
FIGS. 18A and 18B are a graph representing the voltage-transmittance characteristic, and a diagram of the CIE chromaticity which the fourth embodiment exhibits when the liquid crystal molecules assume the second metastable aligned state.
Figure 18B:
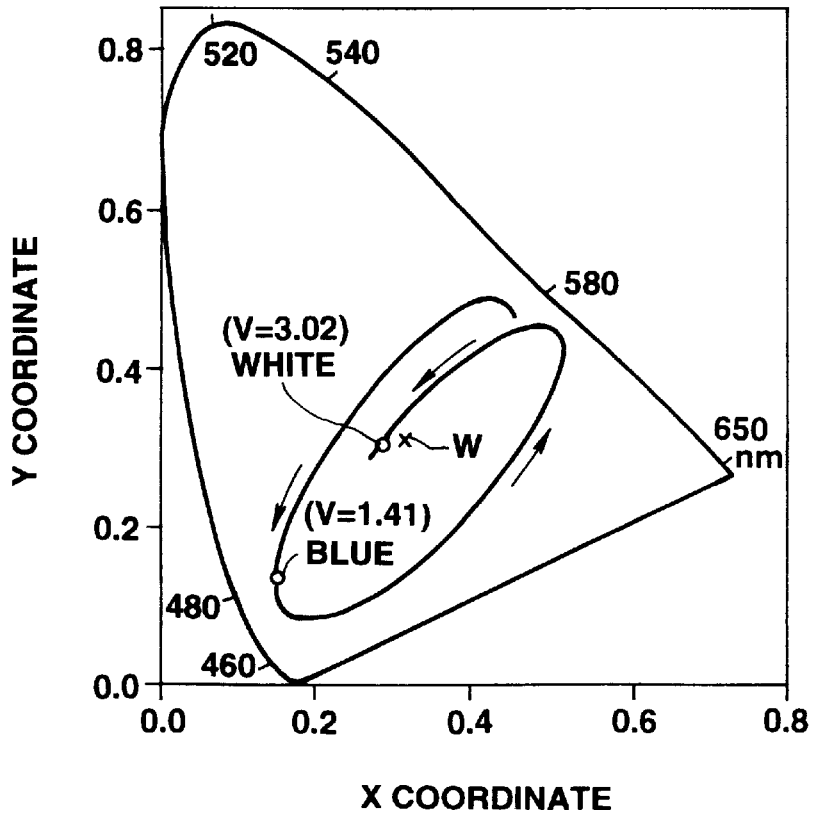

FIGS. 16A and 18B show how the transmittance of the liquid crystal layer and the color of each pixel change with the voltage applied to the pixel when the aligned directions 11*a* and 12*a* of the substrates 11 and 12 in the liquid crystal cell 10, the transmission axes 21*a* and 22*a* of the first and second polarizing plates 21 and 22 are set as shown in FIG. 9 and the value Δnd (i.e., the product of the optical anisotropy Δn of liquid crystal 18 and the thickness d of the liquid crystal layer) is set about 900 nm in the liquid crystal cell 10. More specifically, FIG. 16A represents the voltage-transmittance characteristic which the display exhibits when the liquid crystal molecules assume the initial aligned state. FIG. 16B is a diagram of the CIE chromaticity which each pixel of the display presents when the liquid crystal molecules assume the initial aligned state. FIG. 17A shows the voltage-transmittance characteristic which the display has when the liquid crystal molecules assume the first metastable aligned state. FIG. 17B is a diagram of the CIE chromaticity which each pixel presents when the liquid crystal molecules assume the first metastable aligned state. FIG. 18A shows the voltage-transmittance characteristic which the first example presents when the liquid crystal molecules assume the second metastable aligned state. FIG. 18B is a diagram representing the CIE chromaticity which each pixel presents when the liquid crystal molecules assume the second metastable aligned state. In each of the diagrams of the chromaticity, reference alphabet W denotes uncolored point.

As seen from FIG. 16A, the transmittance of each pixel changes substantially in proportion to the voltage applied to the pixel when the liquid crystal molecules assume the initial aligned state. As FIG. 16B shows, the pixel appears black when a voltage is 0V (no voltage is applied) is applied to it. The pixel appears purple when applied with a voltage (e.g., 5V).

FIG. 17A shows, the transmittance of the liquid crystal layer remains high and almost unchanged when the voltage applied ranges from 0V to about 2.5V, and abruptly decreases when the voltage rises above 2.5V, as long as the liquid crystal molecules 18*a* assume the first metastable aligned state. As clearly seen from FIG. 17B, the pixel appears red when applied with a voltage of 2.51V, and black when applied with a voltage of 3.03V, while the liquid crystal molecules remain in the first metastable aligned state.

X- and Y-coordinate values of the red are 0.42 and 0.46, respectively (x=0.42, y=0.46). Y value (i.e., brightness) of the red is 30.13. X- and Y-coordinate values of the black are 0.27 and 0.29, respectively (x=0.27, y=0.29). Y value of the black is 11.6.

FIG. 18A shows the voltage-transmittance characteristic under the second metastable aligned state. As can be understood from FIG. 18B, the pixel appears blue when applied with a voltage of 1.41V, and white when applied with a voltage of 3.02V, while the liquid crystal molecules remain in the second metastable aligned state.

X- and Y-coordinate values of the blue are 0.15 and 0.14, respectively (x=0.15, y=0.14). Y value of the blue is 5.7. X- and Y-coordinate values of the white are 0.29 and 0.31, respectively (x=0.29, y=0.31). Y value of the white is 26.7.

Each pixel of the fourth example appears either red or black while the liquid crystal molecules 18*a* remain in the first metastable aligned state, and appears either blue or white while the molecules 18*a* remain in the second metastable aligned state.

As described above, the fourth example has the electrooptical characteristics of two liquid crystal displays which differ in the alighted state of liquid crystal molecules. The characteristics of one display are used to control some of the gray-scale levels of each pixel or some of color tones of the pixel, and the characteristics of the other display are used to control the remaining gray-scale levels of the pixel or the remaining color tones of the pixel. To be more specific, the liquid crystal molecules 18*a* are set in the first metastable aligned state and the transmittance of each pixel is controlled, whereby the pixel presents one of the gray-scale level or color tones of the first set, and the molecules 18*a* are set in the second metastable aligned state and the transmittance of each pixel is controlled, whereby the pixel presents one of the gray-scale level or color tones of the second set. Hence, the drive signal only needs to be time-divided far less minutely, providing fewer segment signals for driving while the molecules remain in the first or second metastable aligned state.

Hence, the operating voltage margin can be broad, making it possible to drive the liquid crystal cell 10 in high-duty time division, though the cell 10 is a simple matrix cell which is driven by a controlled drive signal. The liquid crystal display according to the fourth example can therefore display an image composed of a great number of pixels.

The display colors may be changed in accordance with the value of Δnd for the liquid crystal cell 10.

In the liquid crystal display device of the present invention, the initial aligned state in the liquid crystal cell 10 is not limited to the description in the first to fourth examples. The liquid crystal molecules which are spray-aligned at angle from 0° to about 180° in one direction with respect to the aligned direction of one of the substrates, may be allowed to be used for the liquid crystal display device.

For example, if all of molecules are aligned along an aligned direction of one of substrate and not twisted when the molecules assume the initial aligned state, the molecules are twisted at twist angle of 180° in one direction with respect to the aligned direction of one of the substrates and released from spray-strained state when the molecules assume the first metastable aligned state, and the molecules are twisted at angle of 180° in the direction inverse to the one direction with respect to the aligned direction of one of the substrates and released from the spray-strained state when the molecules assume the second metastable aligned state.

For example, if molecules are twisted at angle of 180° in one direction with respect to the aligned direction of one of the substrates when the molecules assume the initial aligned state, the molecules are twisted at angle of 360° in one direction with respect to the aligned direction of one of the substrates and released from spray-strained state when the molecules assume the first metastable aligned state, and all of the molecules are not twisted along the aligned direction of one of the substrates and released from spray-strained state when the molecules assume the second metastable aligned state.

Accordingly, the liquid crystal display device can display color images in birefringent mode, whichever the first or second metastable aligned state the molecules 18*a* assumes to control the transmission by setting at least the direction of the transmission axis 21*a* of the first polarizing plate 21 of the pair of the polarizing plates 21 and 22 interposing the liquid crystal cell 10 so as to intersect with the aligned direction 11*a* of the first substrate 11 in the liquid crystal cell 10.

Figure 19:
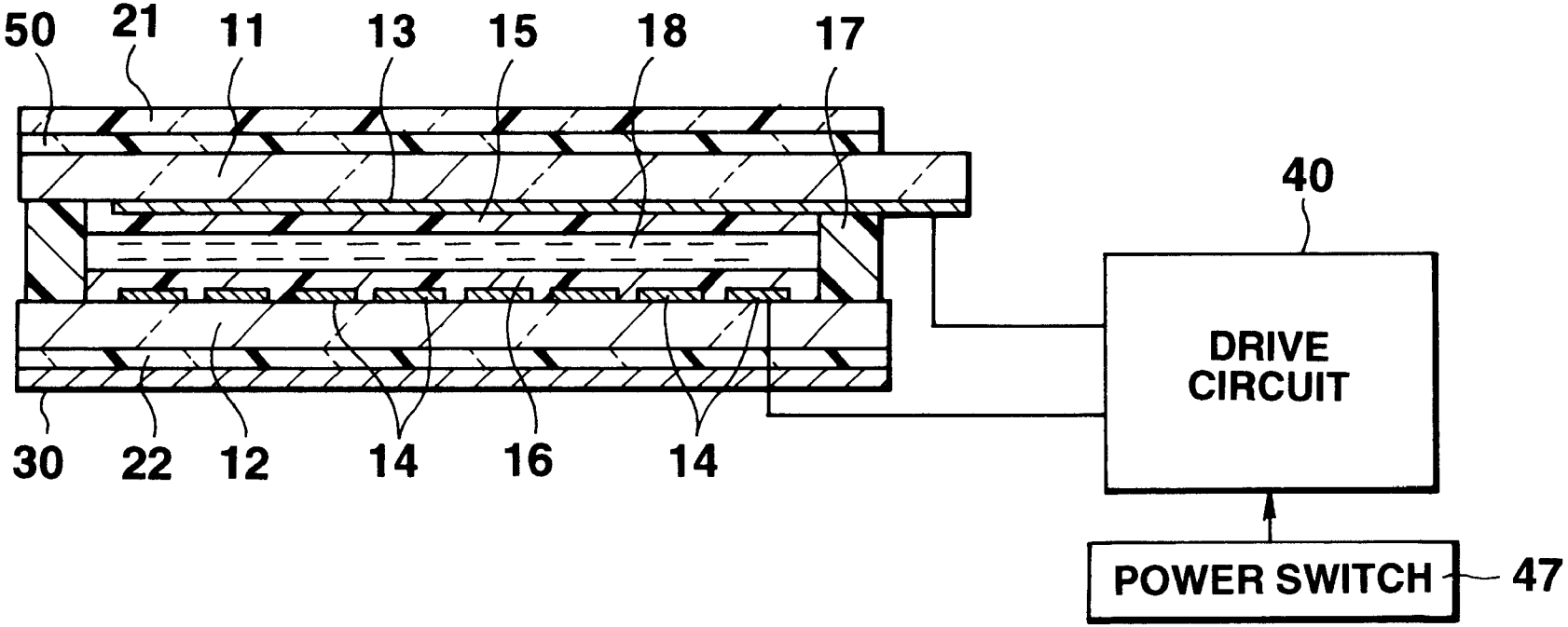
FIG. 19 is a sectional view of a modification of the basic structure of the liquid crystal display device shown in FIG. 1.

Further, a retardation plate 50 may be arranged between the liquid crystal cell 10 and one of or both the first and second polarizing plates 21 and 22 as shown in FIG. 19.

Addition of the retardation plate is effective for a liquid crystal display device which displays color images in birefringent mode. If the retardation plate is added, lights having each wavelength to be incident to the second polarizing plate 22 is greatly polarized by birefringence caused by the liquid crystal layer in the liquid crystal cell 10 and the retardation plate. The light becomes brighter colored light whose strength of wavelength greatly differ from each other after transmits the second polarizing plate 22. Moreover, the color of the colored light changes because the transmission rate of each wavelength and difference thereof change in response to change of aligned state of the molecules in accordance with the effective value of the drive voltage. As a result, the number of display colors increases.

The present invention may be applied to a transmissive liquid crystal display device (without the reflective plate 30) which utilizes light from its backlight.

Furthermore, the present invention may be applied to a reflective liquid crystal display device having one polarizing plate on the outer surface of its liquid crystal cell and a reflection plate on the back surface of the liquid crystal cell. In this case, the reflective plate may be arranged on a rear substrate of the liquid crystal cell. Or, a metal layer forms electrodes to be disposed on the inner surface of the rear substrate, and the electrodes may function as the reflection plate.

[Embodiments of Drive Circuit 40]

The above-described drive circuit 40 and a method of driving the liquid crystal cell 10 by means of this drive circuit 40 will be described below with reference to the case where the liquid crystal display according to the above-described second or third embodiment.

First Embodiment

Figure 20:
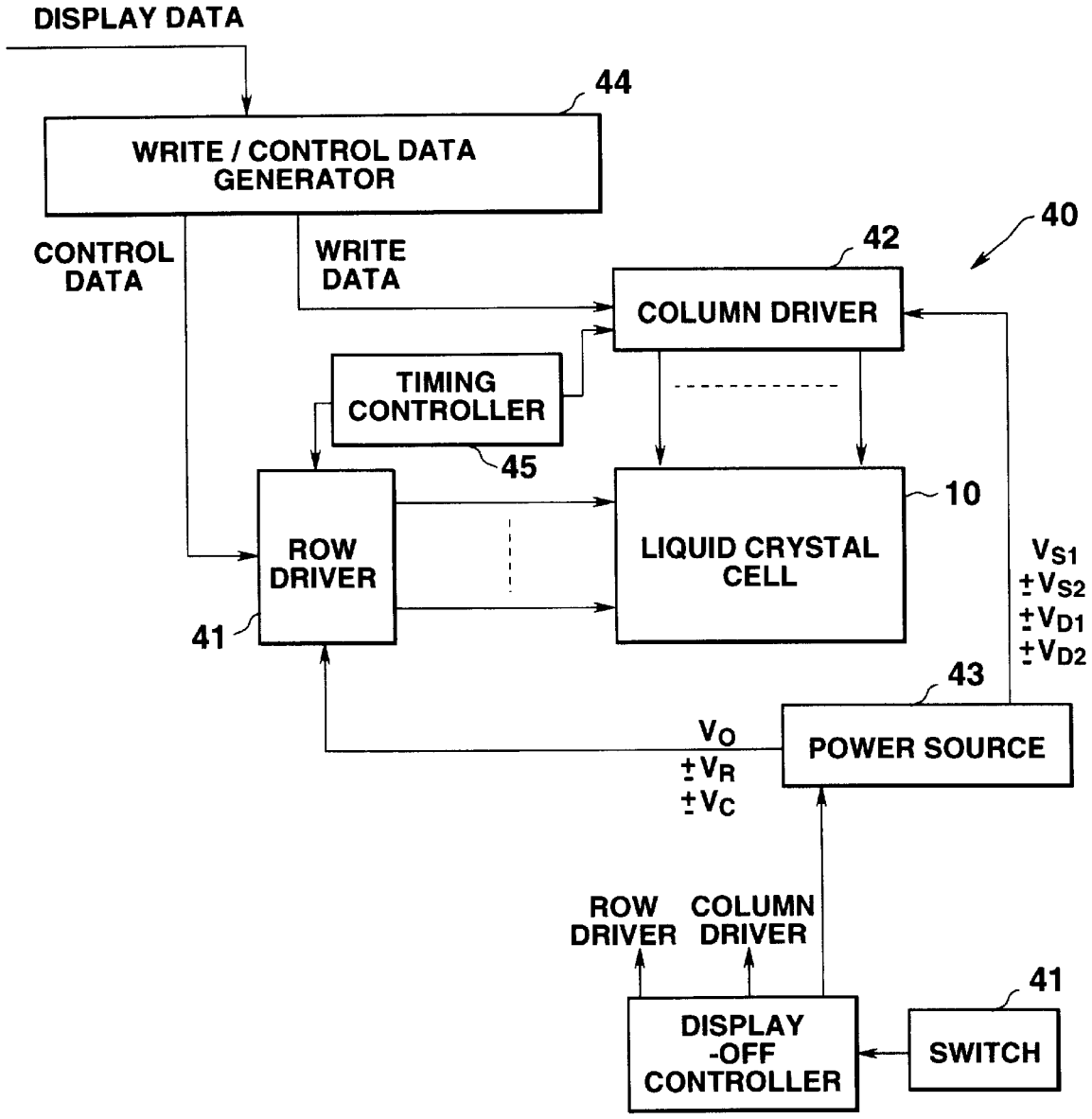
FIG. 20 is a block diagram of a driving circuit shown in FIG. 1 according to a first example.

FIG. 20 shows the structure of the drive circuit 40. The drive circuit 40 comprises a row driver 41 for supplying a scan signal to the individual scan electrodes 13 of the liquid crystal cell 10, a column driver 42 for supplying a data signal to the individual signal electrodes 14 of the liquid crystal cell 10, a power source 43, a write/control data generator 44, a timing controller 45 and a display OFF controller 46.

The row driver 41, connected to the individual scan electrodes 13 of the liquid crystal cell 10, applies the scan signal, which will be discussed later, to the scan electrodes 13.

The column driver 42, connected to the individual signal electrodes 14 of the liquid crystal cell 10, applies the data signal, which will be discussed later, to the signal electrodes 14.

The power source 43 generates reset voltages $+V_R$ and $-V_R$ to be applied between the electrodes of the liquid crystal cell 10, and write-period voltages $+V_C$ and $-V_C$ which define the write period in which the write voltage for determining the effective value of the aforementioned drive voltage is applied between the electrodes, and supplies the generated voltages to the row driver 41.

The power source 43 further generates a first metastable-aligned-state selecting voltage $V_{S1}$ to be applied between the electrodes of the liquid crystal cell 10, a second metastable-aligned-state selecting voltage $\pm V_{S2}$ to be applied between the electrodes of the liquid crystal cell 10, and write voltages $\pm V_{D1}$ and $\pm V_{D2}$ to be applied between the electrodes, and supplies the generated voltages to the column driver 42.

In the second and third examples of the liquid crystal display device, since two effective values for selectively designating and displaying an aligned state in the first metastable aligned state are identical to two effective values for selectively designating and displaying an aligned state in the second metastable aligned state, the voltages $\pm V_{D1}$ and $\pm V_{D2}$ suffice as the write voltages.

In the second and third examples of the liquid crystal display device, as mentioned above, the voltage for selecting the first metastable aligned state is substantially 0 V, so that the first metastable-aligned-state selecting voltage $V_{S1}$ may be identical to the reference potential $V_0$ of the scan signal to be supplied to the row driver 41.

To drive the liquid crystal cell 10 by a frame inversion system, the power source 43 supplies the reset voltages $+V_R$ and $-V_R$ of the opposite polarities with respect to the reference potential $V_0$ of the scan signal and having substantially the same absolute values, and the write-period voltages $+V_C$ and $-V_C$ of the opposite polarities with respect to the reference potential $V_0$ of the scan signal and having substantially the same absolute values, to the row driver 41 as mentioned above. Further, the power source 43 supplies the second metastable-aligned-state selecting voltages $+V_{S2}$ and $-V_{S2}$ of the opposite polarities with respect to the first metastable-aligned-state selecting voltage $V_{S1}$ (which is the same in potential to the reference potential $V_0$ of the scan signal) and having substantially the same absolute values, and the write voltages $+V_{D1}$ and $-V_{D1}$ and $+V_{D2}$ and $-V_{D2}$ to the column driver 42.

The write/control data generator 44 generates control data for controlling the polarity and application timing of the reset voltage and write data for selecting the first or second metastable aligned state and subsequent writing based on display data which is externally supplied, and supplies the control data to the row driver 41 and the write data to the column driver 42.

The row driver 41 sequentially generates the reset voltages $+V_R$ and $-V_R$ and the write-period voltages $+V_C$ and $-V_C$ with reference to the reference potential $V_0$ in a cycle predetermined in response to a clock signal which is supplied from the timing controller 45, and further generates a scan signal of a waveform which suppresses the generation of the reset voltage $+V_R$ or $-V_R$ in accordance with the control data from the write/control data generator 44, and applies the generated voltages and scan signal to the individual scan electrodes 13 of the liquid crystal cell 10.

Any scan signal, this row driver 41 supplies to the individual scan electrodes of the liquid crystal cell 10, has such a waveform that holds the reference potential $V_0$ in other periods than the reset period and the write period of a row of pixels associated with the scan electrodes to which the scan signal is supplied, becomes the aforementioned reset voltage $+V_R$ or $-V_R$ in the reset period, and becomes the write-period voltage $+V_C$ or $-V_C$ in the write period. The waveform of the scan signal inverts with respect to the reference potential $V_0$ for a predetermined number of frames, e.g., one frame.

The column driver 42 generates a data signal whose waveform is synchronized with the first and second metastable-aligned-state selecting voltage $V_{S1}$ and $V_{S2}$ ($+V_{S2}$ or $-V_{S2}$) in accordance with the clock signal supplied from the timing controller 45 and the write data from the write/control data generator 44, and supplies the data signal to the individual signal electrodes of the liquid crystal cell 10.

The data signal, the column driver 42 supplies to the individual scan electrodes of the liquid crystal cell 10, has such a waveform that becomes the first or second metastable-aligned-state selecting voltage $V_{S1}$ or $V_{S2}$ for each metastable-aligned-state selecting period immediately after the reset period of each pixel row, and becomes one of the two write voltages $V_{D1}$ and $V_{D2}$ for each write period of each pixel row. The waveform of the data signal inverts with respect to the first metastable-aligned-state selecting voltage $V_{S1}$ for a predetermined number of frames, e.g., one frame.

The timing controller 45 generates the clock signal to control the operational timings of the row driver 41 and the column driver 42.

The display OFF controller 46, which is designed for the eighth embodiment, detects that a power switch 47 is switched off, and then permits the row driver 41 and the column driver 42 to perform predetermined display end operations.

A description will now be given of a method of driving the liquid crystal cell 10 by the drive circuit 40 according to this embodiment.

In this embodiment, to eliminate flickering of the screen by increasing the frame frequency, all the pixel at rows of the liquid crystal cell 10 are separated into groups each consisting of a plurality of rows, and the resetting of the written state (the metastable aligned state and the aligned state of the liquid crystal molecules) of pixel sections in each of the pixel rows in one group and selection of the next metastable aligned state of that pixel row, and writing of the pixel sections of all the pixel rows are performed every frame. During one frame, therefore, the resetting of the written state of pixel sections in each pixel row in one group and selection of the next metastable aligned state of that pixel row, and subsequent new writing are carried out, and rewriting to keep the written state is performed on the pixel rows of the other groups.

That is, as one way of driving the liquid crystal cell 10, the resetting of all the pixel rows and selection of the metastable aligned state thereof may be performed sequentially during one frame after which writing in the individual pixel rows may be performed sequentially. However, the resetting of each pixel row and selection of the metastable aligned state thereof require a certain time, and thus the resetting of all the pixel rows and selection of the metastable aligned state thereof take a long time. This elongates one frame and thus reduces the frame frequency.

What is more, this method disables new writing of a pixel row whose metastable aligned state has been selected, until the resetting of the remaining pixel rows and selection of the metastable aligned state thereof are completed, then the writing of the individual pixel rows starts one after another and the write period for that pixel row comes. Particularly, the pixel row whose metastable aligned state has been selected earlier suffers the disabled sate longer, causing flickering of the screen.

According to this embodiment, in view of the above, all the pixel rows of the liquid crystal cell 10 are separated into groups each consisting of a plurality of rows, and the resetting of the written state of pixel sections in each of the pixel rows in one group and selection of the next metastable aligned state of that pixel row, and writing of the pixel sections of all the pixel rows are carried out every frame. This way, the time for the resetting and the selection of the metastable aligned state that should be secured for one frame can merely be the time required for the resetting and the selection of the metastable aligned state for one group of pixel rows. It is therefore possible to shorten one frame and increase the frame frequency.

According to this method, writing of a pixel row in one group whose metastable aligned state has been selected is executed when the resetting of the remaining pixel rows in that group and selection of the metastable aligned state thereof are finished after which the writing of the individual pixel rows in this group starts one after another and the write period for the selected pixel row comes. Even for a pixel row in a group whose metastable aligned state has been selected first, the idling time to the implementation of new writing is very short, preventing the screen from flickering.

In such a case where all the pixel rows of the liquid crystal cell 10 are separated into groups each consisting of a plurality of rows, only one group of pixel rows is rewritten every frame and rewriting is merely performed on the other groups of pixel rows to keep their written states in that frame, so that one screen of images is rewritten in the same number of frames as the number of groups of pixel rows. If a large number of frames are needed to rewrite one screen of images, therefore, switching between screens becomes slower.

In this respect, it is desirable to perform grouping of the pixel rows in such a way that one group of pixel rows is so selected as to acquire a high frame frequency and that the number of groups should be selected so that the number of frames for rewriting one screen of images does not become too large.

As one such example, if a simple matrix type liquid crystal cell has 64 rows of pixels, though there are simple matrix type liquid crystal cells which have 32 pixel rows, 64 pixel rows, 128 pixel rows and the like, it is preferable to separate the pixel rows into groups of eight rows. A group consisting of about eight pixel rows can provide a sufficiently high frame frequency. Further, separating 64 rows into groups of eight rows allows one screen of images to be rewritten in about eight to nine frames, resulting in smooth switching between screens.

That is, if the frame frequency is 1/30 sec and the number of frames needed to rewrite one screen of images is eight to nine, approximately three to four screens can be rewritten per second, thus ensuring smooth switching between screens.

For the following reason, however, it is desirable to select the grouping of pixel rows in such a manner that the composition of pixel rows in each group is to be changed every time one screen of images is rewritten or every cycle in which resetting and selecting the metastable aligned states of all the groups of pixel rows are executed.

The display state from the resetting to the writing of an area corresponding to a group of pixel rows which is to be rewritten by selecting the metastable aligned state at the time of designating the resetting of the previous written state and applying a write voltage (this area will be hereinafter called rewriting area) differs from the display state of an area corresponding to a group of pixel rows which is not to be rewritten and keeps the previous written state (the latter area will be hereinafter called non-rewriting area). If the composition of pixel rows in each group is always the same, therefore, the boundary between the writing area and the non-writing area appears at the same location every cycle, making the display irregularity prominent.

Let us consider the case where the liquid crystal cell has a total of 64 pixel rows which are to be separated into groups of eight. In this case, if the whole pixel rows are separated into groups in such a way that the total number of pixel rows is dividable by the number of pixel rows in one group, yielding the groups that respectively consist of first to eighth rows, ninth to sixteenth rows, seventeenth to twenty-fourth rows, so forth to the fifty-seventh to sixty-fourth rows, the composition of pixel rows in each group is always the same and the boundaries between individual groups of pixel rows are fixed. This causes the boundary between a writing area and a non-writing area to appear at the same location every cycle.

By contrast, if grouping the pixel rows is carried out in such a way that a part of the composition of pixel rows in each group is altered cycle by cycle, as mentioned above, the boundary between a writing area and a non-writing area is shifted cycle by cycle, thus making display irregularity, caused by a difference between the display states of those areas, unnoticeably small.

For example, the boundary between a writing area and a non-writing area can be shifted by one pixel row every cycle by grouping the pixel rows in such a way that the last pixel row in each group overlaps the first pixel row in the next group, sequentially rewriting the individual pixel row groups of the first to eighth rows, eighth to fifteenth rows, fifteenth to twenty-second rows, so forth to the fifty-seventh to sixty-fourth rows in the first cycle, and sequentially rewriting the individual pixel row groups of the sixty-third to sixth rows, sixth to thirteenth rows, thirteenth to twentieth rows, so forth to the fifty-fifth to sixty-second rows in the third cycle.

The number of overlapping pixel rows in each group is not limited to one, but may be a plurality of rows; for example, if the number of overlapping pixel rows in each group is set to two, the boundary between a writing area and a non-writing area is shifted by two pixel rows cycle by cycle.

If the total number of pixel rows of the liquid crystal cell is not dividable by the number of pixel rows in one group, however, the boundary between a writing area and a non-writing area can be shifted every cycle without making each group of pixel rows partially overlapping the next group.

Figure 21:
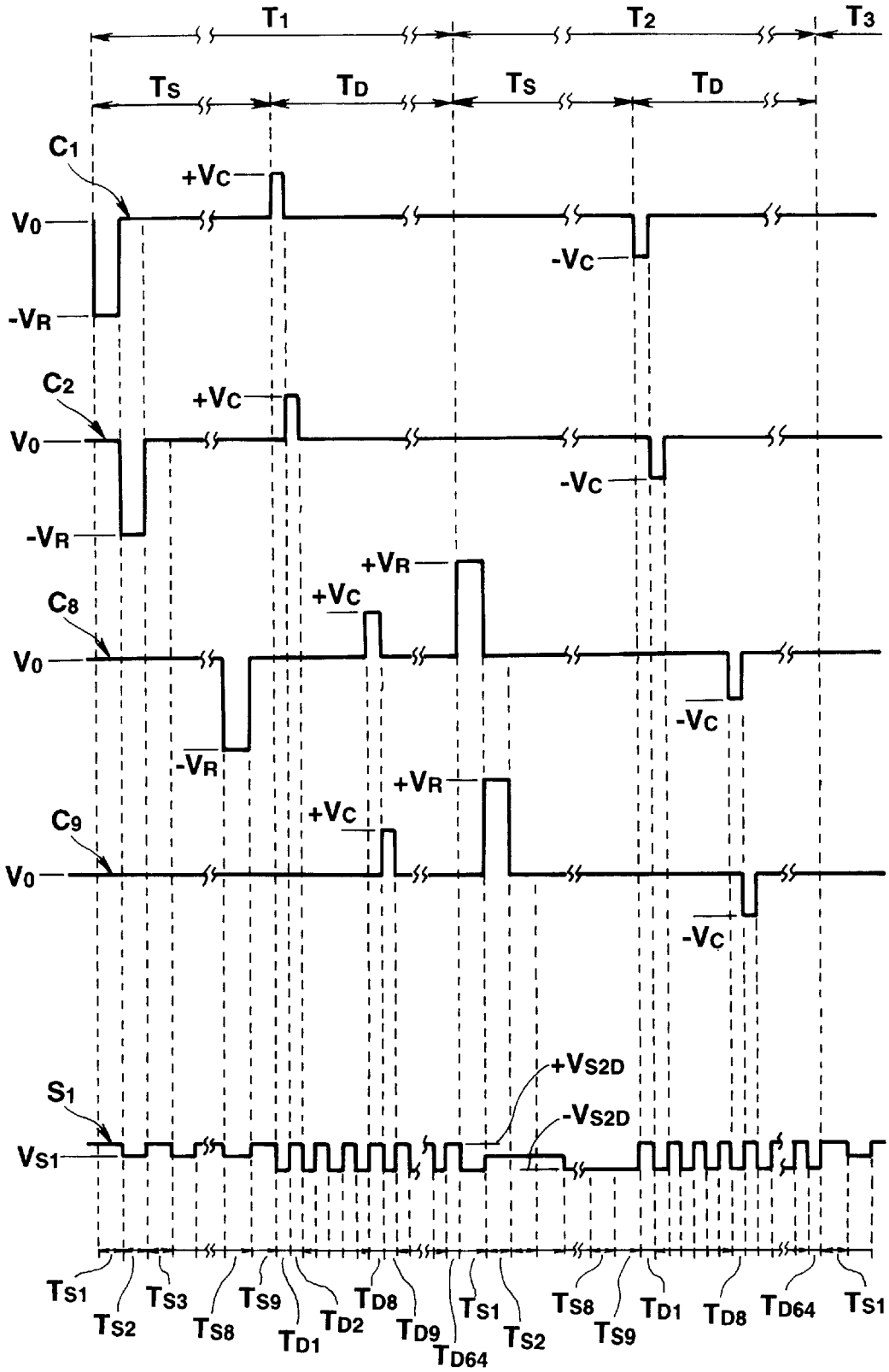
FIG. 21 is a timing chart showing waveforms of a scanning signal and a data signal for explaining a driving method for the liquid crystal display device of the present invention according to the first embodiment.

FIG. 21 presents a waveform chart of a scan signal and a data signal in the case where the entire 64 pixel rows of the liquid crystal cell are separated into groups of eight and the liquid crystal cell is driven by a method of shifting the boundary between a writing area and a non-writing area is shifted by one pixel row every cycle. This figure shows waveforms of scan signals $C_1$, $C_2$, $C_8$ and $C_9$ which the row driver 41 respectively supplies to the first row of scan electrodes, the second row of scan electrodes, the eighth row of scan electrodes, and the ninth row of scan electrodes, and the waveform of a data signal $S_1$ which is supplied to the first column of signal electrodes by the column driver 42.

As shown in FIG. 21, the initial periods for all the frames T1, T2 and so forth are set to a reset/metastable-aligned-state selecting period $T_S$ for one pixel row group, and the remaining periods are set to a write period $T_D$ for all of the first to sixty-fourth pixel rows.

The reset/metastable-aligned-state selecting period $T_S$ is equally divided to first to ninth periods $T_{S1}$ to $T_{S9}$, and the first pixel row in the first group of (eight) pixel rows is reset in the first sub period $T_{S1}$ while selecting the metastable aligned state of the first pixel row and resetting the second pixel row are carried out in the second sub period $T_{S2}$. Likewise, resetting the other pixel rows and selecting the metastable aligned states thereof are performed so that selecting the metastable aligned state of the seventh pixel row and resetting the eighth pixel row are carried out in the eight sub period $T_{S8}$ and the metastable aligned state of the eighth pixel row is selected in the last, ninth sub period $T_{S9}$. For example, the reset/metastable-aligned-state selecting period $T_S$ is about 300 ms and each of the sub periods $T_{S1}$ to $T_{S9}$ is about 33 ms.

In this embodiment, the write period $T_D$ is equally divided into 64 periods $T_{D1}$ to $T_{D64}$ in each of which writing of one pixel row is performed one after another. In this case, the write period $T_D$ is about 10 ms, and each of the equally divided periods $T_{D1}$, $T_{D2}$, $T_{D3}$, . . . , $T_{D64}$ is about 0.16 ms.

The scan signal and the data signal will be discussed below.

Each of the scan signals, the row driver 41 supplies to the individual scan electrodes of the liquid crystal cell 10, has such a waveform that it is set to the reference potential $V_0$ in other periods than the reset period and the write period for the pixel row associated with the scan electrode to which that scan signal is supplied, the reset voltage $+V_R$ or $-V_R$ (e.g., a voltage having a potential difference of about 30 V with respect to the reference potential $V_0$) is supplied in the reset period, the write-period voltage $+V_C$ or $-V_C$ (e.g., a voltage having a potential difference of about 6.5 V with respect to the reference potential $V_0$) is supplied in the write period. The waveform inverts every frame with respect to the reference potential $V_0$.

The reset voltage $V_R$ is supplied to the individual scan electrodes once in nine frames (one cycle) excluding the first pixel row in each group in the case where the last pixel row in each group overlaps the first pixel row in the next group, and the reset voltage $V_R$ is supplied to the last pixel row in each group once in each of the last reset period of one frame and the first reset period of the next frame.

The write-period voltage $V_C$ is supplied to the individual scan electrodes once every frame, and the period in which the reset voltage $V_R$ is supplied is shifted by one set period every nine frames while the period in which the write-period voltage $V_C$ is supplied is the same in any frame (the period for selecting the pixel row associated with the scan electrode to which that scan signal is supplied).

Any of the individual data signals to be applied to the signal electrodes of the liquid crystal cell 10 from the column driver 42 basically has such a waveform that the first or second metastable-aligned-state selecting voltage $V_{S1}$ or $V_{S2}$ (e.g., a voltage having a potential difference of about 0.5 V with respect to the first metastable-aligned-state selecting voltage $V_{S1}$) is supplied in every metastable-aligned-state selecting period immediately after the reset period for all the pixel rows, and two write voltages $V_{D1}$ and $V_{D2}$ are selectively supplied in every write period for each pixel row in accordance with display data. The waveform inverts frame by frame with respect to the first metastable-aligned-state selecting voltage $V_{S1}$.

To simplify the structures of the column driver 42 and the power source 43, in this embodiment, each data signal is so designed as to have a simple waveform such that the potential of the data signal $S_1$ varies in three ways, $V_{S1}$, $+V_{S2D}$ and $-V_{S2D}$, by setting the first metastable-aligned-state selecting voltage $V_{S1}$ among the three voltages $V_{S1}$, $+V_{S2D}$ and $-V_{S2D}$ substantially identical to the reference potential $V_0$ as shown in FIG. 21.

The voltages $+V_{S2D}$ and $-V_{S2D}$ have the same absolute values, and their potential differences with respect to the reference potential $V_0$ of the scan signal become equal to the second metastable-aligned-state selecting voltage (the voltage of a low value by which the liquid crystal molecules are tilted by an angle equal to or close to the pre-tilt angle in the initial aligned state).

In this embodiment, the absolute values of the write-period voltages $+V_C$ and $-V_C$ of the scan signal are so set that their potential differences with respect to $+V_{S2D}$ and $-V_{S2D}$ of the data signal can provide different effective values of the drive voltage in the first and second metastable aligned states.

Specifically, in this embodiment, the potential difference between the write-period voltage $+V_C$ of the scan signal and $+V_{S2D}$ of the data signal becomes the write voltage for acquiring the aligned state where the effective value of the drive voltage is relatively small (the upper aligned state in FIG. 3) from among the aligned states of the liquid crystal molecules according to the effective values of the drive voltage in the first and second metastable aligned states shown in FIG. 3, the potential difference between the write-period voltage $+V_C$ and $-V_{S2D}$ of the data signal becomes the write voltage for acquiring the aligned state where the drive voltage has a high effective value to some degrees (the lower aligned state in FIG. 3), the potential difference between the write-period voltage $-V_C$ and $+V_{S2D}$ of the data signal becomes the write voltage for acquiring the aligned state where the effective value is high, and the potential difference between the write-period voltage $-V_C$ and $-V_{S2D}$ of the data signal becomes the write voltage for acquiring the aligned state where the effective value is low.

The absolute value of the reset voltage $V_R$ of the scan signal is set to a value which provides a potential difference enough to make the liquid crystal molecules stand nearly perpendicularly with respect to any of the voltages $V_{S1}$, $+V_{SD2}$ and $-V_{SD2}$ of the data signal.

Figure 22:
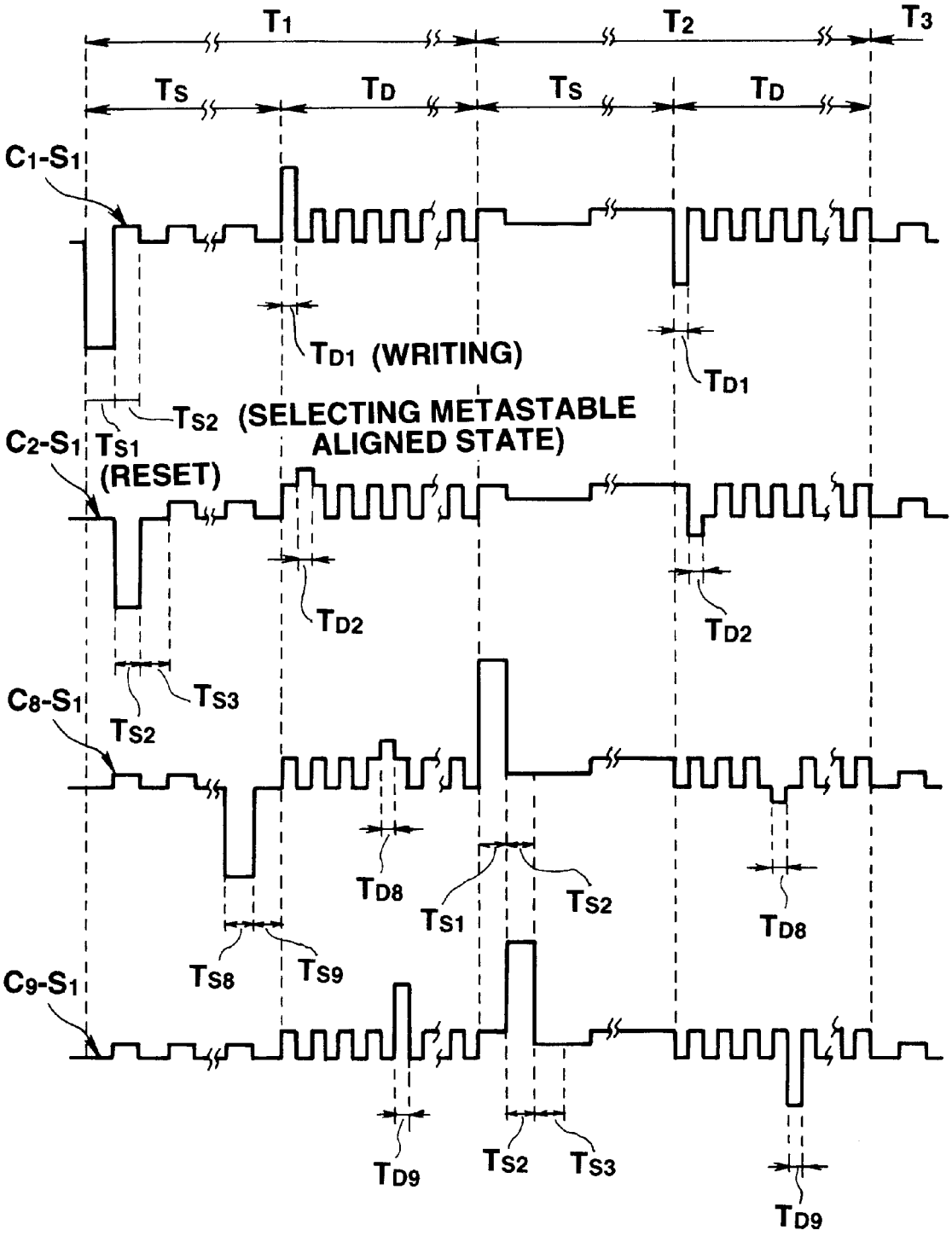
FIG. 22 is a timing chart showing waveform of voltage to be applied to the liquid crystal by the scanning signal and the data signal shown in FIG. 21.

FIG. 22 is a waveform chart for voltages which are applied between the first row, second row, eight row and ninth row of scan electrodes and the first column of signal electrodes when the scan signals $C_1$, $C_2$, $C_8$ and $C_9$ and the data signal $S_1$ have waveforms as depicted in FIG. 21. $C_1$-$S_1$ indicates a voltage to be applied between the first row of scan electrodes and the first column of signal electrodes, $C_2$-$S_1$ indicates a voltage to be applied between the second row of scan electrodes and the first column of signal electrodes, $C_8$-$S_1$ indicates a voltage to be applied between the eighth row of scan electrodes and the first column of signal electrodes, and $C_9$-$S_1$ indicates a voltage to be applied between the ninth row of scan electrodes and the first column of signal electrodes.

Referring to FIG. 22, how to drive each row of pixel sections of the liquid crystal cell 10 will be explained with reference to a case where the scan signal and data signal having waveforms as shown in FIG. 22 are supplied to the scan electrode and signal electrode for the pixel section in the first column in each row. In this example, rewriting of one screen of images in the first one cycle (first to ninth frames) starts from the first row of pixels.

First, rewriting of one screen of images in the first one cycle will be discussed. In the figure, in the first frame (hereinafter called first frame) $T_1$, a reset voltage equivalent to the difference between the reset voltage $V_R$ of the scan signal $C_1$ and the potential of the data signal $S_1$ is applied between the electrodes of the first row of pixel sections in the group of first to eighth pixel rows in the first sub period $T_{S1}$ of the reset/metastable-aligned-state selecting period $T_S$, so that the liquid crystal molecules of the pixel sections are aligned to stand substantially perpendicularly, resetting the previous written state.

Next, in the second sub period $T_{S2}$ of the reset/metastable-aligned-state selecting period $T_S$, a metastable-aligned-state selecting voltage equivalent to the difference between the reference potential $V_0$ of the scan signal $C_1$ and the potential of the data signal $S_1$ is applied between the electrodes of the aforementioned first row of pixel sections, so that the aligned state of the liquid crystal molecules of the pixel sections are selected to be the first or second metastable aligned state, and, at the same time, a reset voltage equivalent to the difference between the reset voltage $V_R$ of the scan signal $C_2$ and the potential of the data signal $S_1$ is applied between the electrodes of the second row of pixel sections, thus resetting the second row of pixel sections.

Then, in the third sub period $T_{S3}$ of the reset/metastable-aligned-state selecting period $T_S$, a metastable-aligned-state selecting voltage equivalent to the difference between the reference potential $V_0$ of the scan signal $C_2$ and the potential of the data signal $S_1$ is applied between the electrodes of the second row of pixel sections, so that the aligned state of the liquid crystal molecules of the second row of pixel sections are selected to be the first or second metastable aligned state, and, at the same time, the reset voltage is applied between the electrodes of the third row of pixel sections, thus resetting the third row of pixel sections.

Thereafter, the selection of the metastable aligned state of one row of pixel sections and resetting of the next row of pixel sections are likewise carried out sequentially in each sub period of the reset/metastable-aligned-state selecting period $T_S$, and the aligned state of the last row or the eighth row of pixel sections in one group is selected to be the first or second metastable aligned state.

The reset voltage $V_R$ of each of the scan signals $C_1$, $C_2$, . . . , and $C_8$ in the reset/metastable-aligned-state selecting period $T_S$ of the first frame $T_1$ is either positive (+) or negative (−) ($-V_R$ in FIG. 21) with respect to the reference potential $V_0$, and the waveform of the data signal $S_1$ in this period $T_S$ assumes the first metastable-aligned-state selecting voltage $V_{S1}$, or either $+V_{S2D}$ or $-V_{S2D}$ ($+V_{S2D}$ in FIG. 21) with respect to the voltage $V_{S1}$ in each of the sub periods $T_{S1}$, $T_{S2}$, . . . , and $T_{S9}$.

The absolute value of the reset voltage $V_R$ is set to a value which provides a potential difference enough to align the liquid crystal molecules substantially perpendicularly, with respect to any of $V_{S1}$, $+V_{S2D}$ and $-V_{S2D}$ of the data signal, so that the individual pixel sections can be reset surely.

The metastable-aligned-state selecting voltage (the difference between the reference potential $V_0$ of the scan signals ($C_1$, $C_2$, . . . , $C_8$) and the potential of the data signal $S_1$), which is to be applied to the individual pixel sections after resetting, is determined by the potential of the data signal $S_1$ which has been selected in write voltage the write data to be supplied to the column driver 42, and the liquid crystal molecules are aligned in either the first or second metastable aligned state in write voltage that metastable-aligned-state selecting voltage.

When the data signal $S_1$ has a waveform as shown in FIG. 21, the potential of the data signal in the second sub period $T_{S2}$ for selecting the metastable aligned state of the first row of pixel sections is the same potential $V_{S1}$ as the reference potential $V_0$ of the scan signal $C_1$, so that the metastable-aligned-state selecting voltage of nearly 0 V is applied to the liquid crystal 18 and the liquid crystal molecules of the first row of pixel sections assume the first metastable aligned state.

With the data signal $S_1$ having the waveform shown in FIG. 21, the potential of the data signal in the third sub period $T_{S3}$ for selecting the metastable aligned state of the second row of pixel sections is $+V_{S2D}$, so that the metastable-aligned-state selecting voltage having such a value as to align the liquid crystal molecules by an angle substantially equal to or close to the pre-tilt angle in the initial aligned state is applied to the liquid crystal layer. This aligns the liquid crystal molecules of the second row of pixel sections in the second metastable aligned state.

After the metastable aligned states of the first to eighth rows of pixel sections are selected in this manner, a write voltage equivalent to the difference between the write-period voltage $V_C$ of the scan signal $C_1$ and the potential of the data signal $S_1$ is applied between the electrodes of the first row of pixel sections to write data there in the first row write period $T_{D1}$ of the next write period $T_D$. Thereafter, the remaining rows of pixel sections are rewritten in the respective row write periods, such as the second row of pixel sections in the second row write period $T_{D2}$, the third row of pixel sections in the third row write period $T_{D3}$, and so forth to the sixty-fourth row of pixel sections in the sixty-fourth row write period $T_{D64}$.

The write-period voltage $V_C$ of each scan signal in the write period $T_D$ of the first frame $T_1$ is either positive (+) or negative (−) ($+V_C$ in FIG. 21) with respect to the reference potential $V_O$, and the waveform of the data signal $S_1$ in this period $T_D$ assumes either $+V_{S2D}$ or $-V_{S2D}$ selected in accordance with the write data in each row write period $T_{D1}$, $T_{D2}$, . . . , or $T_{D64}$.

When the write-period voltage $V_C$ of each scan signal is $+V_C$ and the potential of the data signal in the first row write period $T_{D1}$ is $-V_{S2D}$ as shown in FIG. 21, a write voltage equivalent to the potential difference between $+V_C$ and $-V_{S2D}$ is applied to the first row of pixel sections, causing the effective value of the drive voltage till the first row write period $T_{D1}$ of the next frame (hereinafter called second frame) $T_2$ to become a relatively high value. As a result, this row of pixel sections assumes the first written state in which the liquid crystal molecules are aligned in the state (the lower aligned state in FIG. 3) in the metastable aligned states shown in FIG. 3, which takes place when a high effective value voltage is applied.

With the data signal $S_1$ having the waveform in FIG. 21, the potential of the data signal in the second row write period $T_{D2}$ is $+V_{S2D}$, so that a write voltage equivalent to the potential difference between $+V_C$ and $+V_{S2D}$ is applied to the second row of pixel sections. Therefore, the effective value of the drive voltage till the second row write period $T_{D2}$ of the next second frame $T_2$ becomes a relatively small value. This causes the second row of pixel sections to assume the second written state in which the liquid crystal molecules are aligned in the state (the upper aligned state in FIG. 3) in the metastable aligned states shown in FIG. 3, which takes place when a low effective value voltage is applied.

This applies to the other rows of pixel sections, so that when the potential of the data signal in the write period $T_{D2}$ of each row is $-V_{S2D}$, that row of pixel sections assumes the first written state in which the liquid crystal molecules are aligned in the aligned state which takes place when the aforementioned high effective value voltage is applied, and when the potential of the data signal is $+V_{S2D}$, that row of pixel sections assumes the second written state in which the liquid crystal molecules are aligned in the aligned state which takes place when the aforementioned low effective value voltage is applied.

When writing of the last (sixty-fourth) row of pixel sections is completed and then comes the second frame T2, the individual rows of pixel sections in the pixel row group of eighth to fifteenth rows including the last pixel row in the previous pixel row group (first to eighth rows), which has undergone resetting and selection of the metastable aligned state in the first frame $T_1$, are sequentially reset and their aligned states are selected to be the first or second metastable aligned state, and the first to sixty-fourth rows of pixel sections are sequentially written in the later write period $T_D$.

In this second frame $T_2$, while the waveforms of each scan signal and data signal invert with respect to the waveforms in the first frame $T_1$, resetting of each row of pixel sections and the selection of the metastable aligned state thereof and the subsequent writing are implemented in the same way as done in the first frame $T_1$.

Specifically, the eighth row of pixel sections, for example, is reset in the first sub period $T_{S1}$ of the reset/metastable-aligned-state selecting period $T_S$ even in the second frame $T_2$ following the first frame $T_1$, the metastable aligned state is selected for the eighth row of pixel sections in the second sub period $T_{S2}$, and writing takes places in the eighth row write period $T_{D8}$ in the next write period $T_D$. As shown in FIG. 21, the first metastable aligned state is selected for the liquid crystal molecules of the eighth row of pixel sections in the second sub period $T_{S2}$ where the metastable aligned state for that row can be selected, and assume the second written state, in the metastable aligned states shown in FIG. 3, where a low effective value voltage is applied in the eighth row write period $T_{D8}$ for writing that row.

The ninth row of pixel sections is written only in the first frame $T_1$, undergoing no resetting and selection of the metastable aligned state, and is reset in the second sub period $T_{S2}$ of the reset/metastable-aligned-state selecting period $T_S$ in the second frame $T_2$, the metastable aligned state is selected for the ninth row of pixel sections in the third sub period $T_3$, and writing takes places in the ninth row write period $T_{D9}$ in the next write period $T_D$. As shown in FIG. 21, the first metastable aligned state is selected for the liquid crystal molecules of the ninth row of pixel sections in the third sub period $T_{S3}$ where the metastable aligned state for that row can be selected, and assume the first written state, in the metastable aligned states shown in FIG. 3, where a high effective value voltage is applied in the ninth row write period $T_{D9}$ for writing that row.

With regard to the eight row of pixel sections, the first row in the group of the eighth to fifteenth pixel rows which are to undergo resetting and selection of the metastable aligned state in the second frame $T_2$, resetting and selection of the metastable aligned state and writing are temporarily carried out in the first frame $T_1$, the written state in the first frame $T_1$ is reset and the metastable aligned state is selected again in the second frame $T_2$, after which writing is performed again to assume the written state according to the effective value of the drive voltage till the eight row write period $T_{D8}$ of the next, third frame $T_3$.

The write voltage to be applied to all the rows of pixel sections except the group of the eighth to fifteenth pixel rows, which are to undergo resetting and selection of the metastable aligned state in the second frame $T_2$, is a rewrite voltage for keeping the written states in the first frame $T_1$, and the rewrite voltage applied to those rows of pixel sections is the same as that applied in the first frame $T_1$.

Thereafter, resetting of one group of pixel rows and the selection of the metastable aligned state therefor and writing of all the pixel rows are likewise executed frame by frame, until resetting of a group of fifty-seventh to sixty-fourth pixel rows and the selection of the metastable aligned state therefor and writing of all the pixel rows are carried out in the ninth frame to rewrite one screen of images.

In the next one cycle (the tenth to eighteenth frames), resetting of one of groups of the sixty-fourth to seventh pixel rows, the seventh to fourteenth pixel rows, the fourteenth to twenty-first pixel rows, . . . , and the fifty-sixth to sixty-third pixel rows, and the selection of the metastable aligned state for that group, and writing of all the pixel rows are executed frame by frame to rewrite one screen of images.

In the subsequent cycle (the nineteenth to twenty-seventh frames), resetting of one of groups of the sixty-third to sixth pixel rows, the sixth to thirteenth pixel rows, the thirteenth to twentieth pixel rows, . . . , and the fifty-fifth to sixty-second pixel rows, and the selection of the metastable aligned state for that group, and writing of all the pixel rows are executed frame by frame to rewrite one screen of images.

In the yet next cycle (the twenty-eighth to thirty-sixth frames), resetting of one of groups of the sixty-second to fifth pixel rows, the fifth to twelfth pixel rows, the twelfth to nineteenth pixel rows, . . . , and the fifty-fourth to sixty-first pixel rows, and the selection of the metastable aligned state for that group, and writing of all the pixel rows are executed frame by frame to rewrite one screen of images.

In those cycles, what undergoes display rewriting in one of the nine frames is only the eight rows of pixel sections in the group which is subjected to resetting and the selection of the metastable aligned state and then to writing, and the rewrite voltage identical to the write voltage in the previous frame is applied to each of the other rows of pixel sections to maintain the written state until resetting and the selection of the metastable aligned state for that pixel row are performed next, as mentioned above.

Of the individual pixel rows, the pixel sections in any row which overlaps over two groups (e.g., the eighth, fifteenth, twenty-second, . . . , and fifty-seventh rows in the grouping of the first to eighth rows, the eighth to fifteenth rows, the fifteenth to twenty-second rows, . . . , and fifty-seventh to sixty-sixth rows) are subjected to resetting and the selection of the metastable aligned state twice in succession in the successive two frames and the written states assumed in a later frame are maintained until resetting and the selection of the metastable aligned state for that pixel row are performed next.

Although the selection of the metastable aligned state and writing on such an overlapping row of pixel sections in the first one of the aforementioned two succeeding frames are temporary actions until they are reset again in the next frame, it is desirable that the selection of the metastable aligned state and writing in the previous frame should be set identical to the previous metastable aligned state and written state or identical to the metastable aligned state and written state which are to be selected in the next frame.

The above-described method of driving the liquid crystal cell is accomplished by supplying the reference potential $V_O$, the reset voltage $V_R$ and the write-period voltage $V_C$ of the scan signal to the row driver 41 from the power source 43, supplying the first and second metastable-aligned-state selecting voltages $V_{S1}$ and $V_{S2}$ and the write voltages $V_{D1}$ and $V_{D2}$ ($V_{S1}$ and $+V_{S2D}$ and $-V_{S2D}$ to simplify the waveform of the data signal as shown in FIG. 21) to the column driver 42, supplying the scan signal with a waveform having the reference potential, the reset voltage and the write-period voltage, selected in accordance with the control data, to the individual scan electrodes of the liquid crystal cell 10 from the row driver 41, and supplying the data signal with a waveform having the metastable-aligned-state selecting voltage and the write voltage, selected in accordance with the write data, to the individual scan electrodes of the liquid crystal cell 10 from the column driver 42 to select the individual pixel rows of the liquid crystal cell 10 in a predetermined selection order, applying the reset voltage between the electrodes of each pixel row of pixel sections to reset the previous written state, applying the metastable-aligned-state selecting voltage immediately after resetting to align the liquid crystal molecules of the pixel sections in the first or second metastable aligned state, and then applying the write voltage between the electrodes after the passage of a predetermined period.

According to this driving method, it is possible to select the individual pixel rows of the liquid crystal cell 10 in a predetermined selection order to reset the previous written state, align the liquid crystal molecules of the pixel sections in the first or second metastable aligned state to be selected next, and thereafter control the aligned state of the liquid crystal molecules in the metastable aligned state to set in the next written state.

As all the pixel rows of the liquid crystal cell 10 are separated into groups of a plurality of rows, and resetting of the individual rows of pixel sections in one group and the selection of the metastable aligned state therefor and writing of all the rows of pixel sections are performed every frame according to the driving method of this embodiment, it is possible to increase the frame frequency to eliminate flickering of the screen as mentioned earlier.

In this case, since grouping of the pixel rows is executed in such a way as to alter the composition of the pixel rows in each group every cycle in which resetting and the selection of the metastable aligned state of every group of pixel rows and writing are carried out in this embodiment, it is possible to shift the boundary between a writing area corresponding to a group of pixel rows whose rewritten state is reset to select the next metastable aligned state and perform rewriting by application of the write voltage a non-writing area corresponding to a group of pixel rows which is not rewritten and keeps the previous written state, thereby making display irregularity, caused by the difference between the display states of those areas, unnoticeably small.

Although the pixel rows of the liquid crystal cell 10 are so grouped that one group consists of a predetermined number of adjoining pixel rows, such as the first to eighth rows, the eighth to fifteenth rows, the fifteenth to twenty-second rows, and so forth, grouping may be performed so that one group consists of a predetermined number of every other pixel rows or every some pixel rows.

Further, resetting and the selection of the metastable aligned state and the order of selecting pixel row groups to be newly written thereafter in each frame may be performed every other group or every some groups, and flickering of the screen can be suppressed more by selecting such a pixel row group and executing resetting and the selection of the metastable aligned state of the individual pixel rows in that group, and subsequent writing.

Furthermore, to simplify the structures of the column driver 42 and the power source 43 of the drive circuit 40, the data signal to be supplied to the individual signal electrodes of the liquid crystal cell 10 is designed to have a simple waveform whose potential varies in three ways, $V_{S1}$, $+V_{S2D}$ and $-V_{S2D}$, and $-V_{S2D}$ as shown in FIG. 21 in this driving method. As shown in FIG. 20, however, the power source 43 may supply the first and second metastable-aligned-state selecting voltages $V_{S1}$ and $V_{S2}$, and the write voltages $V_{D1}$ and $V_{D2}$, which are to be applied between the electrodes, to the column driver 42 which in turn may supply the data signal with a waveform having $V_{S1}$, $V_{S2}$, $V_{D1}$ or $V_{D2}$, selected in accordance with write data, to the individual scan electrodes of the liquid crystal cell 10.

This driving method may be applied to driving the first and fourth examples of the liquid crystal display device, in which case two effective values for selecting the first metastable aligned state to display an image differ from two effective values for selecting the second metastable aligned state to display an image so that the power source 43 should generate four types of write voltages and supply them to the row driver 41.

Second Embodiment

In the case where of driving the liquid crystal cell 10 in the frame inverting system, when the scan signal to be supplied to the individual scan electrodes of the liquid crystal cell 10 from the row driver 41 has a waveform as shown in FIG. 21 whose potential varies between the reset voltage $+V_R$ positive to the reference potential $V_O$ and the reset voltage $-V_R$ negative to the reference potential $V_O$, the potential amplitude of the signal generated by the row driver 41 becomes large which requires the use of an integrated circuit device (LSI) with a high breakdown voltage.

In view of the breakdown voltage of the integrated circuit device, an embodiment of a drive circuit which can be designed by an integrated circuit device of a low breakdown voltage will now be discussed.

Figure 23:
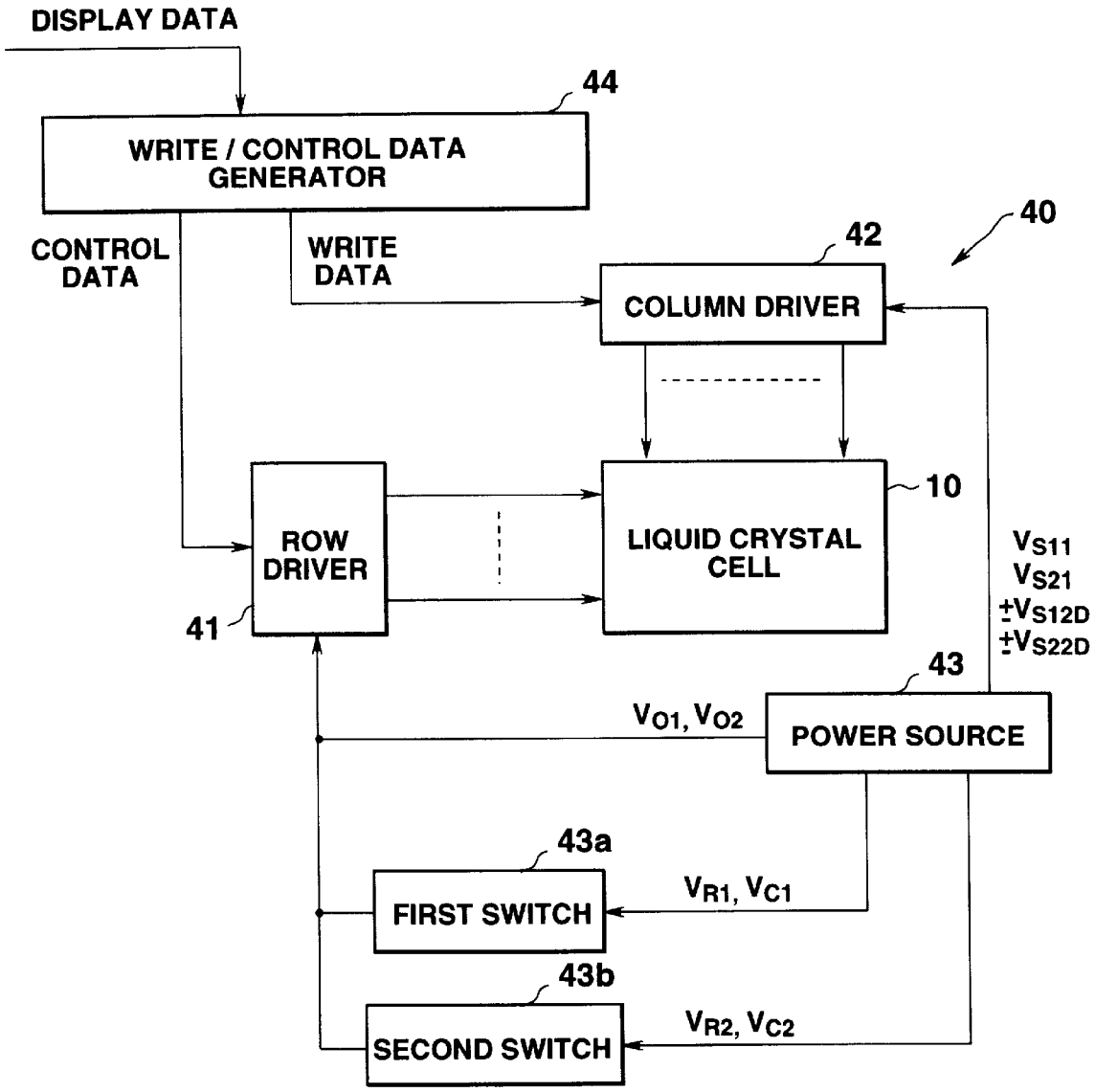
FIG. 23 is a block diagram of the driving circuit shown in FIG. 1 according to a second example.
Figure 24:
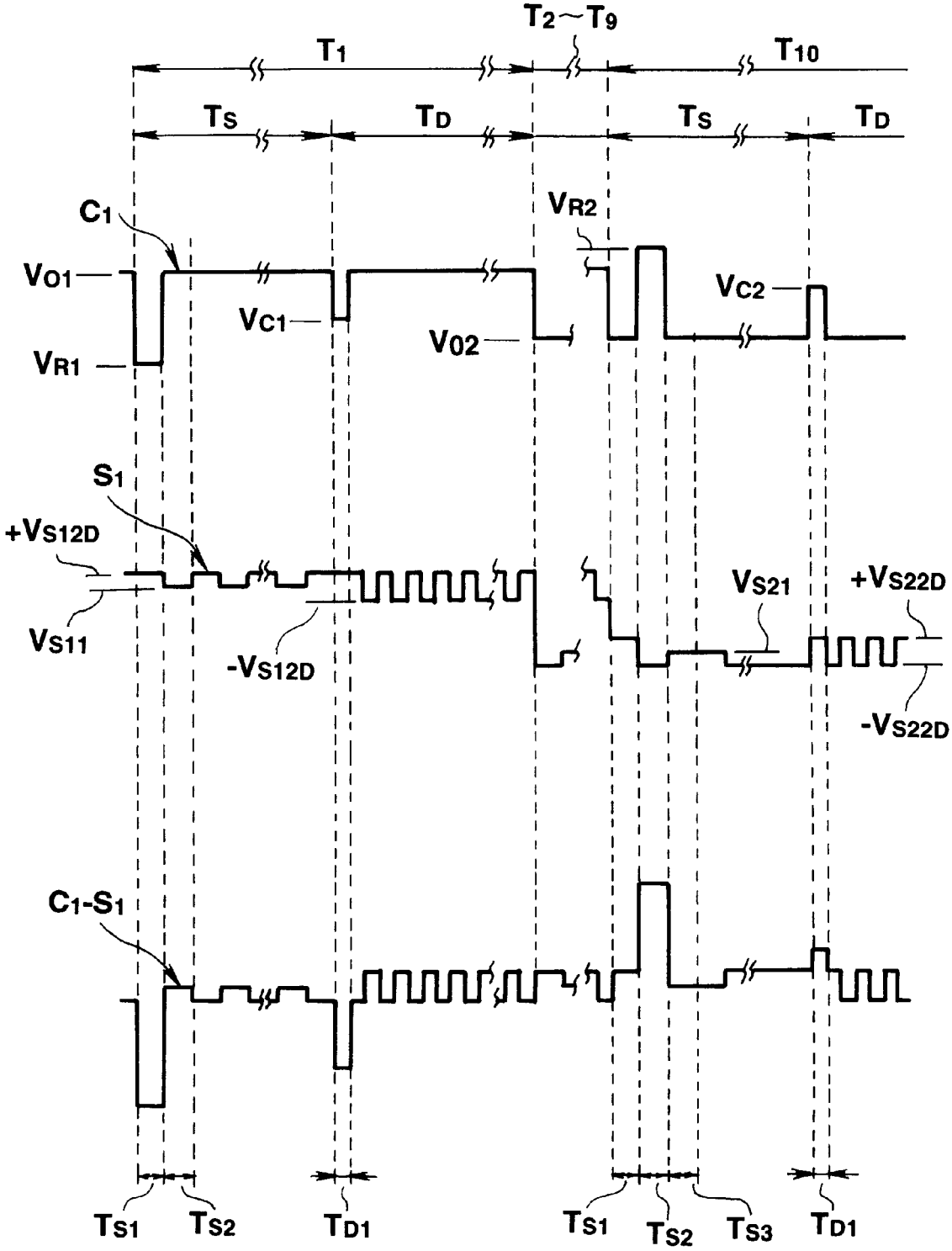
FIG. 24 is a timing chart showing waveforms of a scanning signal and a data signal for explaining a driving method for the liquid crystal display device of the present invention according to the second embodiment.

FIGS. 23 and 24 exemplify the driving of a liquid crystal cell in consideration of the breakdown voltage of the integrated circuit device. FIG. 23 is a structural diagram of the drive circuit 40, and FIG. 24 is a waveform chart of the scan signal, the data signal and voltages applied between electrodes.

This driving example is applied to driving the liquid crystal display device according to the second or third example in which two effective values for selecting the first metastable aligned state to display an image are identical to two effective values for selecting the second metastable aligned state to display an image.

To begin with, the drive circuit 40 shown in FIG. 23 will be discussed. In this embodiment, the potential outputting section from the power source 43 to the row driver 41 has three sections, so that the first output section supplies the voltage to the row driver 41 directly, the second output section supplies the voltage to the row driver 41 via a first switch 43*a* which is switched on in odd frames and is switched off in even frames and the third output section supplies the voltage to the row driver 41 via a second switch 43*b* which is switched on in even frames and is switched off in odd frames.

As this drive circuit 40 differs from the drive circuit shown in FIG. 20 in the potential outputting system from the power source 43 to the row driver 41 and the number and values of the voltages generated by the power source 43, but is identical to the latter drive circuit in the other structure, like or same reference numerals will be given to those components which are the same as the corresponding components of the drive circuit in FIG. 20.

The power source 43 generates first and second non-selecting voltages $V_{O1}$ and $V_{O2}$ different from each other in potentials, a reset voltage $V_{R1}$ and a write-period voltage $V_{C1}$ having low values with respect to the first non-selecting voltage $V_{O1}$ on the high-potential side, and a reset voltage $V_{R2}$ and a write-period voltage $V_{C2}$ having high values with respect to the second non-selecting voltage $V_{O2}$ on the low-potential side, and supplies the individual voltages to the row driver 41.

Of the individual voltages from the power source 43, the first and second non-selecting voltages $V_{O1}$ and $V_{O2}$ are supplied to the row driver 41 directly from the first output section, the reset voltage $V_{R1}$ and write-period voltage $V_{C1}$ with respect to the first non-selecting voltage $V_{O1}$ on the high-potential side are supplied via the first switch 43*a* to the row driver 41, and the reset voltage $V_{R2}$ and write-period voltage $V_{C2}$ with respect to the second non-selecting voltage $V_{O2}$ on the low-potential side are supplied via the second switch 43*b* to the row driver 41. Further, the power source 43 generates two voltages $V_{S11}$ and $V_{S21}$ having the same values as the first and second non-selecting voltages $V_{O1}$ and $V_{O2}$, two voltages $+V_{S12D}$ and $-V_{S12D}$, which are respectively positive and negative to the high-potential side voltage $V_{S11}$ and are equal to each other in the absolute value of the potential difference to the voltage $V_{S11}$, and two voltages $+V_{S21D}$ and $-V_{S22D}$, which are respectively positive and negative to the low-potential side voltage $V_{S21}$ and are equal to each other in the absolute value of the potential difference to the voltage $V_{S21}$, and supplies the individual voltages to the column driver 42.

Of those voltages, the two voltages $V_{S11}$ and $V_{S21}$ having the same values as the non-selecting voltages $V_{O1}$ and $V_{O2}$ are voltages for selecting the first metastable aligned state (hereinafter called the first metastable-aligned-state selecting voltages), and the other voltages $+V_{S12D}$, $-V_{S12D}$, $+V_{S21D}$ and $-V_{S22D}$ serve as both a voltage for selecting the second metastable aligned state and a write voltage (hereinafter called the second metastable-aligned-state selecting/write voltages). The potential difference between the second metastable-aligned-state selecting/write voltages $+V_{S12D}$ and $-V_{S12D}$ with respect to the high-potential side first metastable-aligned-state selecting voltage $V_{S11}$ is the same as the potential difference between the second metastable-aligned-state selecting/write voltages $+V_{S22D}$ and $-V_{S22D}$ with respect to the low-potential side first metastable-aligned-state selecting voltage $V_{S21}$.

In response to the clock signal and at a predetermined timing and in a predetermined period, the row driver 41 selects the high-potential side voltage $V_{O1}$ in the non-selecting voltages $V_{O1}$ and $V_{O2}$, directly supplied from the power source 43, and the reset voltage $V_{R1}$ and write-period voltage $V_{C1}$, supplied via the first switch 43*a*, to form a scan signal in an odd frame, selects the low-potential side voltage $V_{O2}$, and the reset voltage $V_{R2}$ and write-period voltage $V_{C2}$, supplied via the second switch 43*b*, to form a scan signal in an even frame, and supplies the scan signal whose waveform has the aforementioned reset voltages $V_{R1}$ and $V_{R2}$ suppressed in accordance with the control data from the write/control data generator 44, to the individual scan electrodes of the liquid crystal cell 10.

The column driver 42 selects the high-potential side first metastable-aligned-state selecting voltage $V_{S11}$ and the second metastable-aligned-state selecting/write voltages $+V_{S12D}$ and $-V_{S12D}$ in an odd frame and selects the low-potential side first metastable-aligned-state selecting voltage $V_{S21}$ and the second metastable-aligned-state selecting/write voltages $+V_{S22D}$ and $-V_{S22D}$ in an even frame in synchronism with the aforementioned scan signal, both in accordance with the write data from the write/control data generator 44, generates a data signal whose waveform shows the selected voltages, and supplies the data signal to the individual signal electrodes of the liquid crystal cell 10.

A description will now be given of the scan signal and data signal and the waveform of the voltages to be applied between the electrodes of the liquid crystal cell 10. FIG. 24 shows the waveforms of the scan signal $C_1$ to be supplied to the first row of scan electrodes, the data signal $S_1$ to be supplied to the first column of signal electrodes and the voltage $C_1$-$S_1$ to be applied between the first row of scan electrodes and the first column of signal electrodes.

Those waveforms are for the case where a total of 64 pixel rows of the liquid crystal cell are separated into groups of eight and the liquid crystal cell is driven while shifting the boundary between a writing area and a non-writing area every cycle (nine frames). In FIG. 24, $T_S$ indicates the reset/metastable-aligned-state selecting period in each frame $T_1$, $T_2$ or the like, $T_{S1}$, $T_{S2}$ and so forth indicate the individual sub periods of the reset/metastable-aligned-state selecting period, $T_D$ indicates the write period for all of the first to sixty-fourth pixel rows, and $T_{D1}$ indicates the first row write period $T_{D1}$ of the write period $T_D$.

A description on how to drive the liquid crystal cell 10 by this driving method will now be given on the driving of the pixel sections for which the first row of scan electrodes face the first column of signal electrodes (hereinafter referred to as the first row of pixel sections) with reference to the case where the scan signal and data signal having waveforms as shown in FIG. 24 are supplied to the scan electrodes and signal electrodes.

In this example, rewriting of one screen of images in the first one cycle (first to ninth frames) starts from the first row of pixel sections whose written state is reset and whose next metastable aligned state is selected in the first frame $T_1$ after which writing is conducted on that row.

Resetting of the first row of pixel sections and the selection of the metastable aligned state in the first frame $T_1$ are carried out in the first sub period $T_{S1}$ and the second sub period $T_{S2}$ of the reset/metastable-aligned-state selecting period $T_S$ of this frame $T_1$, and writing is performed in the first row write period $T_{D1}$ of the write period $T_D$.

The first row of pixel sections is not subjected to resetting and the selection of the metastable aligned state in the next, second frame $T_2$ to the ninth frame (the last frame in the first one cycle) $T_9$, a write voltage equivalent to the difference between the write-period voltage $V_{C2}$ or $V_{C1}$ of the scan signal $C_1$ and the potential of the data signal $S_1$ is applied to perform only rewriting in the first row write period $T_{D1}$ of the write period $T_D$ in each frame, and the rewritten state is reset and the next metastable aligned state is selected in the tenth frame $T_{10}$ of the next one cycle (the tenth to eighteenth frames) after which rewriting is carried out.

Resetting of the first row of pixel sections and the selection of the metastable aligned state in the tenth frame $T_{10}$ are carried out in the second sub period $T_{S2}$ and the third sub period $T_{S3}$ of the reset/metastable-aligned-state selecting period $T_{S3}$ of this frame $T_{10}$, and writing is performed in the first row write period $T_{D1}$ of the write period $T_D$.

In this driving example, the scan signal $C_1$ is so designed that its waveform alternately inverts every frame with the intermediate potential between the high-potential side non-selecting voltage $V_{O1}$ and the low-potential side non-selecting voltage $V_{O2}$ as a reference, and the data signal $S_1$ is so designed that its waveform alternately inverts every frame with the intermediate potential between the high-potential side first metastable-aligned-state selecting voltage $V_{S11}$ and the low-potential side first metastable-aligned-state selecting voltage $V_{S21}$ as a reference. Since the waveforms of the scan signal $C_1$ and the data signal $S_1$ go to the high-potential side at the same timing and go to the low-potential side at the same timing, the waveform of the voltage to be applied to the pixel sections has a waveform as shown in FIG. 24 and the pixel sections are rewritten in the same way as done by the driving method of the above-described first embodiment.

Specifically, in the first frame $T_1$, the first row of pixel sections is reset in the first sub period $T_{S1}$ of the reset/metastable-aligned-state selecting period $T_S$ by the application of a reset voltage equivalent to the difference between the reset voltage $V_{R1}$ of the scan signal $C_1$ and the potential of the data signal $S_1$ ($+V_{S12D}$ in FIG. 24) and is selected to be the first or second metastable aligned state (the first metastable aligned state when the potential of the data signal $S_1$ is $V_{S11}$ as shown in FIG. 24) in the next, second sub period $T_{S2}$ by the application of the metastable-aligned-state selecting voltage equivalent to the difference between the first non-selecting voltage $V_{O1}$ of the scan signal $C_1$ and the potential of the data signal $S_1$, after which that row of pixel sections is rewritten in the first row write period $T_{D1}$ of the write period $T_D$ by the application of a write voltage equivalent to the difference between the write-period voltage $V_{C1}$ of the scan signal $C_1$ and the potential of the data signal $S_1$ ($-V_{S12D}$ in FIG. 24).

In the tenth frame $T_{10}$, the first row of pixel sections is reset in the second sub period $T_{S2}$ of the reset/metastable-aligned-state selecting period $T_S$ by the application of a reset voltage equivalent to the difference between the reset voltage $V_{R2}$ of the scan signal $C_1$ and the potential of the data signal $S_1$ ($-V_{S22D}$ in FIG. 24) and is selected to be the first or second metastable aligned state (the first metastable aligned state when the potential of the data signal $S_1$ is $V_{S21}$ as shown in FIG. 24) in the subsequent, third sub period $T_{S3}$ by the application of the metastable-aligned-state selecting voltage equivalent to the difference between the low-potential side non-selecting voltage $V_{O2}$ of the scan signal $C_1$ and the potential of the data signal $S_1$, after which that row of pixel sections is rewritten in the first row write period $T_{D1}$ of the write period $T_D$ by the application of a write voltage equivalent to the difference between the write-period voltage $V_{C2}$ of the scan signal $C_1$ and the potential of the data signal $S_1$ ($+V_{S22D}$ in FIG. 24).

In this driving example, the scan signal to be supplied to the scan electrodes of the liquid crystal cell 10 from the row driver 41 is designed to have such a waveform that its non-selecting voltage alternately changes to the high-potential side voltage $V_{O1}$ and the low-potential side voltage $V_{O2}$ every frame, the reset voltage $V_{R1}$ and the write-period voltage $V_{C1}$ in the frame where the non-selecting voltage becomes the high-potential side voltage $V_{O1}$ has low values with respect to the high-potential side non-selecting voltage $V_{O1}$, and the reset voltage $V_{R2}$ and the write-period voltage $V_{C2}$ in the frame where the non-selecting voltage becomes the low-potential side voltage $V_{O2}$ has high values with respect to the low-potential side non-selecting voltage $V_{O2}$. Therefore, the amplitude of each voltage becomes smaller so that the voltage that is controlled by the integrated circuit device which constitutes the row driver 41 can be suppressed low.

Although the waveforms of the scan signal $C_1$ and the data signal $S_1$ go to the high-potential side in odd frames and go to the low-potential side in even frames in this example, the scan signal $C_1$ and the data signal $S_1$ may be designed to go to the high-potential side in even frames and go to the low-potential side in odd frames.

Third Embodiment

Although the reset voltages $+V_R$ and $-V_R$ are set to voltages high enough (about 30 V) to align the liquid crystal molecules substantially perpendicular to the major surface of the substrate in the first and second embodiments, the time for their application can be shortened by setting the absolute values of the reset voltages to sufficiently large values, for example.

The following will discuss an embodiment in which the absolute values of the reset voltages are set sufficiently large.

Figure 25:
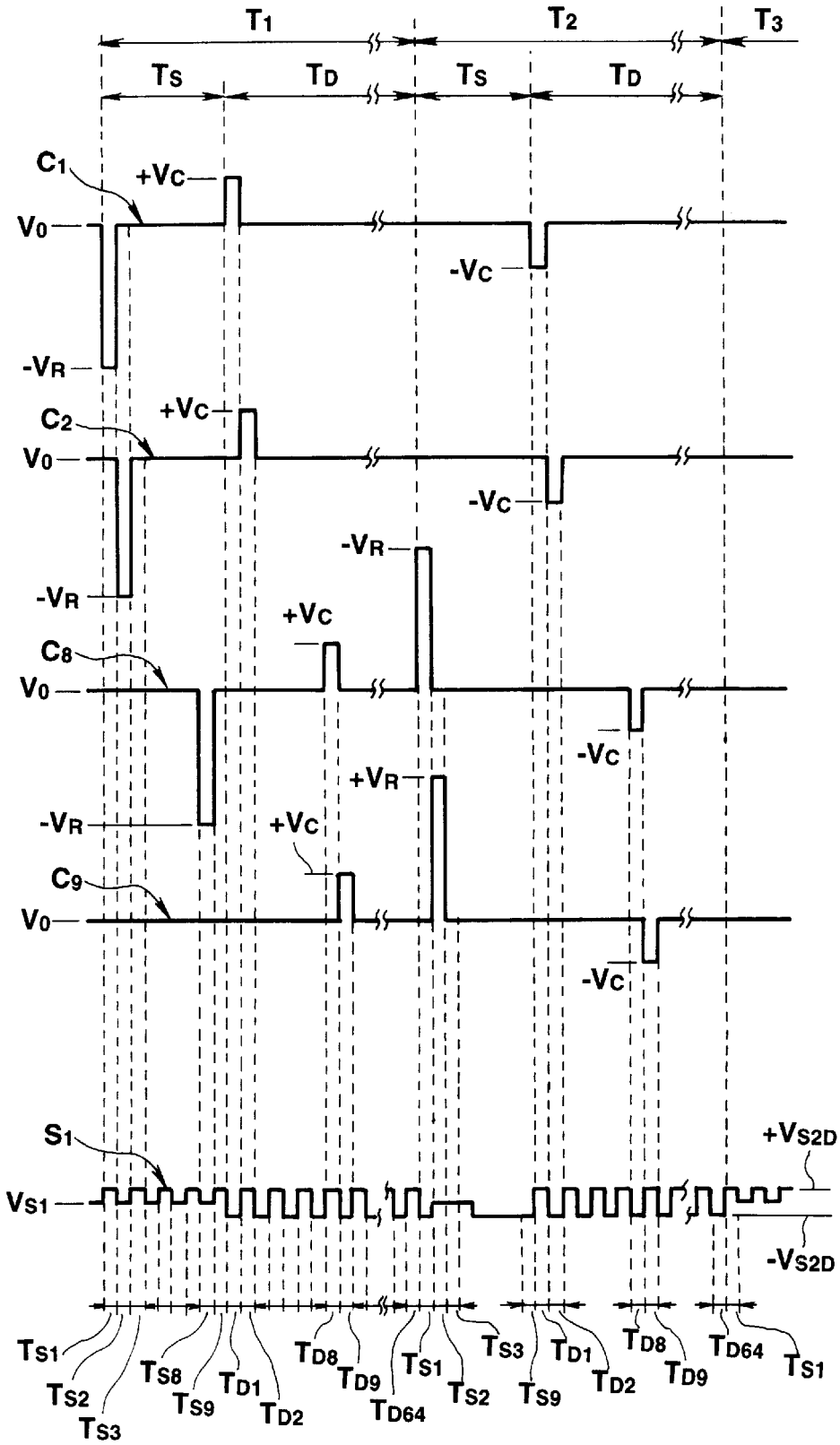
FIG. 25 is a timing chart showing waveform of voltage to be applied to the liquid crystal by the scanning signal and the data signal shown in FIG. 24.
Figure 26:
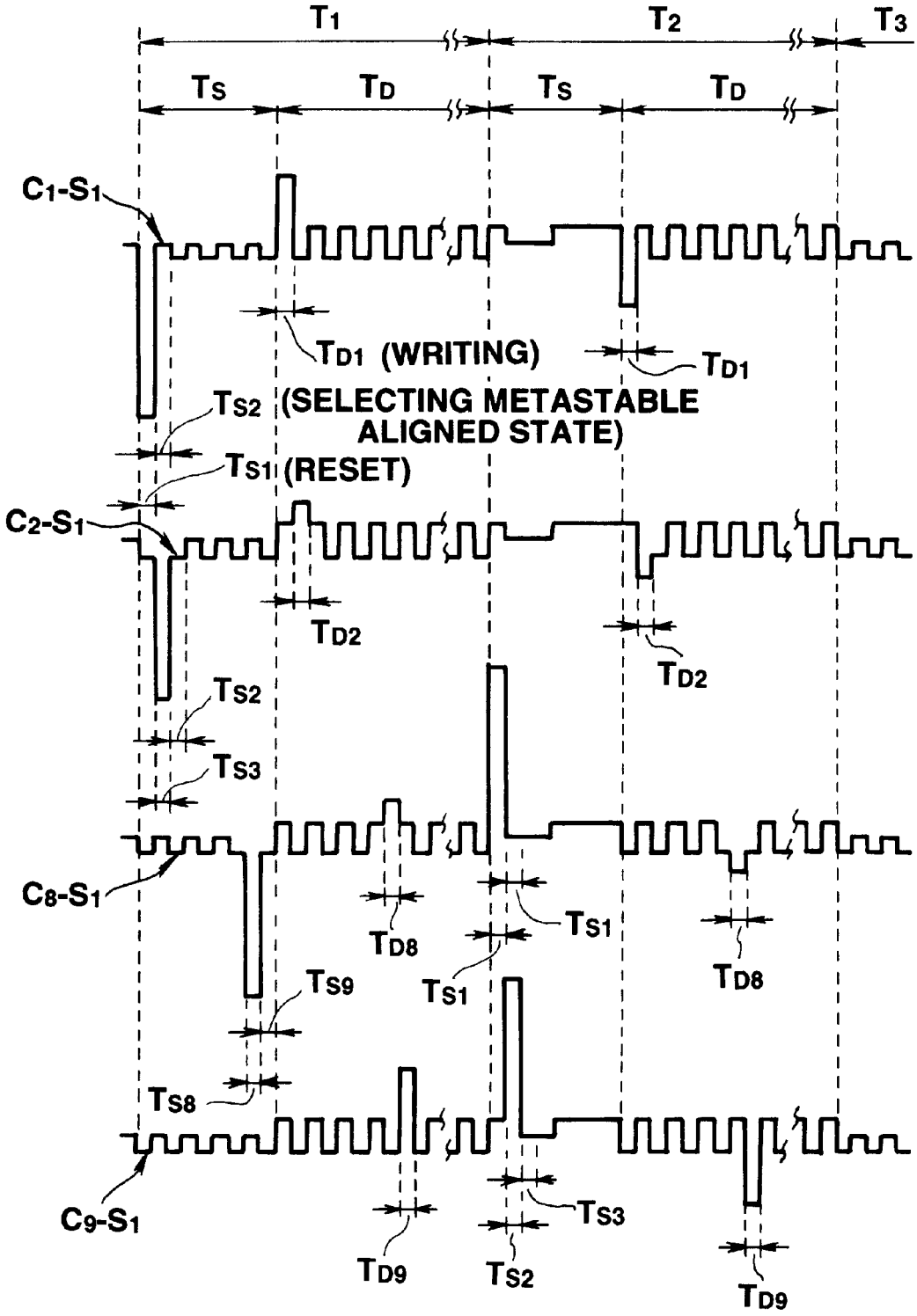
FIG. 26 is a timing chart showing waveforms of a scanning signal and a data signal for explaining a driving method for the liquid crystal display device of the present invention according to the third embodiment.

FIG. 25 is a waveform chart when the absolute values of the reset voltages of the scan signal shown in FIG. 21 are set large. FIG. 26 is a waveform chart of a voltages to be applied between the scan electrodes and the data electrodes (i.e., to the liquid crystal) when the liquid crystal display device is driven with the signals C1 to C9 and S1 having the waveforms shown in FIG. 25.

In this embodiment, for example, the reset voltage $V_R$ is set to 36 to 90 V with respect to the reference potential $V_O$, desirably in a range of 45 to 90 V, when the value of the voltage necessary to align the liquid crystal molecules substantially perpendicular to the major surface of the substrate is about 30 V.

It is desirable that the application period be greater than the time needed to align the liquid crystal molecules substantially perpendicular to the major surface of the substrate but as short as possible, and it is preferable that the application period be longer than the write period $T_{D1}$, $T_{D1}$ or the like for one pixel row in the write period $T_D$.

When the absolute value of the voltage, and its application period, necessary to align the liquid crystal molecules substantially perpendicularly are respectively about 30 V and 30 ms, for example, the absolute value of the reset voltage $V_R$ is set to 60 V and its application period is set to about 15 ms. In this case, the individual sub periods $T_{S1}$–$T_{S9}$ of the reset/metastable-aligned-state selecting period $T_S$ should each be set to about 15 ms as shown in FIG. 25. Thus, the reset/metastable-aligned-state selecting period $T_S$ is approximately 135 ms.

According to the driving method using the signals as shown in FIGS. 25 and 26, the reset voltage of a value sufficiently larger than the voltage value which is needed to align the liquid crystal molecules substantially perpendicularly is applied between the electrodes of the row of pixel sections in a very short period of time to reset the previous aligned state of the liquid crystal molecules. It is possible to make the period for resetting the individual pixel rows and selecting the metastable aligned state shorter, increasing the frame frequency, thus ensuring the driving of the liquid crystal cell in high-duty time division.

Figure 27:
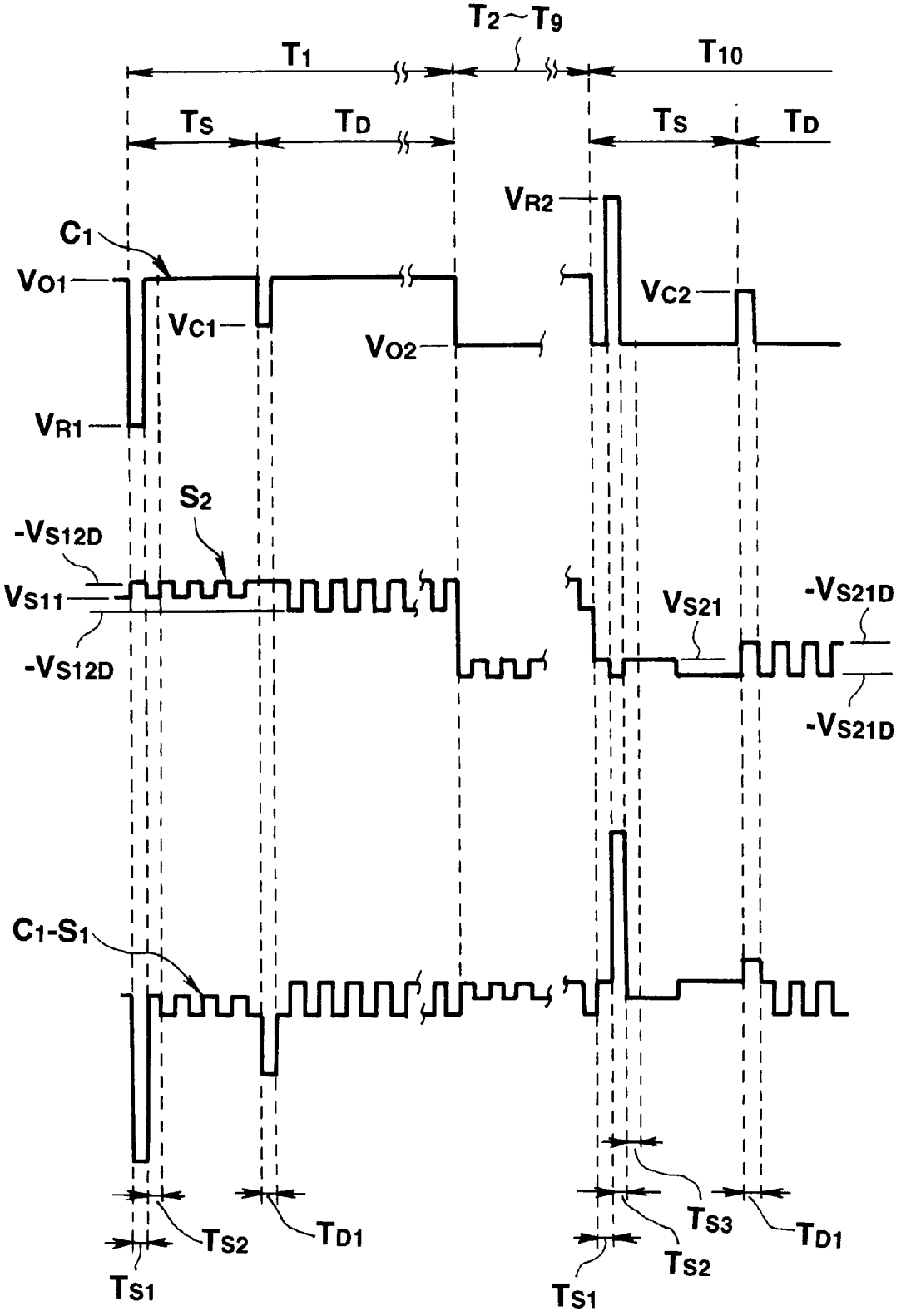
FIG. 27 is a timing chart showing waveform of voltage to be applied to the liquid crystal by the scanning signal and the data signal shown in FIG. 26.

The driving method according to the second embodiment as shown in FIG. 24 may be modified so that the absolute value of the reset voltage $V_R$ is increased to shorten the selecting period $T_S$, as shown in FIG. 27.

Fourth Embodiment

In the first to third embodiments, the first or second metastable aligned state is set by switching the voltage of the data signal. That is, the first metastable aligned state is set when the signal voltage to be applied immediately after the application of the reset voltage is $+V_{S1}$, and the second metastable aligned state is set when the signal voltage is $+V_{S2SD}$ or $-V_{S2SD}$. This requires that the power source should strictly manage the supply voltages and generate three kinds of voltages, complicating the circuit structure and increasing power dissipation.

A description will now be given of an embodiment which uses a data signal capable of easily and surely selecting the metastable aligned state with reference to FIGS. 28 and 29.

In this embodiment, the power source 43 generates the metastable-aligned-state selecting voltages $+V_{SD}$ and $-V_{SD}$ for applying an AC type second metastable-aligned-state selecting voltage between the electrodes of the liquid crystal cell 10 and write voltages $V_{D1}$ and $V_{D2}$ to be applied between the electrodes, and supplies those voltages to the column driver 42.

The voltages $+V_{SD}$ and $-V_{SD}$ serve to select the second metastable-aligned-state selecting voltage of a low frequency.

In this embodiment, the first metastable-aligned-state selecting voltage is a high-frequency voltage. The liquid crystal molecules show a dielectric anisotropy of substantially 0 or negative dielectric anisotropy with respect to a high-frequency voltage, and are apt to hold the aligned state when no voltage is applied or to be aligned parallel to the substrate surface, regardless of the voltage value. The first metastable-aligned-state selecting voltage can thus take an arbitrary value. In this embodiment, therefore, the voltages $+V_{SD}$ and $-V_{SD}$ for selecting the aforementioned low-frequency second metastable-aligned-state selecting voltage are also used as the high-frequency first metastable-aligned-state selecting voltage.

Each data signal to be applied to each signal electrode by the column driver 42 has an AC type pulse waveform (metastable-aligned-state selecting waveform) of a high frequency or a low frequency whose potential alternately changes to $+V_S$ and $-V_S$ in each metastable-aligned-state selecting period immediately after the reset period for each pixel row. The waveform inverts every frame with the center of the amplitude of the AC pulse waveform (an intermediate value between $+V_S$ and $-V_S$) as a reference.

The structures of the row driver and the scan signal are substantially the same as those of the row driver 41 and the scan signal of the first embodiment.

Figure 28:
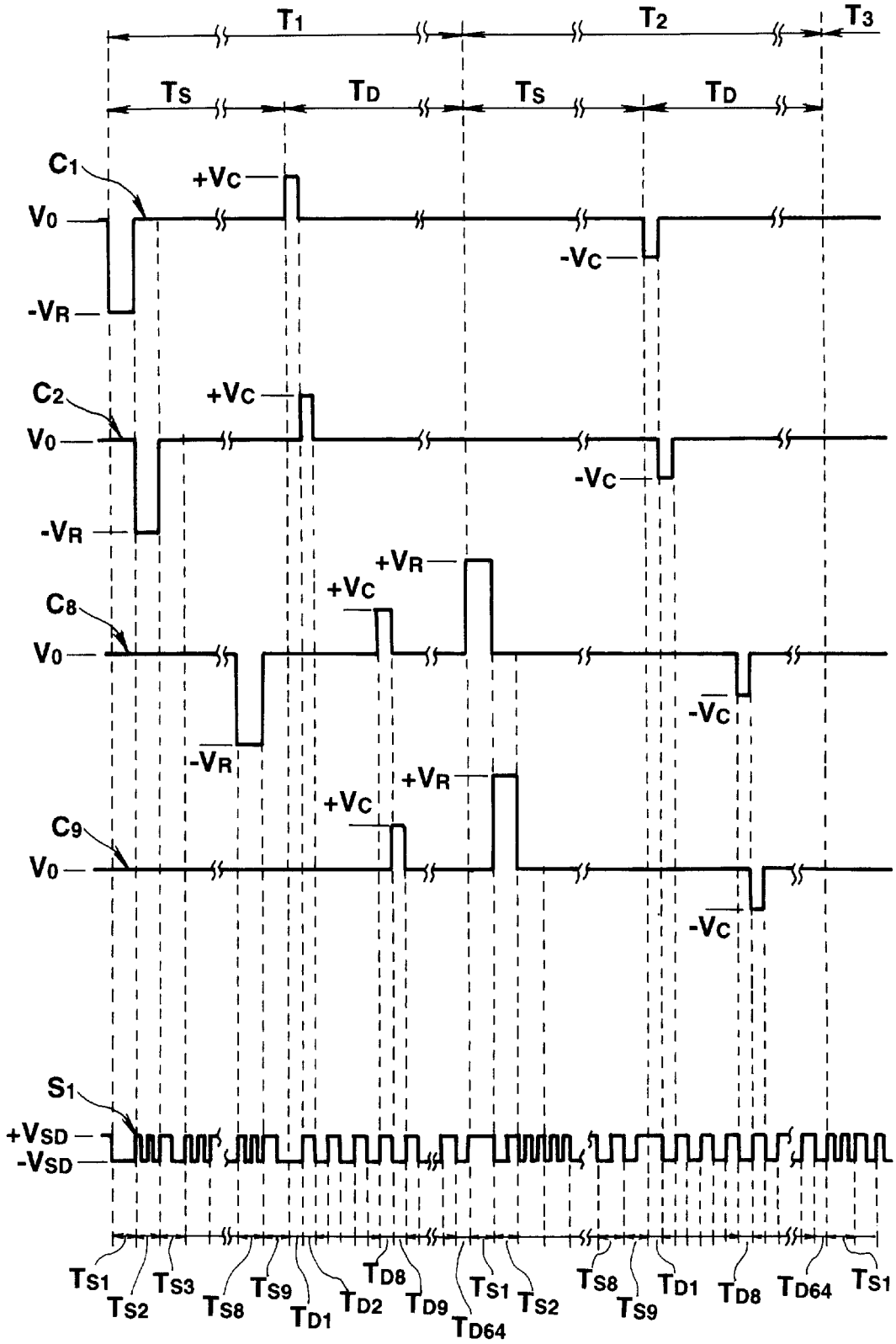
FIG. 28 is a timing chart showing waveforms of a scanning signal and a data signal for explaining a driving method for the liquid crystal display device of the present invention according to the fourth embodiment.
Figure 29:
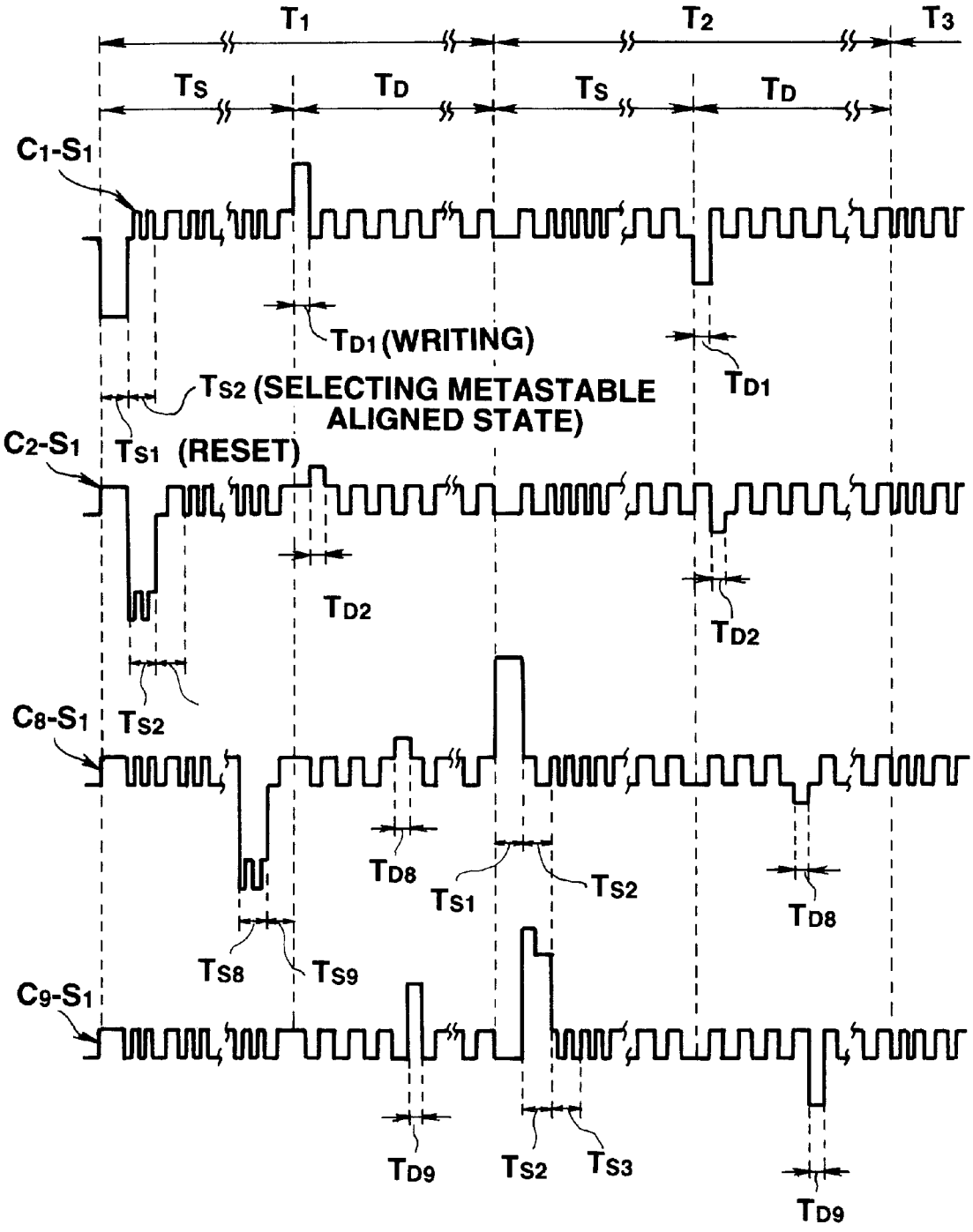
FIG. 29 is a timing chart showing waveform of voltage to be applied to the liquid crystal by the scanning signal and the data signal shown in FIG. 28.

FIG. 28 presents a waveform chart of a scan signal and a data signal in the case where the entire 64 pixel rows of the liquid crystal cell are separated into groups of eight and the liquid crystal cell is driven by a method of shifting the boundary between a writing area and a non-writing area is shifted by one pixel row every cycle. This figure shows waveforms of scan signals $C_1$, $C_2$, $C_8$ and $C_9$ which the row driver 41 respectively supplies to the first row of scan electrodes, the second row of scan electrodes, the eighth row of scan electrodes, and the ninth row of scan electrodes, and the waveform of a data signal $S_1$ which is supplied to the first column of signal electrodes by the column driver 42. FIG. 29 is a waveform chart of a voltages to be applied between the scan electrodes and the data electrodes when the liquid crystal display device is driven with the signals C1 to C9 and S1 having the waveforms shown in FIG. 28.

In this embodiment, as shown in FIG. 28, the initial periods for all the frames T1, T2 and so forth are set to a reset/metastable-aligned-state selecting period $T_S$ for one pixel row group, and the remaining periods are set to a write period $T_D$ for all of the first to sixty-fourth pixel rows.

In this embodiment as in the first embodiment, the reset/metastable-aligned-state selecting period $T_S$ is equally divided to first to ninth periods $T_{S1}$ to $T_{S9}$, and the n-th pixel row in one group of (eight) pixel rows is reset and selecting the metastable aligned state of the (n−1)-th pixel row is carried out in the n-th sub period $T_{S1}$.

Further, the write period $T_D$ is equally divided into 64 periods $T_{D1}$ to $T_{D64}$ in each of which writing of one pixel row is performed one after another. The write period $T_D$ is approximately 10 ms.

As in the first embodiment, the row driver 41 applies the reference potential $V_O$ to the individual scan electrodes in other periods than the reset period and the write period for the pixel rows on the scan electrodes, applies the reset voltage $+V_R$ or $-V_R$ in the reset period, and supplies the scan signals $C_1$ to $C_{64}$ having the write-period voltage $V_C$ in the write period. Further, the waveform of each scan signal inverts every frame with the reference potential $V_O$ as a reference.

The column driver 42 applies to the individual signal electrodes a high-frequency AC pulse voltage (first metastable-aligned-state selecting voltage) or a low-frequency AC pulse voltage (second metastable-aligned-state selecting voltage), which alternately changes to $+V_{SD}$ and $-V_{SD}$. Further, the column driver 42 inverts the waveform of the applied voltage every frame with the center of the amplitude of the AC pulse waveform (an intermediate value between $+V_{SD}$ and $-V_D$) or the first metastable-aligned-state selecting voltage $V_{S1}$ as a reference.

First, rewriting of one screen of images in the first one cycle will be discussed. In FIG. 28, in the first frame (hereinafter called first frame) $T_1$, a reset voltage equivalent to the difference between the reset voltage $V_R$ of the scan signal $C_1$ and the potential of the data signal $S_1$ is applied between the electrodes of the first row of pixel sections in the group of first to eighth pixel rows in the first sub period $T_{S1}$ of the reset/metastable-aligned-state selecting period $T_S$, so that the liquid crystal molecules of the pixel sections are aligned to stand substantially perpendicularly, resetting the previous written state.

Next, in the second sub period $T_{S2}$ of the reset/metastable-aligned-state selecting period $T_S$, a metastable-aligned-state selecting voltage whose amplitude is equivalent to the difference between the reference potential $V_O$ of the scan signal $C_1$ and the potential of the data signal $S_1$ is applied between the electrodes of the aforementioned first row of pixel sections, so that the aligned state of the liquid crystal molecules of the pixel sections is selected to be the first or second metastable aligned state. At the same time, a reset voltage equivalent to the difference between the reset voltage $V_R$ of the scan signal $C_2$ and the potential of the data signal $S_1$ is applied between the electrodes of the second row of pixel sections, thus resetting the second row of pixel sections. In FIG. 28, the data signal $S_1$ is a high-frequency signal in the period $T_{S2}$, and the voltage between the scan electrode $C_1$ and the signal electrode $S_1$ becomes a high-frequency AC signal as shown in FIG. 29. The liquid crystal molecules show a dielectric anisotropy of substantially 0 or negative dielectric anisotropy with respect to a high-frequency voltage, and tend to hold the aligned state when no voltage is applied or to be aligned parallel to the substrate surface, regardless of the voltage value. The first metastable aligned state is therefore selected.

Then, in the third sub period $T_{S3}$ of the reset/metastable-aligned-state selecting period $T_S$, a metastable-aligned-state selecting voltage whose amplitude is equivalent to the difference between the reference potential $V_O$ of the scan signal $C_2$ and the potential of the data signal $S_1$ is applied between the electrodes of the second row of pixel sections, so that the aligned state of the liquid crystal molecules of the second row of pixel sections is selected to be the first or second metastable aligned state. At the same time, the reset voltage equivalent to the difference between the reset voltage $V_R$ of the scan signal $C_3$ and the potential of the data signal $S_1$ is applied between the electrodes of the third row of pixel sections, thus resetting the third row of pixel sections. In FIG. 28, the data signal $S_1$ is a low-frequency signal in the period $T_{S3}$, and the voltage between the scan electrode $C_1$ and the signal electrode $S_1$ becomes a low-frequency AC signal as shown in FIG. 29. Force to make the liquid crystal molecules to stand upright by a predetermined tilt angle with respect to the substrate surface acts on the liquid crystal molecules due to the mutual effect of the low-frequency AC voltage. The second metastable aligned state is therefore selected.

Next, in the fourth sub period $T_{S4}$ of the reset/metastable-aligned-state selecting period $T_S$, a metastable-aligned-state selecting voltage whose amplitude is equivalent to the difference between the reference potential $V_O$ of the scan signal $C_3$ and the potential of the data signal $S_1$ is applied between the electrodes of the third row of pixel sections, so that the aligned state of the liquid crystal molecules of the pixel sections is selected to be the first or second metastable aligned state. At the same time, a reset voltage equivalent to the difference between the reset voltage $V_R$ of the scan signal $C_4$ and the potential of the data signal $S_1$ is applied between the electrodes of the fourth row of pixel sections, thus resetting the fourth row of pixel sections. In FIG. 28, the data signal $S_1$ is a high-frequency signal in the period $T_{S4}$, and the voltage between the scan electrode $C_1$ and the signal electrode $S_1$ becomes a high-frequency AC signal as shown in FIG. 29. Nor force acts on the liquid crystal molecules or force to align the liquid crystal molecules in parallel to the substrate surface. The first metastable aligned state is therefore selected.

Thereafter, the selection of the metastable aligned state of one row of pixel sections and resetting of the next row of pixel sections are likewise carried out sequentially in each sub period of the reset/metastable-aligned-state selecting period $T_S$, and the aligned state of the last row or the eighth row of pixel sections in one group is selected to be the first or second metastable aligned state.

The write-period voltage $V_C$ of each scan signal in the write period $T_D$ is either positive or negative to the reference potential $V_O$ ($+V_C$ in FIG. 28), and the waveform of the data signal $S_1$ in this period $T_D$ has a potential of either $+V_{SD}$ or $-V_{SD}$ selected in accordance with the write data for each of the individual row write periods $T_{D1}$, $T_{D2}$, . . . , and $T_{D64}$.

When the write-period voltage $V_C$ of each scan signal is $+V_C$ and the potential of the data signal in the first row write period $T_{D1}$ is $-V_{SD}$ as shown in, for example, FIG. 28, therefore, a write voltage equivalent to the potential difference between $+V_C$ and $-V_{SD}$ is applied to the first row of pixel sections, causing the effective value of the drive voltage till the first row write period $T_{D1}$ of the next frame (hereinafter called second frame) $T_2$ to become a relatively high value. As a result, this row of pixel sections assumes the first written state in which the liquid crystal molecules are aligned in the state (the lower aligned state in FIG. 3) in the metastable aligned states shown in FIG. 3, which takes place when a high effective value voltage is applied.

With the data signal $S_1$ having the waveform in FIG. 28, the potential of the data signal in the second row write period $T_{D2}$ is $+V_{SD}$, so that a write voltage equivalent to the potential difference between $+V_C$ and $+V_{SD}$ is applied to the second row of pixel sections. Therefore, the effective value of the drive voltage till the second row write period $T_{D2}$ of the next second frame $T_2$ becomes a relatively small value. This causes the second row of pixel sections to assume the second written state in which the liquid crystal molecules are aligned in the state (the upper aligned state in FIG. 3) in the metastable aligned states shown in FIG. 3, which takes place when a low effective value voltage is applied.

This applies to the other rows of pixel sections, so that when the potential of the data signal in the write period $T_{D2}$ of each row is $-V_{SD}$, that row of pixel sections assumes the first written state in which the liquid crystal molecules are aligned in the aligned state which takes place when the aforementioned high effective value voltage is applied, and when the potential of the data signal is $V_{SD}$, that row of pixel sections assumes the second written state in which the liquid crystal molecules are aligned in the aligned state which takes place when the aforementioned low effective value voltage is applied.

When writing of the last or sixty-fourth row of pixel sections is completed and then comes the second frame T2, the individual rows of pixel sections in the pixel row group of eighth to fifteenth rows including the last pixel row in the previous pixel row group (first to eighth rows), which has undergone resetting and selection of the metastable aligned state in the first frame $T_1$, are sequentially reset and their aligned states are selected to be the first or second metastable aligned state, and the first to sixty-fourth rows of pixel sections are sequentially written in the later write period $T_D$.

In this second frame $T_2$, while the waveforms of each scan signal and data signal invert with respect to the waveforms in the first frame $T_1$, resetting of each row of pixel sections and the selection of the metastable aligned state thereof and the subsequent writing are implemented in the same way as done in the first frame $T_1$.

Specifically, the eighth row of pixel sections, for example, is reset in the first sub period $T_{S1}$ of the reset/metastable-aligned-state selecting period $T_S$ even in the second frame $T_2$ following the first frame $T_1$, the metastable aligned state is selected for the eighth row of pixel sections in the second sub period $T_{S2}$, and writing takes places in the eighth row write period $T_{D8}$ in the next write period $T_D$. As shown in FIG. 28, the first metastable aligned state is selected for the liquid crystal molecules of the eighth row of pixel sections in the second sub period $T_{S2}$ where the metastable aligned state for that row can be selected, and assume the second written state, in the metastable aligned states shown in FIG. 3, where a low effective value voltage is applied in the eighth row write period $T_{D8}$ for writing that row.

The ninth row of pixel sections is written only in the first frame $T_1$, undergoing no resetting and selection of the metastable aligned state, and is reset in the second sub period $T_{S2}$ of the reset/metastable-aligned-state selecting period $T_S$ in the second frame $T_2$, the metastable aligned state is selected for the ninth row of pixel sections in the third sub period $T_{S3}$, and writing takes places in the ninth row write period $T_{D9}$ in the next write period $T_D$. As shown in FIG. 28, the first metastable aligned state is selected for the liquid crystal molecules of the ninth row of pixel sections in the third sub period $T_{S3}$ where the metastable aligned state for that row can be selected, and assume the first written state, in the metastable aligned states shown in FIG. 3, where a high effective value voltage is applied in the ninth row write period $T_{D9}$ for writing that row.

With regard to the eight row of pixel sections, the first row in the group of the eighth to fifteenth pixel rows which are to undergo resetting and selection of the metastable aligned state in the second frame $T_2$, resetting and selection of the metastable aligned state and writing are temporarily carried out in the first frame $T_1$, the written state in the first frame $T_1$ is reset and the metastable aligned state is selected again in the second frame $T_2$, after which writing is performed again to assume the written state according to the effective value of the drive voltage till the eight row write period $T_{D8}$ of the next, third frame $T_3$.

The write voltage to be applied to all the rows of pixel sections except the group of the eighth to fifteenth pixel rows, which are to undergo resetting and selection of the metastable aligned state in the second frame $T_2$, is a rewrite voltage for keeping the written states in the first frame $T_1$, and the rewrite voltage applied to those rows of pixel sections is the same as that applied in the first frame $T_1$.

Thereafter, resetting of one group of pixel rows and the selection of the metastable aligned state therefor and writing of all the pixel rows are likewise executed frame by frame, until resetting of a group of fifty-seventh to sixty-fourth pixel rows and the selection of the metastable aligned state therefor and writing of all the pixel rows are carried out in the ninth frame to rewrite one screen of images.

When the first or second metastable aligned state is selected by controlling the voltage value of the metastable-aligned-state selecting voltage, it is necessary to control the voltage value of the first and second metastable-aligned-state selecting voltages at a high precision in order to prevent erroneous selection.

According to this driving method, by contrast, the liquid crystal molecules do not substantially behave with respect to a high-frequency voltage which allows the liquid crystal molecules to show a dielectric anisotropy of substantially 0 or a negative dielectric anisotropy. Therefore, the metastable-aligned-state selecting voltage having a high-frequency waveform can take an arbitrary voltage value.

Since the second metastable aligned state is selected by a low-frequency AC voltage which allows the liquid crystal molecules to show a positive dielectric anisotropy, the frequencies of the first and second metastable-aligned-state selecting voltages should be set clearly. It is therefore possible to easily and surely select the first or second metastable aligned state.

Fifth Embodiment

Although the first metastable aligned state and the second metastable aligned state are switched from one to the other by modulating the frequency of the voltage to be applied to the liquid crystal in the fourth embodiment, the switching can still be accomplished by, for example, controlling the pulse width of the voltage to be applied to the liquid crystal. An embodiment which implements such switching will be discussed below referring to FIGS. 30 and 31.

In this embodiment, the power source 43 generates the metastable-aligned-state selecting voltages $V_{SO}$, $+V_{SD}$ and $-V_{SD}$ for applying an AC type second metastable-aligned-state selecting voltage between the electrodes of the liquid crystal cell 10 and write voltages $V_{D1}$ and $V_{D2}$ to be applied between the electrodes, and supplies those voltages to the column driver 42.

The voltage $V_{SO}$ is the reference potential of the data signal. It is desirable to set this reference potential $V_{SO}$ substantially equal to the reference potential $V_O$ of the scan signal. The voltages $+V_{SD}$ and $-V_{SD}$ have such values that their potential differences with respect to the reference potential $V_O$ cause the liquid crystal molecules to be aligned in the second metastable aligned state.

In this embodiment, the data signal having the first pulse waveform for selecting the first metastable aligned state becomes the metastable-aligned-state selecting voltage $V_{SD}$ or $-V_{SD}$ in a half of the sub period $T_S$ and becomes the reference potential $V_{SO}$ in the other period, while the data signal having the second pulse waveform for selecting the second metastable aligned state becomes the metastable-aligned-state selecting voltage $V_{SD}$ or $-V_{SD}$ over the entire sub period $T_S$.

The structures of the row driver and the scan signal are substantially the same as those of the row driver 41 and the scan signal of the first embodiment.

Figure 30:
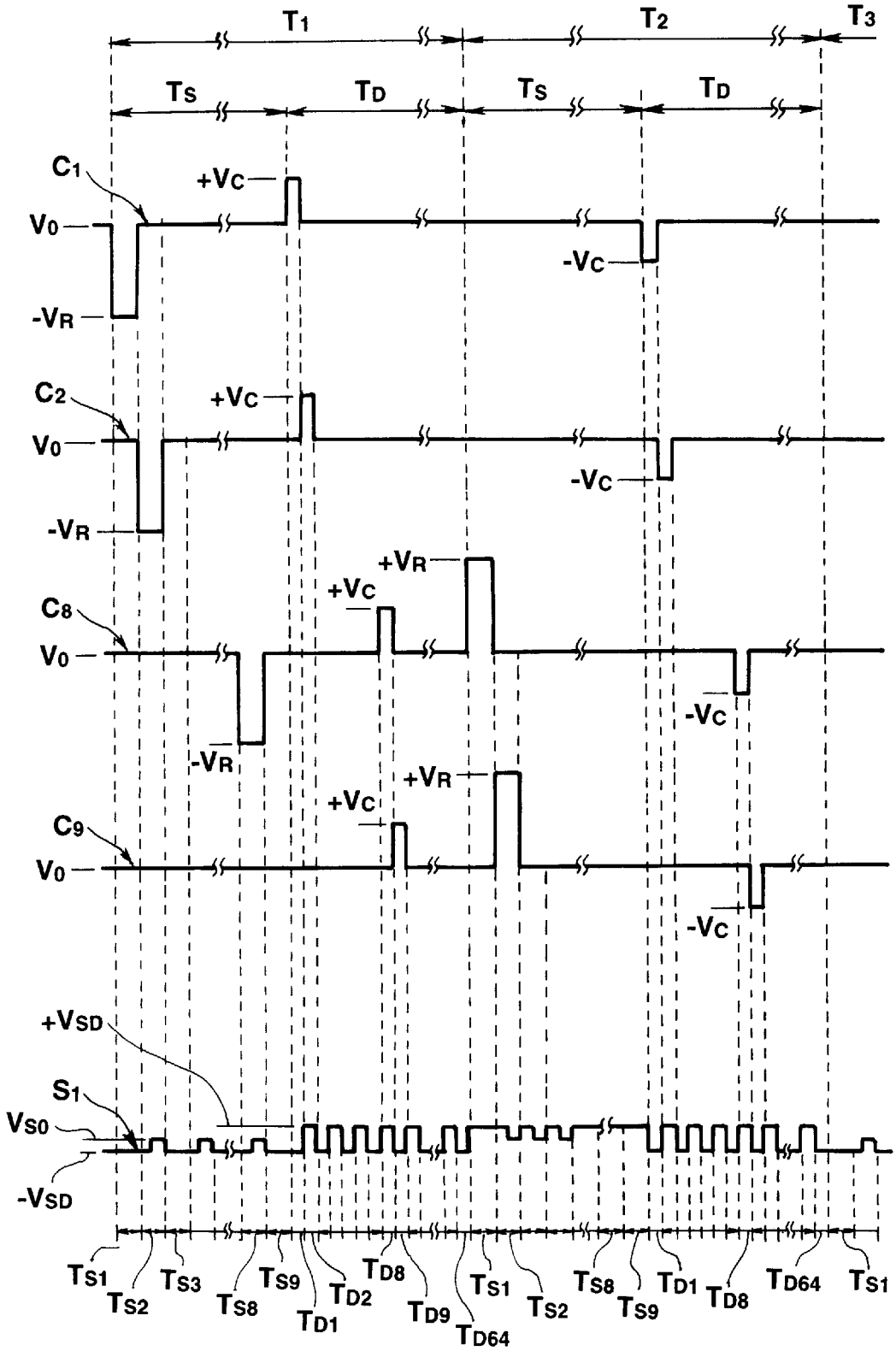
FIG. 30 is a timing chart showing waveforms of a scanning signal and a data signal for explaining a driving method for the liquid crystal display device of the present invention according to the fifth embodiment.

FIG. 30 presents a waveform chart of a scan signal and a data signal in the case where the entire 64 pixel rows of the liquid crystal cell are separated into groups of eight and the liquid crystal cell is driven by a method of shifting the boundary between a writing area and a non-writing area is shifted by one pixel row every cycle. This figure shows waveforms of scan signals $C_1$, $C_2$, $C_8$ and $C_9$ which the row driver 41 respectively supplies to the first row of scan electrodes, the second row of scan electrodes, the eighth row of scan electrodes, and the ninth row of scan electrodes, and the waveform of a data signal $S_1$ which is supplied to the first column of signal electrodes by the column driver 42.

Figure 31:
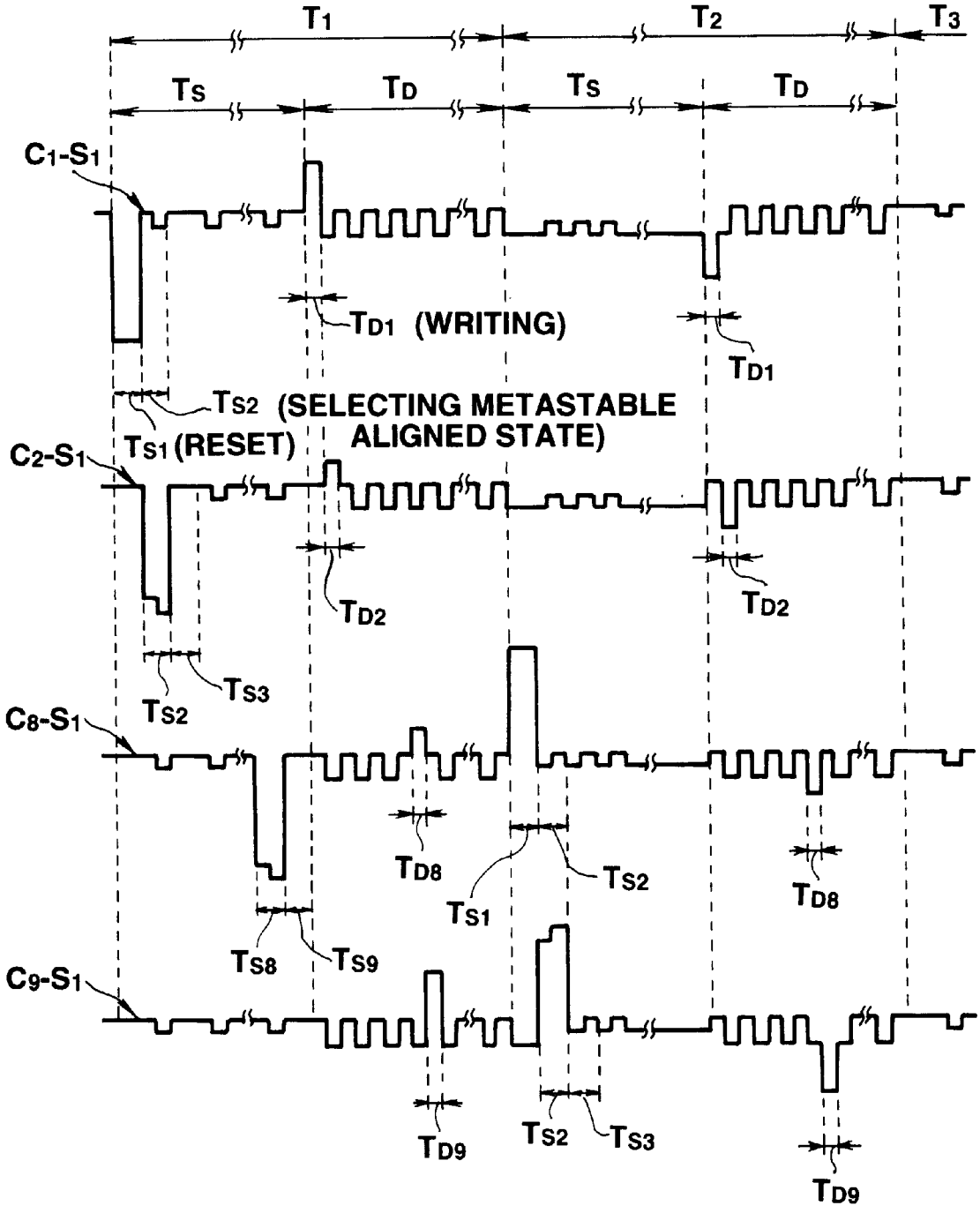
FIG. 31 is a timing chart showing waveform of voltage to be applied to the liquid crystal by the scanning signal and the data signal shown in FIG. 30.

FIG. 31 is a waveform chart of a voltages to be applied between the scan electrodes and the data electrodes when the liquid crystal display device is driven with the signals C1 to C9 and S1 having the waveforms shown in FIG. 30.

In this embodiment too, as shown in FIG. 30, the initial periods for all the frames T1, T2 and so forth are set to a reset/metastable-aligned-state selecting period $T_S$ for one pixel row group, and the remaining periods are set to a write period $T_D$ for all of the first to sixty-fourth pixel rows.

Further, the reset/metastable-aligned-state selecting period $T_S$ is equally divided to first to ninth periods $T_{S1}$ to $T_{S9}$, and the n-th pixel row in one group of (eight) pixel rows is reset and selecting the metastable aligned state of the (n−1)-th pixel row is carried out in the n-th sub period $T_{S1}$.

The write period $T_D$ is equally divided into 64 periods $T_{D1}$ to $T_{D64}$ in each of which writing of one pixel row is performed one after another. The write period $T_D$ is approximately 10 ms.

As in the first embodiment, the row driver 41 applies the reference potential $V_O$ to the individual scan electrodes in other periods than the reset period and the write period for the pixel rows on the scan electrodes, applies the reset voltage $+V_R$ or $-V_R$ in the reset period, and supplies the scan signals $C_1$ to $C_{64}$ having the write-period voltage $V_C$ in the write period. Further, the waveform of each scan signal inverts every frame with the reference potential $V_O$ as a reference.

The column driver 42 applies to the individual signal electrodes a voltage (first metastable-aligned-state selecting voltage), which becomes $V_{SO}$ only in a period of $T_S/2$, or a voltage (second metastable-aligned-state selecting voltage), which becomes $+V_{SD}$ and $-V_{SD}$ over the entire period $T_S$. Further, the column driver 42 inverts the waveform of the applied voltage every frame with the center of the amplitude of the AC pulse waveform (an intermediate value between $+V_{SD}$ and $-V_{SD}$) or the first metastable-aligned-state selecting voltage $V_{S1}$ as a reference.

First, rewriting of one screen of images in the first one cycle will be discussed. In FIG. 31, in the first frame (hereinafter called first frame) $T_1$, a reset voltage equivalent to the difference between the reset voltage $V_R$ of the scan signal $C_1$ and the potential of the data signal $S_1$ is applied between the electrodes of the first row of pixel sections in the group of first to eighth pixel rows in the first sub period $T_{S1}$ of the reset/metastable-aligned-state selecting period $T_S$, so that the liquid crystal molecules of the pixel sections are aligned to stand substantially perpendicularly, resetting the previous written state.

Next, in the second sub period $T_{S2}$ of the reset/metastable-aligned-state selecting period $T_S$, a metastable-aligned-state selecting voltage whose amplitude is equivalent to the difference between the reference potential $V_O$ of the scan signal $C_1$ and the potential of the data signal $S_1$ is applied between the electrodes of the aforementioned first row of pixel sections, so that the aligned state of the liquid crystal molecules of the pixel sections is selected to be the first or second metastable aligned state. At the same time, a reset voltage equivalent to the difference between the reset voltage $V_R$ of the scan signal $C_2$ and the potential of the data signal $S_1$ is applied between the electrodes of the second row of pixel sections, thus resetting the second row of pixel sections. In FIG. 30, the voltage of the data signal $S_1$ is $-V_{DS}$ in a half of the period $T_{S2}$ and is $V_{SO}$ in the remaining half period, and the voltage applied between the scan electrode $C_1$ and the signal electrode $S_1$ is a pulse having an amplitude of $V_{SD}$ and a width of $T_{S2}/2$ as shown in FIG. 31. The first metastable aligned state is therefore selected.

Then, in the third sub period $T_{S3}$ of the reset/metastable-aligned-state selecting period $T_S$, a metastable-aligned-state selecting voltage whose amplitude is equivalent to the difference between the reference potential $V_O$ of the scan signal $C_2$ and the potential of the data signal $S_1$ is applied between the electrodes of the second row of pixel sections, so that the aligned state of the liquid crystal molecules of the second row of pixel sections is selected to be the first or second metastable aligned state. At the same time, the reset voltage equivalent to the difference between the reset voltage $V_R$ of the scan signal $C_3$ and the potential of the data signal $S_1$ is applied between the electrodes of the third row of pixel sections, thus resetting the third row of pixel sections. In FIG. 30, the voltage of the data signal $S_1$ is $-V_{SD}$ in the period $T_{S3}$, and the voltage between the scan electrode $C_1$ and the signal electrode $S_1$ becomes substantially 0 as shown in FIG. 31. Accordingly, the first metastable aligned state is selected.

Next, in the fourth sub period $T_{S4}$ of the reset/metastable-aligned-state selecting period $T_S$, a metastable-aligned-state selecting voltage whose amplitude is equivalent to the difference between the reference potential $V_O$ of the scan signal $C_3$ and the potential of the data signal $S_1$ is applied between the electrodes of the third row of pixel sections, so that the aligned state of the liquid crystal molecules of the pixel sections is selected to be the first or second metastable aligned state. At the same time, a reset voltage equivalent to the difference between the reset voltage $V_R$ of the scan signal $C_4$ and the potential of the data signal $S_1$ is applied between the electrodes of the fourth row of pixel sections, thus resetting the fourth row of pixel sections. In FIG. 30, the data signal $S_1$ is a high-frequency signal in the period $T_{S4}$, and the voltage between the scan electrode $C_1$ and the signal electrode $S_1$ becomes a signal having a pulse width of one half the sub period as shown in FIG. 31. The second metastable aligned state is therefore selected.

Thereafter, the selection of the metastable aligned state of one row of pixel sections and resetting of the next row of pixel sections are likewise carried out sequentially in each sub period of the reset/metastable-aligned-state selecting period $T_S$, and the aligned state of the last row or the eighth row of pixel sections in one group is selected to be the first or second metastable aligned state.

The write-period voltage $V_C$ of each scan signal in the write period $T_D$ is either positive or negative to the reference potential $V_O$, and the waveform of the data signal $S_1$ in this period $T_D$ has a potential of either $+V_{SD}$ or $-V_{SD}$ selected in accordance with the write data for each of the individual row write periods $T_{D1}$, $T_{D2}$, . . . , and $T_{D64}$.

When the write-period voltage $V_C$ of each scan signal is $+V_C$ and the potential of the data signal in the first row write period $T_{D1}$ is $-V_{SD}$ as shown in, for example, FIG. 30, therefore, a write voltage equivalent to the potential difference between $+V_C$ and $-V_{SD}$ is applied to the first row of pixel sections, causing the effective value of the drive voltage till the first row write period $T_{D1}$ of the next frame (hereinafter called second frame) $T_2$ to become a relatively high value. As a result, this row of pixel sections assumes the first written state in which the liquid crystal molecules are aligned in the state (the lower aligned state in FIG. 3) in the metastable aligned states shown in FIG. 3, which takes place when a high effective value voltage is applied.

With the data signal $S_1$ having the waveform in FIG. 30, the potential of the data signal in the second row write period $T_{D2}$ is $+V_{SD}$, so that a write voltage equivalent to the potential difference between $+V_C$ and $+V_{SD}$ is applied to the second row of pixel sections. Therefore, the effective value of the drive voltage till the second row write period $T_{D2}$ of the next second frame $T_2$ becomes a relatively small value. This causes the second row of pixel sections to assume the second written state in which the liquid crystal molecules are aligned in the state (the upper aligned state in FIG. 3) in the metastable aligned states shown in FIG. 3, which takes place when a low effective value voltage is applied.

This applies to the other rows of pixel sections, so that when the potential of the data signal in the write period $T_{D2}$ of each row is $-V_{SD}$, that row of pixel sections assumes the first written state in which the liquid crystal molecules are aligned in the aligned state which takes place when the aforementioned high effective value voltage is applied, and when the potential of the data signal is $+V_{SD}$, that row of pixel sections assumes the second written state in which the liquid crystal molecules are aligned in the aligned state which takes place when the aforementioned low effective value voltage is applied.

When writing of the last or sixty-fourth row of pixel sections is completed and then comes the second frame T2, the individual rows of pixel sections in the pixel row group of eighth to fifteenth rows including the last pixel row in the previous pixel row group (first to eighth rows), which has undergone resetting and selection of the metastable aligned state in the first frame $T_1$, are sequentially reset and their aligned states are selected to be the first or second metastable aligned state, and the first to sixty-fourth rows of pixel sections are sequentially written in the later write period $T_D$.

In this second frame $T_2$, while the waveforms of each scan signal and data signal invert with respect to the waveforms in the first frame $T_1$, resetting of each row of pixel sections and the selection of the metastable aligned state thereof and the subsequent writing are implemented in the same way as done in the first frame $T_1$.

According to this driving method, as voltages having the same voltage value but different pulse widths are applied as the first and second metastable-aligned-state selecting voltages, it is unnecessary to strictly control the voltage value of the metastable-aligned-state selecting voltage, unlike in the case of selecting the first and second metastable aligned states by applying voltages with different absolute values. It is therefore possible to easily and surely select the metastable aligned state.

Sixth Embodiment

Figure 32:
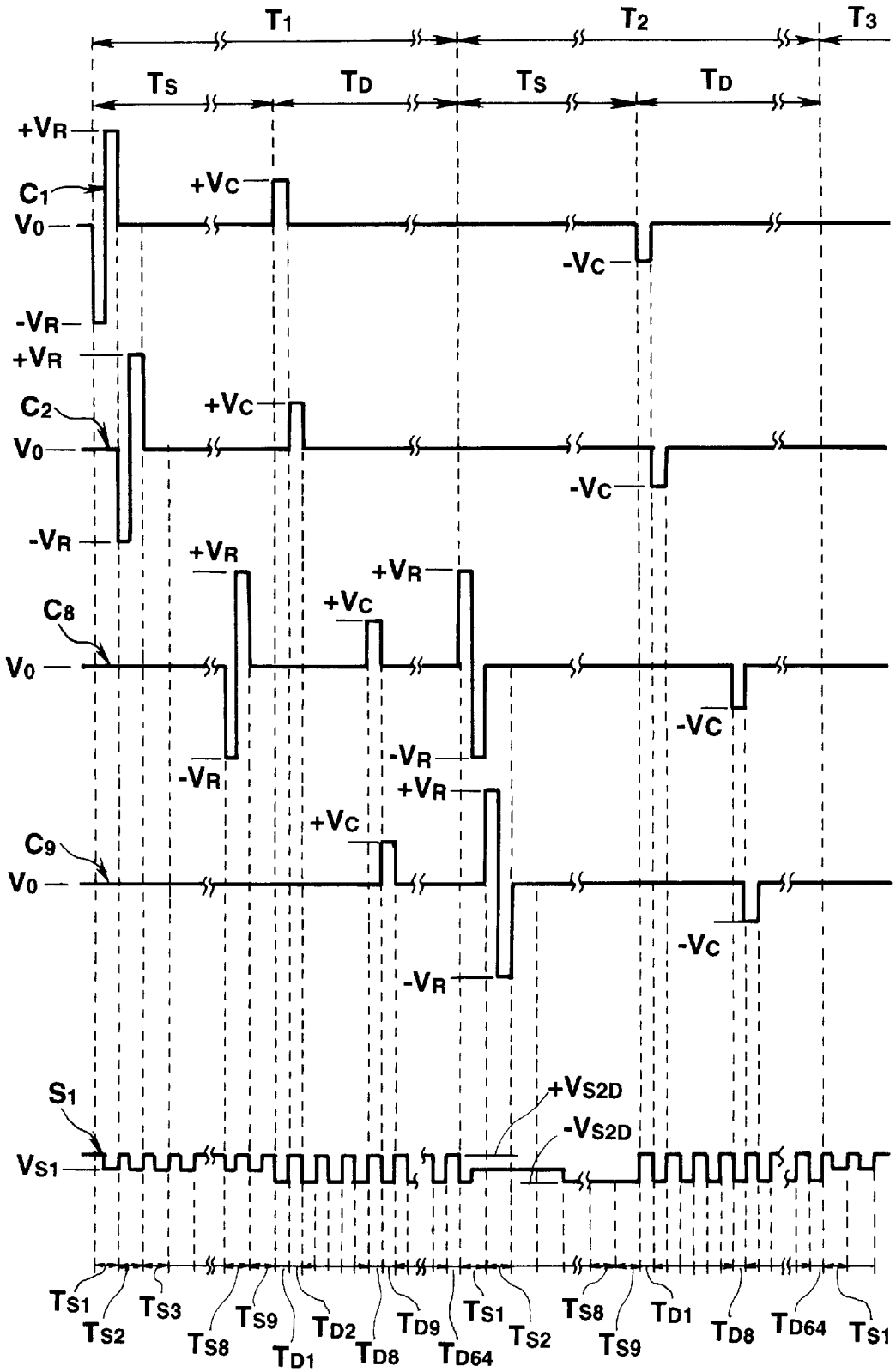
FIG. 32 is a timing chart showing waveforms of a scanning signal and a data signal for explaining a driving method for the liquid crystal display device of the present invention according to the sixth embodiment.

In the first to fifth embodiments, the reset voltage $V_R$ to be applied to the liquid crystal 18 in each reset/metastable-aligned-state selecting period $T_S$ has one polarity. As shown in FIG. 32, however, the reset voltage which is applied to the liquid crystal in the reset/metastable-aligned-state selecting period $T_S$ for each pixel row may be a pair of a reset voltage of a positive polarity and a reset voltage of a negative polarity. This driving method makes the DC component of the voltage to be applied to the liquid crystal 18 substantially 0 and can suppress display burning or the like.

The power source 43 supplies positive and negative reset voltages $+V_R$ and $-V_R$ to the row driver 41. In accordance with a clock from an unillustrated clock circuit, the row driver 41 selects the negative reset voltage $-V_R$ and applies it to the scan electrodes in the first half of each reset/metastable-aligned-state selecting period $T_S$, and selects the positive reset voltage $+V_R$ and applies it to the scan electrodes in the second half of each reset/metastable-aligned-state selecting period $T_S$.

The reset voltages $+V_R$ and $-V_R$ are identical in the absolute value to the reference potential $V_O$, and are sufficient to align the liquid crystal molecules substantially perpendicular to the substrate surface with respect to any of the potentials $V_{S1}$, $+V_{S2D}$ and $-V_{S2D}$ of the data signal.

This will be discussed below specifically. FIG. 32 presents a waveform chart of a scan signal and a data signal in the case where the entire 64 pixel rows of the liquid crystal cell 10 are separated into groups of eight and the liquid crystal cell is driven by a method of shifting the boundary between a writing area and a non-writing area is shifted by one pixel row every cycle. This figure shows waveforms of scan signals $C_1$, $C_2$, $C_8$ and $C_9$ which the row driver 41 respectively supplies to the first row of scan electrodes, the second row of scan electrodes, the eighth row of scan electrodes, and the ninth row of scan electrodes, and the waveform of a data signal $S_1$ which is supplied to the first column of signal electrodes by the column driver 42.

As shown in FIG. 32, the initial periods for all the frames T1, T2 and so forth are set to a reset/metastable-aligned-state selecting period $T_S$ for one pixel row group, and the remaining periods are set to a write period $T_D$ for all of the first to sixty-fourth pixel rows.

In this embodiment, the reset/metastable-aligned-state selecting period $T_S$ is equally divided to first to ninth periods $T_{S1}$ to $T_{S9}$, and the first pixel row in the first group of (eight) pixel rows is reset in the first sub period $T_{S1}$ while selecting the metastable aligned state of the first pixel row and resetting the second pixel row are carried out in the second sub period $T_{S2}$. Likewise, resetting the other pixel rows and selecting the metastable aligned states thereof are performed so that selecting the metastable aligned state of the seventh pixel row and resetting the eighth pixel row are carried out in the eighth sub period $T_{S8}$ and the metastable aligned state of the eighth pixel row is selected in the last, ninth sub period $T_{S9}$. For example, the reset/metastable-aligned-state selecting period $T_S$ is about 300 ms and each of the sub periods $T_{S1}$ to $T_{S9}$ is about 33 ms.

In this embodiment, the write period $T_D$ is equally divided into 64 periods $T_{D1}$ to $T_{D64}$ in each of which writing of one pixel row is performed one after another. In this case, the write period $T_D$ is about 10 ms, and each of the equally divided periods $T_{D1}$, $T_{D2}$, $T_{D3}$, . . . , $T_{D64}$ is about 0.16 ms.

The scan signal and the data signal will be discussed below. As mentioned earlier, each of the scan signals the row driver 41 supplies to the individual scan electrodes of the liquid crystal cell 10 has such a waveform that it is set to the reference potential $V_O$ in other periods than the reset period and the write period for the pixel row associated with the scan electrode to which that scan signal is supplied, the reset voltages $+V_R$ and $-V_R$ (e.g., a voltage having a potential difference of about 30 V with respect to the reference potential $V_O$) is supplied in the reset period, the write-period voltage $V_C$ (e.g., a voltage having a potential difference of about 6.5 V with respect to the reference potential $V_O$) is supplied in the write period. The waveform inverts every frame with respect to the reference potential $V_O$.

The reset voltages $+V_R$ and $-V_R$ are supplied to the individual scan electrodes once in nine frames (one cycle) excluding the first pixel row in each group in the case where the last pixel row in each group overlaps the first pixel row in the next group, and the reset voltage $V_R$ is supplied to the last pixel row in each group once in each of the last reset period of one frame and the first reset period of the next frame.

The write-period voltage $V_C$ is supplied to the individual scan electrodes once every frame, and the period in which the reset voltage $V_R$ is supplied is shifted by one set period every nine frames while the period in which the write-period voltage $V_C$ is supplied is the same in any frame (the period for selecting the pixel row associated with the scan electrode to which that scan signal is supplied).

Any of the individual data signals to be applied to the signal electrodes of the liquid crystal cell 10 basically has such a waveform that the first or second metastable-aligned-state selecting voltage $V_{S1}$ or $V_{S2}$ (e.g., a voltage having a potential difference of about 0.5 V with respect to the first metastable-aligned-state selecting voltage $V_{S1}$) is supplied in every metastable-aligned-state selecting period immediately after the reset period for all the pixel rows, and two write voltages $V_{D1}$ and $V_{D2}$ are selectively supplied in every write period for each pixel row in accordance with display data. The waveform inverts frame by frame with respect to the first metastable-aligned-state selecting voltage $V_{S1}$.

To further simplify the structures of the column driver 42 and the power source 43 of the drive circuit 40, in this embodiment, each data signal is so designed as to have a simple waveform such that the potential of the data signal $S_1$ varies in three ways, $V_{S1}$, $+V_{S2D}$ and $-V_{S2D}$, by setting the first metastable-aligned-state selecting voltage $V_{S1}$, among those voltages $V_{S1}$, $+V_{S2D}$ and $-V_{S2D}$, substantially identical to the reference potential $V_O$ as shown in FIG. 32.

The voltages $+V_{S2D}$ and $-V_{S2D}$ have the same absolute values, and their potential differences with respect to the reference potential $V_O$ of the scan signal become equal to the second metastable-aligned-state selecting voltage (the voltage of a low value by which the liquid crystal molecules are tilted by an angle equal to or close to the pre-tilt angle in the initial aligned state).

In this embodiment, the absolute values of the write-period voltages $V_C$ ($+V_C$ and $-V_C$) of the scan signal are so set that their potential differences with respect to $+V_{S2D}$ and $-V_{S2D}$ of the data signal can provide different effective values of the drive voltage in the first and second metastable aligned states.

Figure 33:
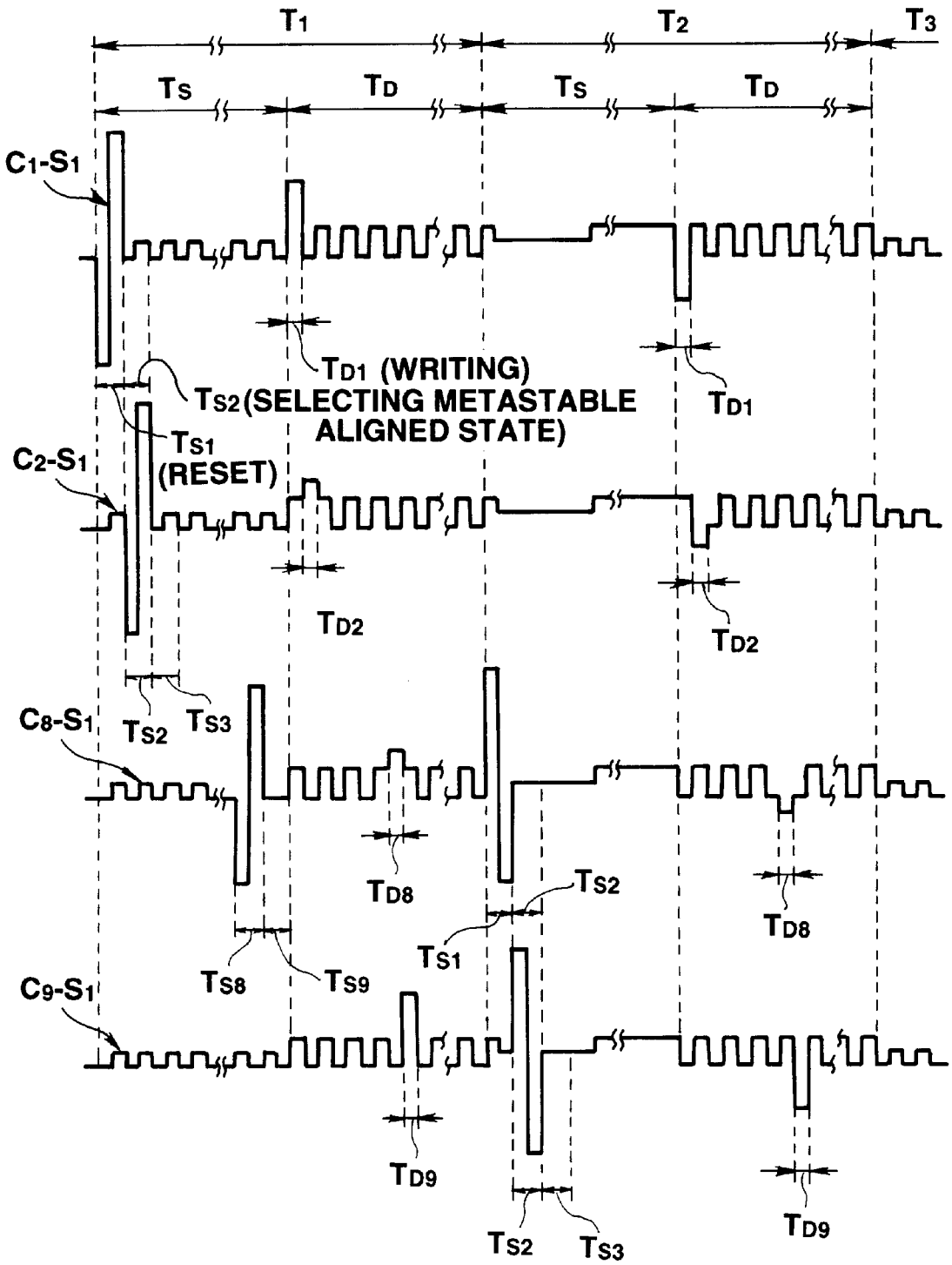
FIG. 33 is a timing chart showing waveform of voltage to be applied to the liquid crystal by the scanning signal and the data signal shown in FIG. 32.

FIG. 33 is a waveform chart for voltages which are applied between the first row, second row, eighth row and ninth row of scan electrodes and the first column of signal electrodes when the scan signals $C_1$, $C_2$, $C_8$ and $C_9$ and the data signal $S_1$ have waveforms as depicted in FIG. 32. $C_1$-$S_1$ indicates a voltage to be applied between the first row of scan electrodes and the signal electrodes, $C_2$-$S_1$ indicates a voltage to be applied between the second row of scan electrodes and the signal electrodes, $C_8$-$S_1$ indicates a voltage to be applied between the eighth row of scan electrodes and the signal electrodes, and $C_9$-$S_1$ indicates a voltage to be applied between the ninth row of scan electrodes and the signal electrodes.

Referring to FIG. 33, how to drive each row of pixel sections of the liquid crystal cell 10 will be explained with reference to a case where the scan signal and data signal having waveforms as shown in FIG. 32 are supplied to the scan electrode and signal electrode for the pixel section in the first column in each row. In this example, rewriting of one screen of images in the first one cycle (first to ninth frames) starts from the first row of pixels.

First, rewriting of one screen of images in the first one cycle will be discussed. In the figure, in the first frame (hereinafter called first frame) $T_1$, a reset voltage equivalent to the difference between the reset voltage $-V_R$ or $+V_R$ of the scan signal $C_1$ and the potential of the data signal $S_1$ is applied between the electrodes of the first row of pixel sections in the group of first to eighth pixel rows in the first sub period $T_{S1}$ of the reset/metastable-aligned-state selecting period $T_S$, so that the liquid crystal molecules of the pixel sections are aligned to stand substantially perpendicularly, resetting the previous written state.

Next, in the second sub period $T_{S2}$ of the reset/metastable-aligned-state selecting period $T_S$, a metastable-aligned-state selecting voltage equivalent to the difference between the reference potential $V_O$ of the scan signal $C_1$ and the potential of the data signal $S_1$ is applied between the electrodes of the aforementioned first row of pixel sections, so that the aligned state of the liquid crystal molecules of the pixel sections are selected to be the first or second metastable aligned state, and, at the same time, a reset voltage equivalent to the difference between the reset voltage $-V_R$ or $+V_R$ of the scan signal $C_2$ and the potential of the data signal $S_1$ is applied between the electrodes of the second row of pixel sections, thus resetting the second row of pixel sections.

Then, in the third sub period $T_{S3}$ of the reset/metastable-aligned-state selecting period $T_S$, a metastable-aligned-state selecting voltage equivalent to the difference between the reference potential $V_O$ of the scan signal $C_2$ and the potential of the data signal $S_1$ is applied between the electrodes of the second row of pixel sections, so that the aligned state of the liquid crystal molecules of the second row of pixel sections are selected to be the first or second metastable aligned state, and, at the same time, the reset voltage is applied between the electrodes of the third row of pixel sections, thus resetting the third row of pixel sections.

Thereafter, the selection of the metastable aligned state of one row of pixel sections and resetting of the next row of pixel sections are likewise carried out sequentially in each sub period of the reset/metastable-aligned-state selecting period $T_S$, and the aligned state of the last row or the eighth row of pixel sections in one group is selected to be the first or second metastable aligned state.

The waveform of the data signal $S_1$ in the reset/metastable-aligned-state selecting period $T_S$ in the first frame $T_1$ assumes the first metastable-aligned-state selecting voltage $V_{S1}$, or either $+V_{S2D}$ or $-V_{S2D}$ ($+V_{S2D}$ in FIG. 32) with respect to the voltage $V_{S1}$ in each of the sub periods $T_{S1}$, $T_{S2}$, . . . , and $T_{S9}$.

In this embodiment, as mentioned above, the absolute values of the reset voltages $+V_R$ and $-V_R$ are so set as to provide a potential difference enough to align the liquid crystal molecules substantially perpendicularly, with respect to any of $V_1$, $+V_{S2D}$ and $-V_{S2D}$ of the data signal, so that the individual pixel sections can be reset surely.

In this case, if the reset voltage has either a positive or negative polarity, an electric field in one direction is eccentrically applied to the liquid crystal 18. When such a reset voltage is applied, therefore, ionic impurity in the liquid crystal gathers on one substrate side of the liquid crystal cell 10 and gets hardened, which is likely to cause display burning or the like. In this embodiment, the reset voltage has an AC waveform which changes to the positive and negative sides at least once around the reference potential $V_O$, an ionic impurity does not gather on one substrate. This can prevent display burning.

The metastable-aligned-state selecting voltage (the difference between the reference potential $V_O$ of the scan signals ($C_1$, $C_2$, . . . , $C_8$) and the potential of the data signal $S_1$), which is to be applied to the individual pixel sections after resetting, is determined by the potential of the data signal $S_1$ which has been selected in accordance with the write data to be supplied to the column driver 42, and the liquid crystal molecules are aligned in either the first or second metastable aligned state in accordance with that metastable-aligned-state selecting voltage.

When the data signal $S_1$ has a waveform as shown in FIG. 32, the potential of the data signal in the second sub period $T_{S2}$ for selecting the metastable aligned state of the first row of pixel sections is the same potential $V_{S1}$ as the reference potential $V_O$ of the scan signal $C_1$, so that the metastable-aligned-state selecting voltage of nearly 0 V is applied to the liquid crystal 18 and the liquid crystal molecules of the first row of pixel sections assume the first metastable aligned state.

With the data signal $S_1$ having the waveform shown in FIG. 32, the potential of the data signal in the third sub period $T_{S3}$ for selecting the metastable aligned state of the second row of pixel sections is $+V_{S2D}$, so that the metastable-aligned-state selecting voltage having such a value as to align the liquid crystal molecules by an angle substantially equal to or close to the pre-tilt angle in the initial aligned state is applied to the liquid crystal layer. This aligns the liquid crystal molecules of the second row of pixel sections in the second metastable aligned state.

After the metastable aligned states of the first to eighth rows of pixel sections are selected in this manner, a write voltage equivalent to the difference between the write-period voltage $V_C$ of the scan signal C and the potential of the data signal $S_1$ is applied between the electrodes of the first row of pixel sections to write data there in the first row write period $T_{D1}$ of the next write period $T_D$. Thereafter, the remaining rows of pixel sections are rewritten in the respective row write periods, such as the second row of pixel sections in the second row write period $T_{D2}$, the third row of pixel sections in the third row write period $T_{D3}$, and so forth to the sixty-fourth row of pixel sections in the sixty-fourth row write period $T_{D64}$.

The write-period voltage $V_C$ of each scan signal in the write period $T_D$ of the first frame $T_1$ is either positive (+) or negative (−) ($+V_C$ in FIG. 32) with respect to the reference potential $V_O$, and the waveform of the data signal $S_1$ in this period $T_D$ assumes either $+V_{S2D}$ or $-V_{S2D}$ selected in accordance with the write data in each row write period $T_{D1}$, $T_{D2}$, . . . , or $T_{D64}$.

When the write-period voltage $V_C$ of each scan signal is $+V_C$ and the potential of the data signal in the first row write period $T_{D1}$ is $-V_{S2D}$ as shown in, for example, FIG. 32, therefore, a write voltage equivalent to the potential difference between $+V_C$ and $-V_{S2D}$ is applied to the first row of pixel sections, causing the effective value of the drive voltage till the first row write period $T_{D1}$ of the next frame (hereinafter called second frame) $T_2$ to become a relatively high value. As a result, this row of pixel sections assumes the first written state in which the liquid crystal molecules are aligned in the state (the lower aligned state in FIG. 3) in the metastable aligned states shown in FIG. 3, which takes place when a high effective value voltage is applied.

With the data signal $S_1$ having the waveform in FIG. 32, the potential of the data signal in the second row write period $T_{D2}$ is $+V_{S2D}$, so that a write voltage equivalent to the potential difference between $+V_C$ and $+V_{S2D}$ is applied to the second row of pixel sections. Therefore, the effective value of the drive voltage till the second row write period $T_{D2}$ of the next second frame $T_2$ becomes a relatively small value. This causes the second row of pixel sections to assume the second written state in which the liquid crystal molecules are aligned in the state (the upper aligned state in FIG. 3) in the metastable aligned states shown in FIG. 3, which takes place when a low effective value voltage is applied.

This applies to the other rows of pixel sections, so that when the potential of the data signal in the write period $T_{D2}$ of each row is $-V_{S2D}$, that row of pixel sections assumes the first written state in which the liquid crystal molecules are aligned in the aligned state which takes place when the aforementioned high effective value voltage is applied, and when the potential of the data signal is $+V_{S2D}$, that row of pixel sections assumes the second written state in which the liquid crystal molecules are aligned in the aligned state which takes place when the aforementioned low effective value voltage is applied.

When writing of the last or sixty-fourth row of pixel sections is completed and then comes the second frame T2, the individual rows of pixel sections in the pixel row group of eighth to fifteenth rows including the last pixel row in the previous pixel row group (first to eighth rows), which has undergone resetting and selection of the metastable aligned state in the first frame $T_1$, are sequentially reset and their aligned states are selected to be the first or second metastable aligned state, and the first to sixty-fourth rows of pixel sections are sequentially written in the later write period $T_D$.

In this second frame $T_2$, while the waveforms of each scan signal and data signal invert with respect to the waveforms in the first frame $T_1$, resetting of each row of pixel sections and the selection of the metastable aligned state thereof and the subsequent writing are implemented in the same way as done in the first frame $T_1$.

Specifically, the eighth row of pixel sections, for example, is reset in the first sub period $T_{S1}$ of the reset/metastable-aligned-state selecting period $T_S$ even in the second frame $T_2$ following the first frame $T_1$, the metastable aligned state is selected for the eighth row of pixel sections in the second sub period $T_{S2}$, and writing takes places in the eighth row write period $T_{D8}$ in the next write period $T_D$. As shown in FIG. 32, the first metastable aligned state is selected for the liquid crystal molecules of the eighth row of pixel sections in the second sub period $T_{S2}$ where the metastable aligned state for that row can be selected, and assume the second written state, in the metastable aligned states shown in FIG. 3, where a low effective value voltage is applied in the eighth row write period $T_{D8}$ for writing that row.

The ninth row of pixel sections is written only in the first frame $T_1$, undergoing no resetting and selection of the metastable aligned state, and is reset in the second sub period $T_{S2}$ of the reset/metastable-aligned-state selecting period $T_S$ in the second frame $T_2$, the metastable aligned state is selected for the ninth row of pixel sections in the third sub period $T_{S3}$, and writing takes places in the ninth row write period $T_{D9}$ in the next write period $T_D$. As shown in FIG. 32, the first metastable aligned state is selected for the liquid crystal molecules of the ninth row of pixel sections in the third sub period $T_{S3}$ where the metastable aligned state for that row can be selected, and assume the first written state, in the metastable aligned states shown in FIG. 3, where a high effective value voltage is applied in the ninth row write period $T_{D9}$ for writing that row.

With regard to the eighth row of pixel sections, the first row in the group of the eighth to fifteenth pixel rows which are to undergo resetting and selection of the metastable aligned state in the second frame $T_2$, resetting and selection of the metastable aligned state and writing are temporarily carried out in the first frame $T_1$, the written state in the first frame $T_1$ is reset and the metastable aligned state is selected again in the second frame $T_2$, after which writing is performed again to assume the written state according to the effective value of the drive voltage till the eighth row write period $T_{D8}$ of the next, third frame $T_3$.

The write voltage to be applied to all the rows of pixel sections except the group of the eighth to fifteenth pixel rows, which are to undergo resetting and selection of the metastable aligned state in the second frame $T_2$, is a rewrite voltage for keeping the written states in the first frame $T_1$, and the rewrite voltage applied to those rows of pixel sections is the same as that applied in the first frame $T_1$.

Thereafter, resetting of one group of pixel rows and the selection of the metastable aligned state therefor and writing of all the pixel rows are likewise executed frame by frame, until resetting of a group of fifty-seventh to sixty-fourth pixel rows and the selection of the metastable aligned state therefor and writing of all the pixel rows are carried out in the ninth frame to rewrite one screen of images.

In the next one cycle (the tenth to eighteenth frames), resetting of one of groups of the sixty-fourth to seventh pixel rows, the seventh to fourteenth pixel rows, the fourteenth to twenty-first pixel rows, . . . , and the fifty-sixth to sixty-third pixel rows, and the selection of the metastable aligned state for that group, and writing of all the pixel rows are executed frame by frame to rewrite one screen of images.

In the subsequent cycle (the nineteenth to twenty-seventh frames), resetting of one of groups of the sixty-third to sixth pixel rows, the sixth to thirteenth pixel rows, the thirteenth to twentieth pixel rows, . . . , and the fifty-fifth to sixty-second pixel rows, and the selection of the metastable aligned state for that group, and writing of all the pixel rows are executed frame by frame to rewrite one screen of images.

In the yet next cycle (the twenty-eighth to thirty-sixth frames), resetting of one of groups of the sixty-second to fifth pixel rows, the fifth to twelfth pixel rows, the twelfth to nineteenth pixel rows, . . . , and the fifty-fourth to sixty-first pixel rows, and the selection of the metastable aligned state for that group, and writing of all the pixel rows are executed frame by frame to rewrite one screen of images.

In those cycles, what undergoes display rewriting in one of the nine frames is only the eight rows of pixel sections in the group which is subjected to resetting and the selection of the metastable aligned state and then to writing, and the rewrite voltage identical to the write voltage in the previous frame is applied to each of the other rows of pixel sections to maintain the written state until resetting and the selection of the metastable aligned state for that pixel row are performed next, as mentioned above.

Of the individual pixel rows, the pixel sections in any row which overlaps over two groups (e.g., the eighth, fifteenth, twenty-second, . . . , and fifty-seventh rows in the grouping of the first to eighth rows, the eighth to fifteenth rows, the fifteenth to twenty-second rows, . . . , and fifty-seventh to sixty-sixth rows) are subjected to resetting and the selection of the metastable aligned state twice in succession in the successive two frames and the written states assumed in a later frame are maintained until resetting and the selection of the metastable aligned state for that pixel row are performed next.

Although the selection of the metastable aligned state and writing on such an overlapping row of pixel sections in the first one of the aforementioned two succeeding frames are temporary actions until they are reset again in the next frame, it is desirable that the selection of the metastable aligned state and writing in the previous frame should be set identical to the previous metastable aligned state and written state or identical to the metastable aligned state and written state which are to be selected in the next frame.

When the reset voltage has a waveform which rises only on the positive or negative side as in the first embodiment, an ionic impurity in the liquid crystal is likely to gather on one substrate side of the liquid crystal cell 10 upon application of the reset voltage.

The liquid crystal molecules, which have been aligned substantially perpendicular to the substrate surface by the application of the reset voltage, are aligned in the first or second metastable aligned state by the metastable-aligned-state selecting voltage to be applied next. When gathering of an ionic impurity in the liquid crystal on one substrate side occurs when the reset voltage is applied, an electric field is produced between the substrates by the eccentric distribution of the ionic impurity. With this field generated, the metastable-aligned-state selecting voltage is applied. Even when the first and/or second metastable-aligned-state selecting voltage is applied to the liquid crystal 18, the adequate metastable aligned state may not be selected.

Because an AC reset voltage is used according to this embodiment, however, it is possible to prevent an ionic impurity from gathering on one substrate side which otherwise produces a potential difference between the substrates. It is thus possible to surely align the liquid crystal molecules in the first or second metastable aligned state by applying the metastable-aligned-state selecting voltage after resetting. This can allow the adequate metastable aligned state to be selected and an image with a high fidelity to display data to be displayed.

As the scan signal and data signal have the waveforms as shown in FIG. 32 in the foregoing description, the reset voltage to be applied between the electrodes of the pixel sections of the liquid crystal cell 10 has a waveform formed by a combination of a pulse which rises toward the positive side and a pulse which rises toward the negative side, as shown in FIG. 33. There may be a plurality of pulses which rise toward the positive side and a plurality of pulses which rise toward the negative side.

Although the pixel rows of the liquid crystal cell 10 are so grouped that one group consists of a predetermined number of adjoining pixel rows, such as the first to eighth rows, the eighth to fifteenth rows, the fifteenth to twenty-second rows, and so forth, grouping may be performed so that one group consists of a predetermined number of every other pixel rows or every some pixel rows.

Further, resetting and the selection of the metastable aligned state and the order of selecting pixel row groups to be newly written thereafter in each frame may be performed every other group or every some groups, and flickering of the screen can be suppressed more by selecting such a pixel row group and executing resetting and the selection of the metastable aligned state of the individual pixel rows in that group, and subsequent writing.

Furthermore, to simplify the structures of the column driver 42 and the power source 43 of the drive circuit 40, the data signal to be supplied to the individual signal electrodes of the liquid crystal cell 10 is designed to have a simple waveform whose potential varies in three ways, $V_{S1}$, $+V_{S2D}$ and $-V_{S2D}$, and $-V_{S2D}$ as shown in FIG. 32 in this driving method. As shown in FIG. 20, however, the power source 43 may supply the first and second metastable-aligned-state selecting voltages $V_{S1}$ and $V_{S2}$, and the write voltages $V_{D1}$ and $V_{D2}$, which are to be applied between the electrodes, to the column driver 42 which in turn may supply the data signal with a waveform having $V_{S1}$, $V_{S2}$, $V_{D1}$ or $V_{D2}$, selected in accordance with write data, to the individual scan electrodes of the liquid crystal cell 10.

This driving method may be applied to driving the liquid crystal cell of the liquid crystal display according to the first embodiment, in which case two effective values for selecting the first metastable aligned state to display an image differ from two effective values for selecting the second metastable aligned state to display an image so that the power source 43 should generate four types of write voltages and supply them to the row driver 41.

Seventh Embodiment

In the first to sixth embodiments, the effective voltage which is applied to the liquid crystal of the individual pixels in a rewrite frame differs from the effective voltage which is applied to the liquid crystal in a written-state holding frame. That is, the effective value of the voltage to be applied is large in the rewrite frame because of the reset voltage applied to the liquid crystal of the individual pixels, whereas the effective value of the applied voltage in the written-state holding frame is small because no reset voltage applied. The difference between effective values, if large between frames, causes a difference in the aligned state of the liquid crystal molecules, which results in different light transmitting states so that brightness fluctuates in some case.

The sixth embodiment as a solution to the above shortcoming will be discussed below by referring to FIGS. 34 and 35.

The liquid crystal cell 10 according to this embodiment may take any one of the structures of the first to fourth examples of the liquid crystal cell 10.

The driving method will now be described.

How to drive the liquid crystal cell by the drive circuit 40 will be discussed below.

The drive circuit 40 drives the individual rows of pixel sections of the liquid crystal cell 10 while rewriting one pixel row of pixel sections every predetermined number of frames. The drive circuit 40 sequentially applies the reset voltage and the metastable-aligned-state selecting voltage for selecting either the first or second metastable aligned state between the electrodes of the pixel sections, then applies the write voltage for controlling the effective value of the drive voltage in the rewrite frame where the pixel sections are rewritten. In the other frame or the written-state holding frame where the written state established in the rewrite frame, the drive circuit 40 applies a high-frequency voltage which makes the dielectric anisotropy of the liquid crystal substantially zero or negative, and then applies a write voltage whose absolute value is the same as that of the write voltage applied in the rewrite frame.

Figure 34:
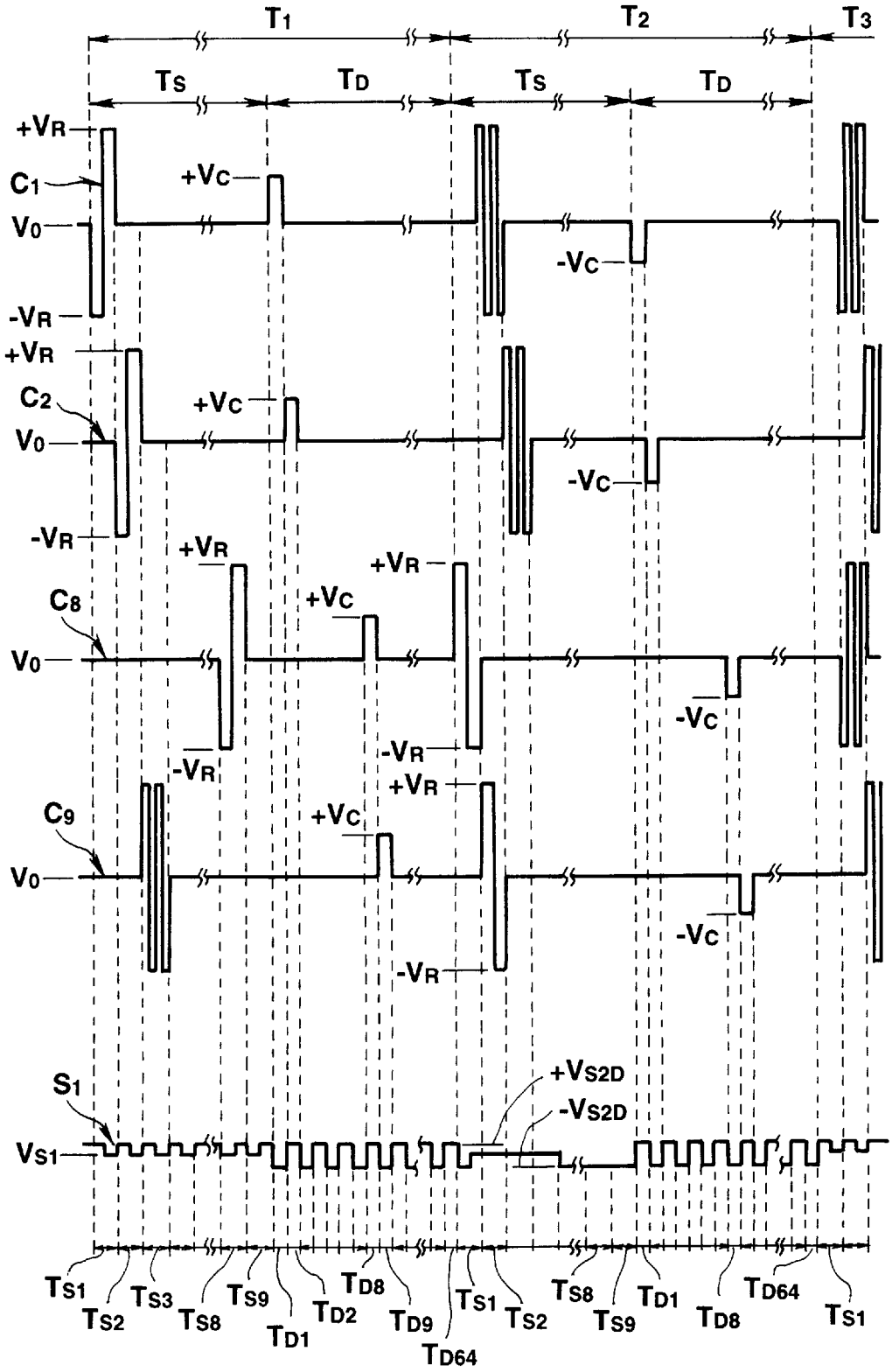
FIG. 34 is a timing chart showing waveforms of a scanning signal and a data signal for explaining a driving method for the liquid crystal display device of the present invention according to the seventh embodiment.

FIG. 34 presents a waveform chart of a scan signal and a data signal in the case where the entire 64 pixel rows of the liquid crystal cell are separated into groups of eight and the liquid crystal cell is driven by a method of shifting the boundary between a writing area and a non-writing area is shifted by one pixel row every cycle. This figure shows waveforms of scan signals $C_1$, $C_2$, $C_8$ and $C_9$ which the row driver 41 respectively supplies to the first row of scan electrodes, the second row of scan electrodes, the eighth row of scan electrodes, and the ninth row of scan electrodes, and the waveform of a data signal $S_1$ which is supplied to the first column of signal electrodes by the column driver 42.

As shown in FIG. 34, the initial periods for all the frames T1, T2 and so forth are set to a reset/metastable-aligned-state selecting period $T_S$ for one pixel row group, and the remaining periods are set to a write period $T_D$ for all of the first to sixty-fourth pixel rows.

In this embodiment, the reset/metastable-aligned-state selecting period $T_S$ is equally divided to first to ninth periods $T_{S1}$ to $T_{S9}$, and the first pixel row in the first group of (eight) pixel rows is reset in the first sub period $T_{S1}$ while selecting the metastable aligned state of the first pixel row and resetting the second pixel row are carried out in the second sub period $T_{S2}$. Likewise, resetting the other pixel rows and selecting the metastable aligned states thereof are performed so that selecting the metastable aligned state of the seventh pixel row and resetting the eighth pixel row are carried out in the eighth sub period $T_{S8}$ and the metastable aligned state of the eighth pixel row is selected in the last, ninth sub period $T_{S9}$. For example, the reset/metastable-aligned-state selecting period $T_S$ is about 300 ms.

Further, this driving method applies a high-frequency voltage in the written-state holding frame by utilizing the reset/metastable-aligned-state selecting period $T_S$; in this embodiment, the application of the high-frequency voltage to the first row of the first group of pixel rows is executed in the second sub period $T_{S2}$, and the application of the high-frequency voltage to the second row in the third sub period $T_{S3}$. Thereafter, the application of the high-frequency voltage to the other individual rows is likewise carried out sequentially so that the application of the high-frequency voltage to the eighth row is performed in the ninth sub period $T_{S9}$. The write period $T_D$ is 10 ms, for example.

Note that the high-frequency voltage is applied only in the written-state holding frame, and no high-frequency voltage is applied to the pixels in the rewrite frame.

In this embodiment, the write period $T_D$ is equally divided into 64 periods $T_{D1}$ to $T_{D64}$ in each of which writing of one pixel row is performed one after another. In this case, as per the first to third embodiments, the write period $T_D$ is about 10 ms.

As mentioned above, the potential of each of the scan signals which are supplied to the individual scan electrodes of the liquid crystal cell 10 is set to the reference potential $V_O$ in other periods than the reset period and the write period for the pixel row associated with the scan electrode to which that scan signal is supplied, is set to an AC voltage of a low frequency, which changes to the reset voltages $-V_R$ and $+V_R$ is applied in the reset period, is set to the write-period voltage $V_C$ in the write period, and is set to a high-frequency AC voltage in the period of applying a high-frequency signal. Further, the waveform of each scan signal inverts every frame with respect to the reference potential $V_O$.

The reset voltage $V_R$ is supplied to the individual scan electrodes once in nine frames (one cycle) excluding the first pixel row in each group in the case where the last pixel row in each group overlaps the first pixel row in the next group, and the reset voltages $+V_R$ and $-V_R$ are supplied to the last pixel row in each group once each in the last reset period of one frame and the first reset period of the next frame.

In the written-state holding frame, each scan signal is set to a high-frequency AC waveform which changes between the positive reset voltage $+V_R$ and the negative reset voltage $V_R$ in the reset period in that frame.

The write-period voltage $V_C$ is supplied to the individual scan electrodes once every frame, and the period in which the reset voltages $+V_R$ and $-V_R$ are supplied is shifted by one set period every nine frames while the period in which the write-period voltage $V_C$ is supplied is the same in any frame.

Any of the individual data signals to be applied to the signal electrodes of the liquid crystal cell 10 has such a waveform that the first or second metastable-aligned-state selecting voltage $V_{S1}$ or $V_{S2}$ is supplied in every metastable-aligned-state selecting period immediately after the reset period, and two write voltages $V_{D1}$ and $V_{D2}$ are selectively supplied in every write period for each pixel row in accordance with display data, as per the first to third embodiments. The waveform inverts frame by frame with respect to the first metastable-aligned-state selecting voltage $V_{S1}$.

Figure 35:
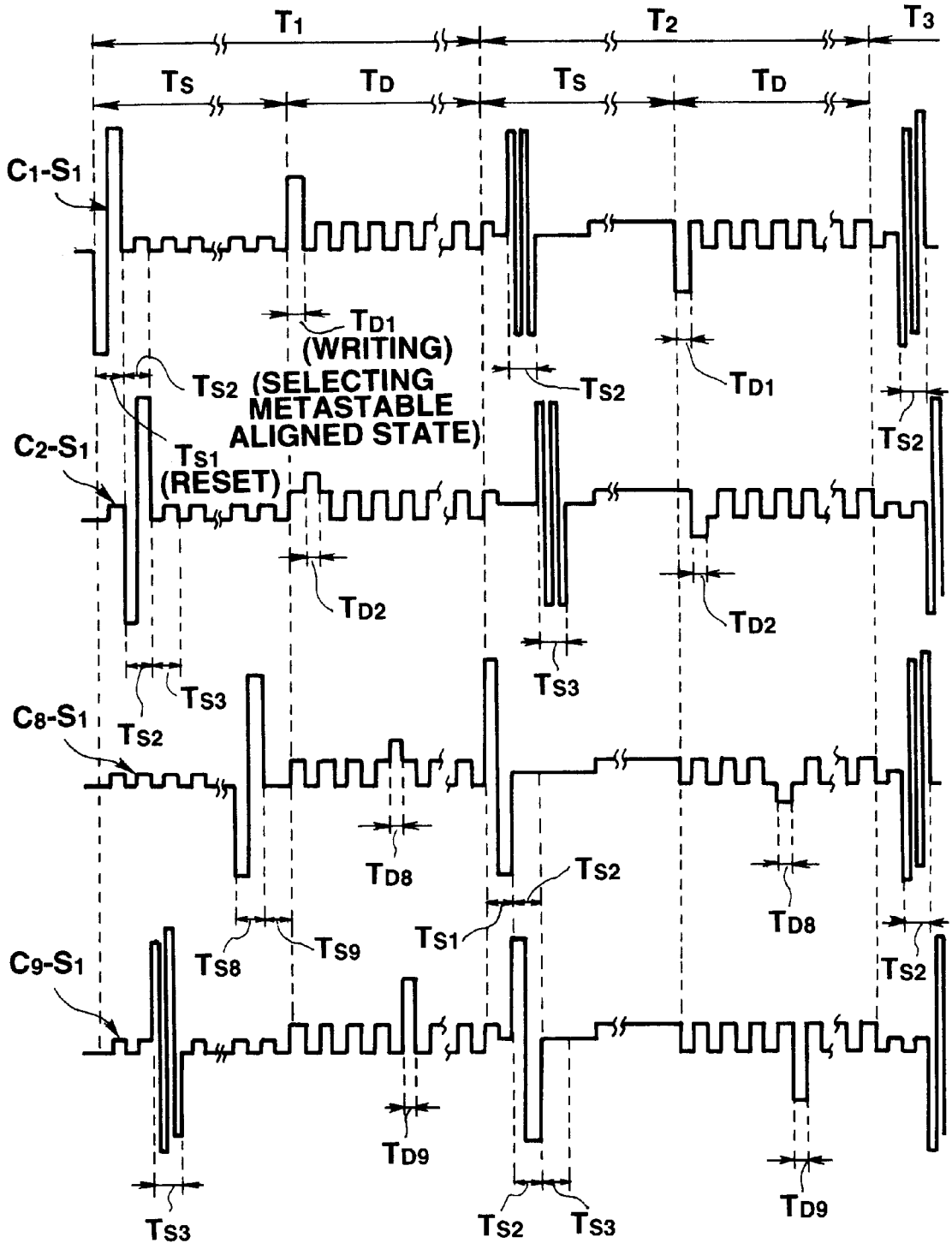
FIG. 35 is a timing chart showing waveform of voltage to be applied to the liquid crystal by the scanning signal and the data signal shown in FIG. 34.

FIG. 35 is a waveform chart for voltages which are applied between the first row, second row, eighth row and ninth row of scan electrodes and the first column of signal electrodes when the scan signals $C_1$, $C_2$, $C_8$ and $C_9$ and the data signal $S_1$ have waveforms as depicted in FIG. 34.

Referring to FIG. 35, how to drive each row of pixel sections of the liquid crystal cell 10 will be explained with reference to a case where the scan signal and data signal having waveforms as shown in FIG. 34 are supplied to the scan electrode and signal electrode for the pixel section in the first column in each row. In this example, rewriting of one screen of images in the first one cycle (first to ninth frames) starts from the first row of pixels.

First, rewriting of one screen of images in the first one cycle will be discussed. In FIG. 34, in the first frame (hereinafter called first frame) $T_1$, a low-frequency reset voltage equivalent to the potential difference between the scan signal $C_1$ and the data signal $S_1$ is applied between the electrodes of the first row of pixel sections in the group of first to eighth pixel rows in the first sub period $T_{S1}$ of the reset/metastable-aligned-state selecting period $T_S$. As a result, the liquid crystal molecules of the pixel sections are aligned to stand substantially perpendicularly, resetting the previous written state.

Next, in the second sub period $T_{S2}$ of the reset/metastable-aligned-state selecting period $T_S$, a metastable-aligned-state selecting voltage equivalent to the difference between the reference potential $V_O$ of the scan signal $C_1$ and the potential of the data signal $S_1$ is applied between the electrodes of the aforementioned first row of pixel sections, so that the aligned state of the liquid crystal molecules of the pixel sections are selected to be the first or second metastable aligned state. At the same time, a low-frequency reset voltage equivalent to the difference between the reset voltage $V_R$ of the scan signal $C_2$ and the potential of the data signal $S_1$ is applied between the electrodes of the second row of pixel sections, thus resetting the second row of pixel sections.

At this time, a high-frequency voltage equivalent to the difference between the potentials $+V_R$ and $-V_R$ of the high-frequency AC waveform of the scan signal $C_2$ and the potential of the data signal $S_1$ is applied to the second rows in the other individual pixel row groups, i.e., the ninth row, sixteenth row, . . . , and fifty-eighth row in the groups of eighth to fifteenth rows, fifteenth to twenty-second rows, . . . , and fifty-seventh to sixty-fourth rows.

It is to be noted that the liquid crystal molecules either hardly respond to a high-frequency voltage or behave so that the longer axes of the liquid crystal molecules are aligned parallel to the substrate surface. Even if the high-frequency voltage is the same as the reset voltage, therefore, the aligned state of the liquid crystal molecules will not be reset.

Then, in the third sub period $T_{S3}$ of the reset/metastable-aligned-state selecting period $T_S$, a metastable-aligned-state selecting voltage equivalent to the difference between the reference potential $V_O$ of the scan signal $C_2$ and the potential of the data signal $S_1$ is applied between the electrodes of the second row of pixel sections, so that the aligned state of the liquid crystal molecules of the second row of pixel sections are selected to be the first or second metastable aligned state, the reset voltage of a low-frequency AC waveform is applied between the electrodes of the third row of pixel sections, thus resetting the third row of pixel sections, and the high-frequency voltage is applied to each of the tenth pixel row, seventeenth pixel row, . . . , and fifty-ninth pixel row.

Thereafter, the selection of the metastable aligned state of one row of pixel sections and resetting of the next row of pixel sections are likewise carried out sequentially in each sub period of the reset/metastable-aligned-state selecting period $T_S$, and the high-frequency voltage is applied to the individual pixel rows of the other pixel row groups. The aligned state of the last row or the eighth row of pixel sections in one group is selected to be the first or second metastable aligned state in the last, ninth sub period $T_{S9}$, and, simultaneously, the high-frequency voltage is applied to the last pixel rows in the other pixel row groups, namely, the fifteenth pixel row, twenty-second pixel row, . . . , and sixty-fourth pixel row.

The above-described method of driving the liquid crystal cell applies a low-frequency AC reset voltage to the liquid crystal in the rewrite frame, and applies a high-frequency AC signal to the liquid crystal in the written-state holding frame. It is thus possible to reduce the difference between the effective value of the voltage to be applied to the liquid crystal in the rewrite frame and the effective value of the voltage to be applied to the liquid crystal in the written-state holding frame. Therefore, a stable image free of brightness fluctuation can be displayed by holding the written state or the light transmitting state, established in the rewrite frame, substantially the same even in the written-state holding frame.

Although the third to seventh embodiments have been described as being adapted to the first embodiment, the third to seventh embodiments may be adapted to the second embodiment.

Eighth Embodiment

When a power switch 47 is cut, voltage supply (the supply of the scan signal and data signal) to the liquid crystal cell 10 from the drive circuit 40 is cut off, and the aligned state of the liquid crystal molecules in the first or second metastable aligned state returns to the initial aligned state, so that the screen returns to the one presented in the initial aligned state where no voltage is applied.

When the application of the drive voltage is cut off at the same time as the power switch 47 is disabled, therefore, the displayed image at the time of power cutoff changes as if it lost its shape as the time passes, and eventually assumes the screen that is presented in the initial aligned state where no voltage is applied.

The time for returning to the initial aligned state from the first or second metastable aligned state varies in a range of several seconds to several minutes, depending on the characteristic of the nematic liquid crystal in use, the characteristic of a chiral agent and the amount of the chiral agent added.

An afterimage raises a problem particularly in color display. In the first example of the liquid crystal display device, for example, when the application of the drive voltage in the display state is cut off, the display of the pixel sections in the first metastable aligned state becomes white in the initial aligned state while changing its color in accordance with the voltage drop caused by the natural discharge, and the display of the pixel sections in the second metastable aligned state becomes white in the initial aligned state while the color is gradually fading in accordance with the voltage drop caused by the natural discharge. Apparently, the change in color varies, pixel by pixel, in the process of returning to the initial aligned state, so that the afterimage changes as if it lost the shape.

A liquid crystal display according to an embodiment which prevents such a phenomenon will be discussed below.

The drive circuit 40 of the liquid crystal display according to this embodiment sequentially applies the reset voltage and a select pulse for selecting a predetermined metastable aligned state of the first and second metastable aligned states to all the pixel sections of the liquid crystal cell 100 in response to the OFF action of the power switch 47, and then applies the last drive voltage of a predetermined effective value after which it stops applying the drive voltage.

At the time the power switch 47 is disabled, therefore, the display screen becomes a plain screen in which all the pixels have substantially the same colors and the same transmittances. Even when the display colors of the individual pixels change thereafter due to natural discharge, those changes are nearly uniform so that the screen does not become unsightly.

This will be discussed more specifically. When the power switch 47 is switched off, the display OFF controller 46 detects the action and instructs the row driver 41 and the column driver 42 to terminate the display.

In response to the instruction, the row driver 41 and the column driver 42 start a new display frame for terminating the display.

First, in the first frame $T_1$, the row driver 41 sequentially applies the reset voltage the first group (first to eighth pixel rows) of scan electrodes 13 in the reset/metastable-aligned-state selecting period $T_S$. During this period, the column driver 42 keeps outputting the metastable-aligned-state selecting voltage for selecting one of the first and second metastable aligned states. Accordingly, the liquid crystal of all the pixels in the first to eighth pixel rows is set in one of the first and second metastable aligned states.

In the subsequent write period $T_D$, the row driver 41 sequentially applies the write voltage the first group (first to eighth pixel rows) of scan electrodes 13 in the reset/metastable-aligned-state selecting period $T_S$. During this period, the column driver 42 keeps outputting the drive voltage for selecting one of the two aligned states, the first metastable aligned state or the second metastable aligned state. Accordingly, all the pixels in the first to eighth pixel rows are set to predetermined colors.

Then, a similar process is performed on the second group (the eighth to fifteenth pixel rows), the third group (the fifteenth to twenty-third pixel rows), and so forth, in the second frame $T_2$, the third frame $T_3$, etc.

When processing of the last pixel row is completed, the display OFF controller 46 sends a display end signal to the power source 43. This display end signal causes the power source 43 to stop generating power.

Pixel rows to be selected commonly may not be arranged over a plurality of frames in the display terminating process, which may be performed on the first to eight pixel rows in the first frame, the ninth to sixteenth pixel rows in the second frame and so forth.

Power supply to the power source 43 is stopped after the operation of the power source 43 is completed, so that switching the power switch 47 off does not stop power supply to the power source 43.

According to this display terminating process, it is desirable that the color of the screen immediately after the power switch 47 is switched off should be the same as the color of the screen acquired upon application of no voltage. This is because even when the display color of each pixel changes later due to natural discharge, no substantial change appears in the display color of the screen.

The color of the screen when the power switch 47 is switched off can be set in the above manner by setting the metastable aligned state and the last drive voltage selected by the drive circuit 40 in such a way that the metastable aligned state and the effective value of the drive voltage can provide the outgoing light whose color and/or transmittance are substantially the same color and/or the same transmittance as those obtained in the initial aligned state where no voltage is applied.

In the first example of the liquid crystal display device as shown in FIG. 2, for example, the color of the screen in the initial aligned state where no voltage is applied is white, and the colors displayable in the first metastable aligned state are red and blue while black is the color displayable in the second metastable aligned state. When the power switch 47 is disabled, the liquid crystal of all the pixel sections should be switched to the second metastable aligned state and the last drive voltage with the effective value (1.55 V) which sets the display of all the pixel sections white should be applied in that state.

The color of the plain screen when the power switch 47 is cut is not limited to the same color as that of the screen presented in the initial aligned state where no voltage is applied, but any one of colors that can be displayed in the first and second metastable aligned states may be selected arbitrarily.

In that case, in the process that the liquid crystal molecules return to the initial aligned state due to the voltage drop caused by natural discharge after the application of the last drive voltage is inhibited, the color of the screen changes to the color of the screen, obtained when no voltage is applied, from the color of the plain screen at the time the power switch 47 is disabled. As the color change is uniform over the entire screen, however, the screen would appear to have very naturally returned to the screen in the initial aligned state where no voltage is applied.

According to the first to eighth embodiments, the reset voltage is applied to switch between two metastable aligned states and switch the state of effective-value driving in one of the metastable aligned states. It is thus possible to switch the liquid crystal molecules from the reset state, ensuring reliable switching and fast response.

According to the first to eighth embodiments, the reset voltage is normally applied even when the metastable aligned state is to be switched over successive frames. It is therefore possible to prevent the property of memorizing the metastable aligned state from being degraded and to implement adequate display.

What is claimed is:

1. A liquid crystal display using bistable nematic liquid crystal comprising:

a liquid crystal cell having a pair of substrates having opposing electrodes and aligning films respectively formed on opposing inner surfaces of said pair of substrates, said aligning films having been subjected to an aligning treatment in a predetermined direction, and a liquid crystal layer of a bistable nematic liquid crystal material, sealed between said pair of substrates and having liquid crystal molecules selectively alignable in one of a first metastable aligned state and a second metastable aligned state different from each other by selective application of a twist select voltage having a plurality of different predetermined voltage values smaller than a voltage value of a reset voltage after application of said reset voltage, said voltage value of said reset voltage being such as to align said liquid crystal molecules substantially perpendicular to said substrates, a tilt angle of said liquid crystal molecules to said substrates being controlled in said first metastable aligned state and said second metastable aligned state in accordance with an effective value of a voltage to be applied to said opposing electrodes;

at least one polarizing plate located on one outer side or both outer sides of said pair of substrates;

a first driver for, in accordance with display data externally supplied, supplying a reset potential for applying said reset voltage between said electrodes, and a write-period voltage for designating a period for applying a voltage with an effective value according to said display data between said electrodes, both to one of said electrodes of said pair of substrates;

a second driver for, in accordance with said display data, supplying a metastable-aligned-state selecting voltage for selectively applying a first metastable-aligned-state selecting voltage and a second metastable-aligned-state selecting voltage between said electrodes, and a write voltage for, in accordance with said display data, varying said effective value of said applied voltage during a period designated by said write-period voltage, both to the other electrode of said pair of substrates respectively in synchronism with said reset voltage and said write-period voltage; and a power source for supplying said reset voltage, said write-period voltage, said metastable-aligned-state selecting voltage and said write voltage to said first driver and said second driver.

2. The liquid crystal display according to claim 1, wherein said opposing electrodes include a plurality of scan electrodes arranged in a stripe form on one of said substrates and a plurality of signal electrodes so arranged as to intersect said scan electrodes; and said pair of substrates and said liquid crystal layer constitute a simple matrix type liquid crystal cell.

3. The liquid crystal display according to claim 1, wherein said opposing aligning films cause said liquid crystal to be spray-strained by a twist angle of 0° to 180° in an initial aligned state;

said first metastable aligned state is a state where said liquid crystal is twisted by a twist angle which is 180° plus said twist angle in said initial aligned state; and said second metastable aligned state is a state where said liquid crystal is twisted by a twist angle which is 180° subtracted from said twist angle in said initial aligned state.

4. The liquid crystal display according to claim 1, wherein at least one of said reset voltage and said metastable-aligned-state selecting voltage is comprised of an AC voltage.

5. The liquid crystal display according to claim 1, wherein said reset voltage is greater than a minimum voltage value necessary to align said liquid crystal molecules substantially perpendicular to said substrates; and an application period for said reset voltage is set shorter than a time for said liquid crystal molecules to be aligned substantially perpendicular to said substrates by application of said minimum voltage value.

6. The liquid crystal display according to claim 1, wherein said reset voltage includes a reset voltage of a first frequency by which said liquid crystal molecules shows a positive dielectric anisotropy and a reset voltage of a second frequency by which said liquid crystal molecules shows a negative dielectric anisotropy; and said first driver applies said reset voltage of said first frequency to said one electrode which is to be set in one of said first and second metastable aligned states, and applies said reset voltage of said second frequency to said one electrode which is to hold said previously set first or second metastable aligned state.

7. The liquid crystal display according to claim 1, wherein said second driver has means for frequency-modulating a voltage and applying said frequency-modulated voltage to said other electrode.

8. The liquid crystal display according to claim 1, wherein said second driver has means for performing pulse width modulation on a voltage and applying said pulse-width-modulated voltage to said other electrode.

9. The liquid crystal display according to claim 1, wherein said first and second drivers apply said metastable-aligned-state selecting voltage after applying said reset voltage to said liquid crystal.

10. The liquid crystal display according to claim 1, wherein after applying said reset voltage even to liquid crystal of pixels whose metastable aligned state to be selected is the same as a previous one, said first and second drivers apply said metastable-aligned-state selecting voltage to said liquid crystal, thereby setting an old metastable aligned state again.

11. The liquid crystal display according to claim 1, wherein said pair of substrates, said liquid crystal layer sealed between said pair of substrates, and said at least one polarizing plate located outside said pair of substrates form a liquid crystal cell which presents a display color in said initial aligned state substantially matching with at least one of display colors obtained when said write voltage is applied.

12. The liquid crystal display according to claim 11, wherein said first driver and/or said second driver includes control means for applying an effective value voltage for displaying a color substantially matching with said display color in said initial aligned state between said opposing electrodes and then stopping voltage supply between said opposing electrodes.

13. The liquid crystal display according to claim 1, wherein said first driver and said second driver perform rewriting a plurality of pixels, comprised of an intersecting portion between said one electrode and said other electrode and liquid crystal therebetween, over a plurality of frames for image display and setting an aligned state of liquid crystal of plural rows of pixels previously selected in each frame;

said first driver sequentially applies said reset voltage to one of said electrodes which constitutes an associated group of pixel rows in each frame period; and said second driver applies, to the other electrode, said metastable-aligned-state selecting voltage for selecting a metastable aligned state of liquid crystal of those pixels to which said reset voltage is applied.

14. The liquid crystal display according to claim 13, wherein said first and second drivers sequentially alter a composition of pixel rows constituting each group.

15. The method according to claim 1, wherein at least one of said reset voltage applying step and said metastable-aligned-state selecting voltage applying step includes a step of frequency-modulating a voltage and applying said frequency-modulated voltage.

16. A method of driving a liquid crystal display device comprising the steps of:

preparing a liquid crystal cell including a pair of substrates having opposing electrodes and aligning films respectively formed on opposing inner surfaces of said pair of substrates, said aligning films having been subjected to an aligning treatment in a predetermined direction, a liquid crystal layer of a bistable nematic liquid crystal material, sealed between said pair of substrates and having liquid crystal molecules selectively alignable in one of a first metastable aligned state and a second metastable aligned state different from each other by selective application of a twist select voltage having a plurality of different predetermined voltage values smaller than a voltage value of a reset voltage after application of said reset voltage, said voltage value of said reset voltage being such as to align said liquid crystal molecules substantially perpendicular to said substrates, a tilt angle of said liquid crystal molecules to said substrates being controlled in said first metastable aligned state and said second metastable aligned state in accordance with an effective value of a voltage to be applied to said opposing electrodes, and at least one polarizing plate located on one outer side or both outer sides of said pair of substrates;

supplying a reset potential for applying said reset voltage between said electrodes, to one of said electrodes of said pair of substrates in accordance with display data externally supplied;

supplying a metastable-aligned-state selecting voltage for selecting a first metastable-aligned-state selecting voltage and a second metastable-aligned-state selecting voltage, between said electrodes in accordance with said display data; and supplying a write voltage for, in accordance with said display data, varying said effective value of said applied voltage during a period designated by said write-period, between said electrodes.

17. The method according to claim 16, wherein said step of preparing said liquid crystal cell prepares a liquid crystal cell having said liquid crystal spray-strained by a twist angle of 0° to 180° in an initial aligned state;

said step of applying said metastable-aligned-state selecting voltage includes a step of selectively applying to said liquid crystal a voltage for twisting liquid crystal molecules by a twist angle which is 180° plus said twist angle in said initial aligned state, and a voltage for twisting said liquid crystal molecules by a twist angle which is 180° subtracted from said twist angle in said initial aligned state.

18. The method according to claim 16, wherein at least one of said reset voltage applying step and said metastable-aligned-state selecting voltage applying step comprises a step of applying an AC voltage between said electrodes.

19. The method according to claim 16, wherein said reset voltage is greater than a minimum voltage value necessary to align said liquid crystal molecules substantially perpendicular to said substrates; and said reset voltage applying step applies said reset voltage between said electrodes for a period shorter than a time required for said liquid crystal molecules to be aligned substantially perpendicular to said substrates by application of said minimum voltage value.

20. The method according to claim 16, wherein said reset voltage includes a reset voltage of a first frequency by which said liquid crystal molecules shows a positive dielectric anisotropy and a reset voltage of a second frequency by which said liquid crystal molecules shows a negative dielectric anisotropy; and said reset voltage applying step applies said reset voltage of said first frequency between said electrodes sandwiching a liquid crystal area which is to be set in one of said first and second metastable aligned states, and applies said reset voltage of said second frequency between said electrodes sandwiching a liquid crystal area which is to hold one of said first or second metastable aligned state previously set.

21. The method according to claim 16, wherein at least one of said reset voltage applying step and said metastable-aligned-state selecting voltage applying step includes a step of performing pulse width modulation on a voltage and applying said pulse-width-modulated voltage to said other electrode.

22. The method according to claim 16, wherein said reset voltage applying step and said metastable-aligned-state selecting voltage applying step apply said metastable-aligned-state selecting voltage after applying said reset voltage.

23. The method according to claim 16, wherein said reset voltage applying step and said metastable-aligned-state selecting voltage applying step apply said reset voltage even to liquid crystal of pixels to which the same metastable aligned state as a directly previous one is to be set, and then apply said metastable-aligned-state selecting voltage to thereby set an old metastable aligned state again.

24. The method according to claim 16, wherein in response to an instruction to disable display, an effective value voltage for displaying a color substantially matching with a display color in an initial aligned state is applied between said opposing electrodes, and then voltage supply between said opposing electrodes is stopped.

25. The method according to claim 16, wherein said reset voltage applying step and said metastable-aligned-state selecting voltage applying step rewrite one screen of images over a plurality of frames, and apply said reset voltage, and said metastable-aligned-state selecting voltage or selecting said metastable aligned state, between said opposing electrodes of individual pixel rows in a group of a plurality of pixel rows in each frame.

26. The method according to claim 25, wherein said reset voltage applying step and said metastable-aligned-state selecting voltage applying step sequentially alter a composition of pixel rows constituting each group.

* * * * *